US006584780B2

(12) United States Patent
Hibino et al.

(10) Patent No.: US 6,584,780 B2
(45) Date of Patent: Jul. 1, 2003

(54) SYSTEM FOR STORING DISSOLVED METHANE-BASE GAS

(75) Inventors: Kouetsu Hibino, Nisshin (JP); Nobutaka Honma, Susono (JP); Yukio Terashima, Mishima (JP); Tamio Shinozawa, Numazu (JP); Toshiharu Okui, Tokyo (JP); Kiyoto Inomata, Tokyo (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 10/244,408

(22) Filed: Sep. 17, 2002

(65) Prior Publication Data

US 2003/0094002 A1 May 22, 2003

Related U.S. Application Data

(63) Continuation of application No. 09/868,181, filed on Jun. 15, 2001, now abandoned.

(30) Foreign Application Priority Data

Dec. 15, 1998 (JP) ..... 10-355672
Dec. 16, 1998 (JP) ..... 10-357603
Jun. 8, 1999 (JP) ..... 11-161156

(51) Int. Cl.[7] ..... F17C 11/00; F17C 13/02; F25B 19/00

(52) U.S. Cl. ..... 62/46.1; 62/7; 62/49.1

(58) Field of Search ..... 62/46.1, 48.2, 62/50.2, 50.5, 7, 49.1, 49.2, 54.1; 585/14

(56) References Cited

U.S. PATENT DOCUMENTS 3,468,134 A 9/1969 Garst
3,807,181 A * 4/1974 Kuhne ..... 405/59
4,372,753 A 2/1983 Narasimhan, Jr. et al.
5,315,054 A 5/1994 Teel
RE35,874 E 8/1998 Neeser et al.
5,900,515 A 5/1999 Mallinson et al.

FOREIGN PATENT DOCUMENTS

DE 24 38 194 8/1974
EP 0874189 10/1998

(List continued on next page.)

OTHER PUBLICATIONS

Wang, L., et al., "Model and experimental data research of natural gas storage for vehicular usage,"*Separation and Purification Technology, Elsevier*, 12:35–41 (1997).

"Miscibility, Solubility and Retrograde Prediction of Methane in Liquids. Liquid Storage of Natural Gas (LSNG) for Vehicle Fuel," *Annual Report, Gas Research Institute*, Jul. 15, 1992–Jul. 15, 1993.

International Search Report.

Russian Office Action with English translation.

*Primary Examiner*—William C. Doerrler
(74) *Attorney, Agent, or Firm*—Finnegan, Henderson, Farabow, Garrett & Dunner, L.L.P.

(57) ABSTRACT

A system stores densely dissolved methane-base gas and supplies gas of a predetermined composition. A container (10) stores methane-base gas dissolved in hydrocarbon solvent and supplies it to means for adjusting composition, through which an object of regulated contents is obtained. Preferably, the means for adjusting composition is means for maintaining the tank in a supercritical state, or piping (48) for extracting substances at a predetermined ratio from the gas phase (12) and liquid phase (16) in the container.

49 Claims, 54 Drawing Sheets

FOREIGN PATENT DOCUMENTS

| | | |
|---|---|---|
| GB | 1 303 378 | 1/1973 |
| JP | 48-51849-01 | 10/1946 |
| JP | 46-20149 | 6/1971 |
| JP | 47-27204 | 10/1972 |
| JP | 47-33069 | 11/1972 |
| JP | 48-13324 | 4/1973 |
| JP | 49-34443 | 9/1974 |
| JP | 52-44412 | 4/1977 |
| JP | 56-161495 | 12/1981 |
| JP | 61-197897 | 9/1986 |
| JP | 61197897 | 9/1986 |
| JP | 6-47003 | 11/1994 |
| JP | 9-87645 | 3/1997 |
| JP | 9087645 | 3/1997 |
| JP | 9-132580 | 5/1997 |
| JP | 10-299996 | 11/1998 |
| RU | 96102430 | 2/1996 |
| SU | 1520295 | 11/1989 |

* cited by examiner

P-t CURVES OF METHANE-PROPANE COMPOSITS

Fig.40

| | | | | | | | | | OVERALL EFFICIENCY |
|---|---|---|---|---|---|---|---|---|---|
| | EFFICIENCY→ | 0.88 | 0.95 | 0.4 | 0.9 | | | | |
| ELECTRIC POWER GENERATION AT POWER STATION | NATURAL GAS → | LIQUEFACTION → | TRANSPORTATION → | THERMAL POWER PLANT → | POWER TRANS-MISSION | | | | 0.30 |
| | EFFICIENCY→ | 0.88 | 0.95 | 0.95 | 0.75 | 0.65 | 0.9 | | |
| ELECTRIC POWER GENERATION FOR FC-POWERED MOTOR VEHICLE | NATURAL GAS → | LIQUEFACTION → | TRANSPORTATION → | SUPER CRITICAL → | REFORMING → | FC → | CONNECTION TO SYSTEM | | 0.367 |
| | | | | 0.95 | 0.68 | 0.65 | 0.9 | | |
| | | | | CNG → | REFORMING → | FC → | CONNECTION TO SYSTEM | | 0.332 |

SYSTEM FOR STORING DISSOLVED METHANE-BASE GAS

This is a continuation of application Ser. No. 09/868,181 filed Jun. 15, 2001, abandoned.

TECHNICAL FIELD

The present invention relates to an improved gas liquefying and storage system, and especially to a system for storing a gas whose principal ingredient is methane by mixing the gas with another hydrocarbon (an organic solvent) for storage.

BACKGROUND ART

Until now, there have been several different methods for storing methane or a gas, such as natural gas, whose principal ingredient is methane. For example, storing the gas by compression under a high pressure or by adsorption to an adsorbent are both possible methods. In addition, methods have been proposed in which methane is dissolved in a composite hydrogen solvent such as propane, butane, etc. and then stored in a liquid state. For example, U.S. Pat. No. 5,315,054 discloses such a methane liquefying and storing method.

The disclosure of U.S. Pat. No. 5,315,054, however, only describes that methane could be stored by simply dissolving it in a hydrocarbon solvent. This method is not sufficient for storing methane with a high density.

Furthermore, there is no disclosure of a method for discharging methane, or gas whose principal ingredient is methane, with a constant ratio of constituents. When the ratio of the constituents of the gas or liquid discharged from a storage container is not constant, disadvantages, such as variation in flammability and unstable combustion in an internal engine or the like, are experienced.

The present invention addresses problems posed with the prior art and its object is to provide a gas liquefying and storage system for a gas whose principal ingredient is methane, making it possible to store methane with a high density and to discharge stored material while maintaining a constant ratio of constituents.

DISCLOSURE OF THE INVENTION

To attain the above-described object, the present invention provides a gas liquefying and storage system for methane-base gas (gas whose principal ingredient is methane), for dissolving such gas in a hydrocarbon solvent for storage in a storage container and discharging stored material from the storage container for use. This system is furnished with a composition adjusting means for maintaining constant rates of the constituents of stored material being discharged.

The composition adjusting means included in the above system maintains constant rates of the constituent elements of the contents of the storage container.

A hydrocarbon solvent that is applied to the above system is a hydrocarbon that is liquid at room temperature.

A hydrocarbon solvent that is also applied to the above system is a composite solvent of a hydrocarbon that does not readily liquefy at room temperature and a hydrocarbon that is liquid at room temperature.

Hexane is a hydrocarbon solvent applicable to the above system.

Gasoline or light oil is also a hydrocarbon solvent applicable to the above system.

Dimethyl ether is also a hydrocarbon solvent applicable to the above system.

In the above system, a super-critical state exists in the storage container at least during an initial period of discharge of the stored material.

In the above system, the ratio of the constituent elements of the contents of the storage container may be such that a hydrocarbon of a carbon number of 3 or higher is between 7% and 45%, while a hydrocarbon of a carbon number of 2 or lower is between 93% and 55%.

In another aspect of the above system, the ratios of the constituent elements of the contents of said storage container may be such that a hydrocarbon of a carbon number of 3 or higher is between 7% and 65%, while a hydrocarbon of a carbon number of 2 or lower is between 93% and 35%.

Butane is applicable to the above system as the principal hydrocarbon ingredient of with a carbon number of 3 or higher.

Propane is also applicable to the above system as the principal hydrocarbon ingredient of with a carbon number of 3 or higher.

In the above system, the storage container may be temperature-regulated such that its internal super-critical state will be maintained.

The above system may preferably include a means for determining the conditions in the storage container in order to determine the ratio of the constituents of the hydrocarbon and the quantity of the hydrocarbon contained in the storage container; and a supply ratio control means for calculating a ratio at which the gas whose principal ingredient is methane and the hydrocarbon solvent are supplied to the storage container, based on the result of the above detection and executing the supply.

This supply ratio control means may calculate a supply ratio, based on the supply quantity of the gas bearing methane as the principal ingredient.

The above means for determining the conditions in the storage container will detect pressure, temperature, and solvent solution quantity in the storage container and obtain the ratios of the hydrocarbon constituents and the hydrocarbon quantity from these parameters.

In the above system, the hydrocarbon discharged from said storage container may be oxidized in an internal combustion engine and the means for determining the conditions in the storage container may obtain the ratios of the hydrocarbon constituents, based on the output from an air-fuel ratio determining means provided to the internal combustion engine.

In another aspect of the above system, a vapor-phase outlet is provided at the top of the storage container, a liquid quantity detector is installed to detect the quantity of liquid hydrocarbon solvent in the storage container, just the vapor-phase portion of stored material in the storage container is exclusively discharged through the vapor-phase outlet, and the quantity of hydrocarbon solvent to be supplied for recharging is calculated based on the result obtained by the liquid quantity detector.

In another aspect of the above system, a withdrawal container is installed to receive the withdrawn remaining hydrocarbon from the storage container, and the withdrawn hydrocarbon and the gas whose principal ingredient is methane are supplied after the hydrocarbon solvent is supplied.

In another aspect of the above system, a temporary charging container is connected to the storage container, the hydrocarbon solvent is supplied to this temporary charging container before the gas whose principal ingredient is methane, and the gases are supplied together to the storage container.

In another aspect of the above system, a temporary charging container for exclusive solvent use is installed in parallel connection with the storage container so as to be positioned higher than the liquid level of the storage container via piping equipped with a means of controlling passage; the temporary charging container for exclusive solvent use is charged with the hydrocarbon solvent while the passage is closed, and the hydrocarbon solvent enters the storage container when the passage is opened.

In another aspect of the above system, a storage container is installed on a mobile body and a hydrocarbon solvent-dedicated storage container for storing only the hydrocarbon solvent is connected to this storage container.

In another aspect of the above system, material stored in gas is discharged from the vapor-phase portion of the storage container and the hydrocarbon solvent in liquid phase is separated from the discharged gas and returned to the storage container.

In another aspect of the above system, material stored in a liquid is discharged from the liquid-phase portion of the storage container in a small amount such that no substantial change of internal pressure of said storage container occurs and the discharged liquid is returned to the storage container after the vaporization of gas whose principal ingredient is methane from the liquid.

In the above system, the vapor-phase hydrocarbon may be discharged from the top of the storage container and the liquid-phase hydrocarbon may be discharged from the bottom of the storage container at a constant ratio.

The storage container in the above system may be furnished with a liquid quantity detector.

In another aspect of the above system, the stored material discharged from the storage container oxidized in an internal combustion engine and the means for determining the conditions in the storage container obtains the ratios of the hydrocarbon constituents, based on the output from an air-fuel ratio determining means provided to the internal combustion engine.

In the above system, the discharged vapor-phase and liquid-phase hydrocarbons may be heated to blend together.

In the above system, the discharged liquid-phase hydrocarbon may be vaporized and then blended together with the discharged vapor-phase hydrocarbon.

In the above system, the storage container may be cooled while being supplied with said gas.

In another aspect of the above system, the storage container is furnished with a plurality of charging ports positioned apart from each other, and, during the charging with a gas whose principal ingredient is methane, one charging port may initially be used and then the charging may be switched to another charging part.

In another aspect of the above system, the storage container is furnished with a heat conducting means covering the inner surface of the storage container and connected to a charging port for a gas whose principal ingredient is methane, said charging port provided on the storage container.

In another aspect of the above system, the storage container is furnished with a plurality of charging ports positioned apart from each other and the charging ports may be used at the same time.

In another aspect of the above system, a passage extension member extending from a charging port provided on the storage container and entering the internal space of the container is installed, and this passage extension member has a plurality of release openings arranged along its longitudinal direction so as to be adequately separated from the inner walls of the container.

These release openings may be angled as internal outlets of a charging port provided on the storage container.

In the above system, a charging port may be positioned at the far end from the area that holds the solvent in the storage container.

In the above system, a porous body may be fit in the storage container.

With the above system, charging may be performed such that the use of a charging port provided at the bottom of said storage container may begin while gas is being charged.

In another aspect of the above system, a portion of the hydrocarbon solvent is vaporized and released outside the storage container before the storage container is charged with a gas whose principal ingredient is methane.

In the above system, stored material may be released outside the storage container via a decompression passage provided inside or on the surface of the storage container.

This decompression passage may be covered with heat-regenerative material.

The above system can be charged with a cooled hydrocarbon solvent before being charged with gas whose principal ingredient is methane.

The storage container in the above system may be furnished with an agitating means.

In another aspect of the above system, the hydrocarbon solvent can be discharged from the storage container for urgent use.

Furthermore, the invention provides a gas liquefying and storage device for gas whose principal ingredient is methane comprising a composition information determining means for determining the ratios of the constituents of material stored in the storage container in which a gas whose principal ingredient is methane is dissolved in a hydrocarbon solvent and stored; and a sending means for sending the result of the above detection to the supply side from which the gas and the hydrocarbon solvent are supplied to the storage container.

Furthermore, the invention provides a gas liquefying and storage device for gas whose principal ingredient is methane, said device comprising a withdrawal container for withdrawing the remaining hydrocarbon from a storage container in which a gas whose principal ingredient is methane is dissolved in a hydrocarbon solvent and stored; a detection means for determining the rates of the constituents of the hydrocarbon in the withdrawal container; and a supply ratio control means for controlling a ratio at which such gas and the hydrocarbon solvent are supplied to the storage container based on the result of the above determination.

Furthermore, the invention provides a gas liquefying and storage device for gas whose principal ingredient is methane, wherein, at a stage preceding a storage container in which a gas whose principal ingredient is methane is dissolved in a hydrocarbon solvent and stored, a temporary charging container for exclusive solvent use is installed via a means for controlling the passage between the storage container and the temporary charging container for exclusive solvent use.

Furthermore, the invention provides a gas liquefying and storage device for gas whose principal ingredient is methane, wherein the supply source of such gas and the supply source of a hydrocarbon solvent are connected, via respective control means, to a temporary storage tank that is in turn connected to a storage container in which a gas whose principal ingredient is methane is dissolved in the hydrocarbon solvent and stored.

Furthermore, the invention provides a gas liquefying and storage device for gas whose principal ingredient is methane comprising a main storage container in which a gas whose principal ingredient is methane is dissolved in a hydrocarbon solvent and stored; and a hydrocarbon solvent-dedicated storage container for storing only the hydrocarbon solvent, wherein said hydrocarbon solvent-dedicated storage container is connected to the main storage container via a control means.

Furthermore, the invention provides a gas liquefying and storage device for a gas whose principal ingredient is methane comprising a vapor-phase outlet for discharging gaseous stored material, provided at the top of a storage container in which such gas is dissolved in a hydrocarbon solvent and stored; a vapor-liquid separator for separating liquid from the discharged gaseous stored material; and a feedback passage for returning the liquid separated through the vapor-liquid separator to the storage container.

BRIEF DESCRIPTION OF THE DRAWINGS

FIG. 40 is a view comparing the efficiency of three manners of electric power supply.

BEST MODE FOR CARRYING OUT THE INVENTION

Preferred embodiments of the present invention (hereinafter, referred to as embodiments) will be described below with reference to the drawings.

Embodiment 1

Embodiments 1 through 9 of the gas liquefying and storing system for methane-base gas according to the present invention concerns the art of dissolving methane or a gas whose principal ingredient is methane, such as natural gas, in a hydrocarbon solvent and storing methane-base gas at high density in a storage container.

Figure 1:
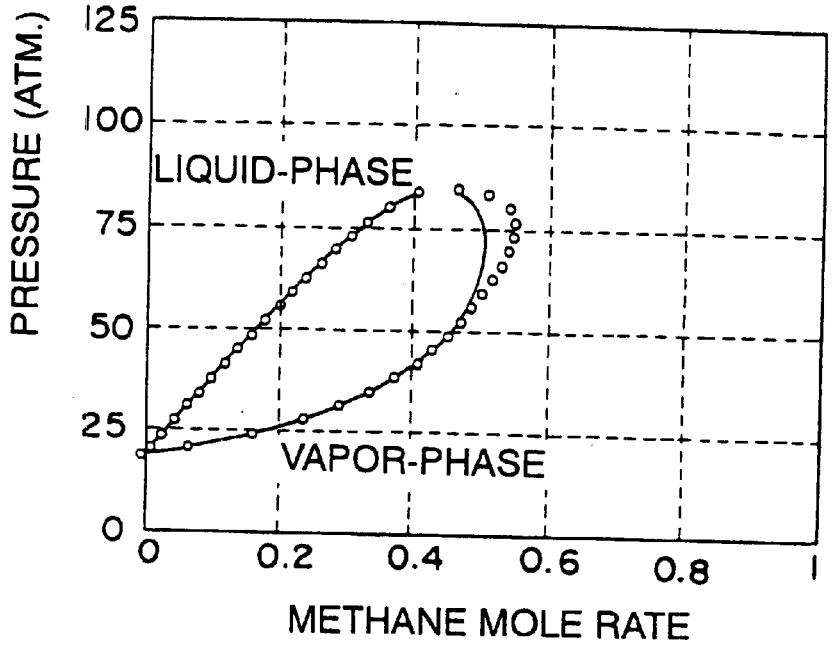
FIG. 1 is a view showing the vapor-liquid equilibrium characteristics of a propane and methane composite at 38°.

FIG. 1 shows the vapor-liquid equilibrium characteristics of a mixed propane and methane solution at 38° C. In FIG. 1, the upper line is a liquid-phase line and the lower line is a vapor-phase line. As seen from FIG. 1, the mixed propane and methane solution remains in a liquid state until the mole ratio of methane becomes about 40%, the mole ratio at which methane enters a vapor state. When the mole percent of methane exceeds the 40% limit, above which it no longer stays in the liquid state, the density of the stored methane decreases. To store high-density methane over a wide range of temperatures, therefore, the broadest possible range in which methane can remain in a liquid state is desirable.

Figure 2:
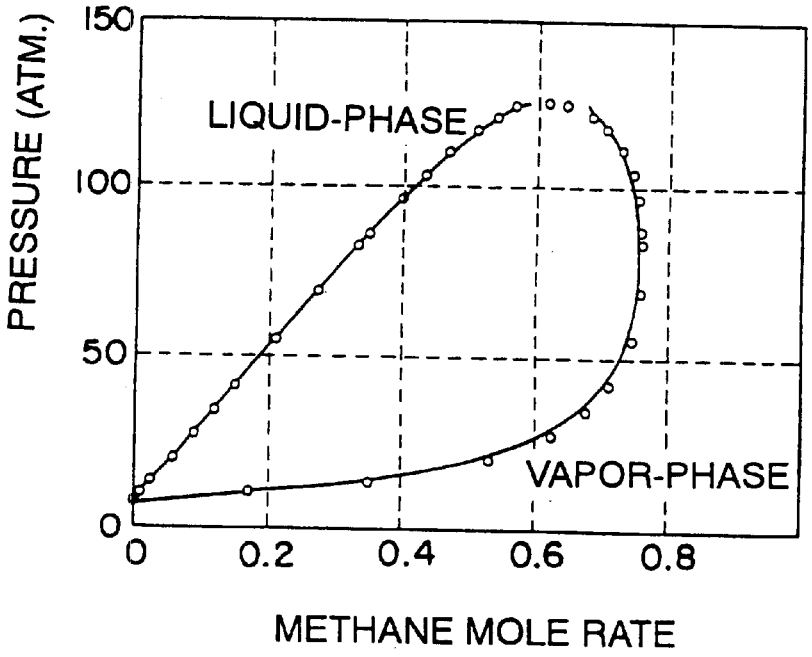
FIG. 2 is a view showing the vapor-liquid equilibrium characteristics of a butane and methane composite at 71° C.

FIG. 2 shows the vapor-liquid equilibrium characteristics of a mixed butane and methane solution at 71° C.. In this case, it can be seen that the liquid state of methane is maintained until the mole percent of methane in the composite solution becomes about 60%.

Figure 3:
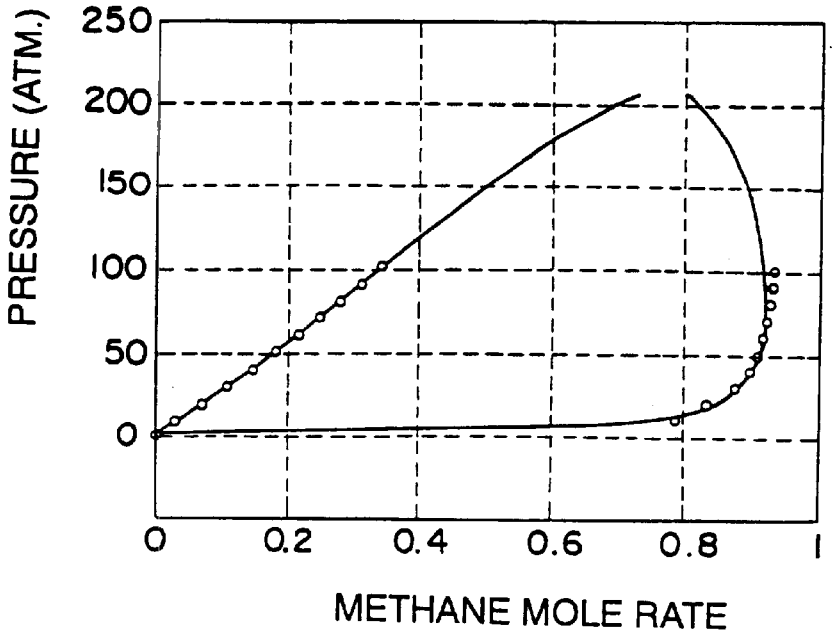
FIG. 3 is a view showing the vapor-liquid equilibrium characteristics of a hexane and methane composite at 100° C.

Furthermore, FIG. 3 shows the vapor-liquid equilibrium characteristics of a mixed hexane and methane solution at 100° C. In this case, it can be seen that methane can stay in the liquid state until the mole percent of methane in the composite liquid becomes about 70%.

As can be seen, a hydrocarbon having more carbons (a higher carbon number), or, in other words, a hydrocarbon that is liquid at room temperature, can better maintain the liquid state of dissolved methane. This property of a hydrocarbon such as hexane that is liquid at room temperature is maintained, even if it is mixed with another hydrocarbon that is hard to liquefy at room temperature, for example, the above-mentioned propane or butane.

Figure 4:
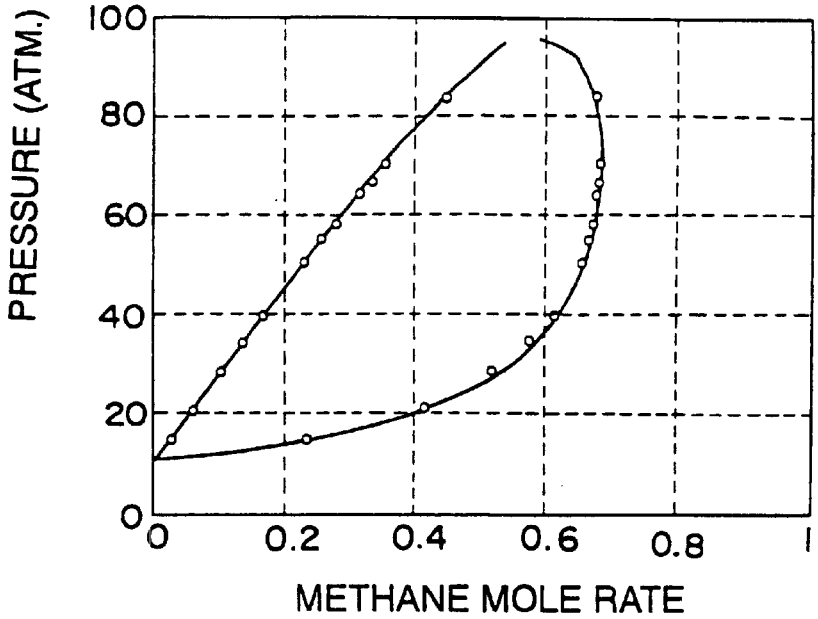
FIG. 4 is a view showing the vapor-liquid equilibrium characteristics at 38° C. of a propane and 10%-hexane solution in which methane is dissolved.

FIG. 4 shows the vapor-liquid equilibrium characteristics at 38° C. of a hydrocarbon solvent consisting of propane and 10% hexane in which methane is dissolved. As shown in FIG. 4, the liquid state of methane is maintained before the mole percent of methane becomes about 55%. As compared with FIG. 1, where the hydrocarbon solvent consisting of 100% propane is used, FIG. 4 shows a wider range in which the dissolved methane can remain in a liquid state, and the hydrocarbon solvent including the hexane ingredient (FIG. 4) indicates a lower pressure for a corresponding level of methane density. This is observed because hexane, the hydrocarbon which is liquid at room temperature, stabilizes methane and propane.

Figure 5:
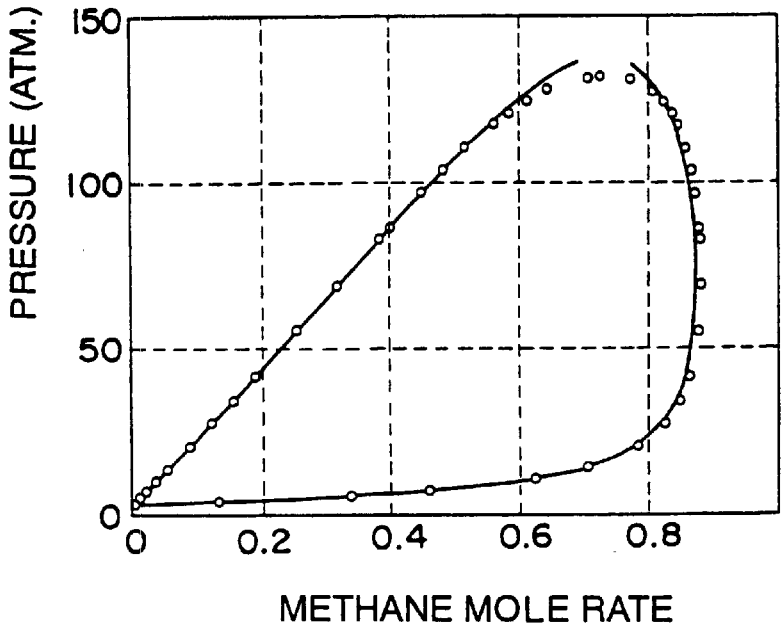
FIG. 5 is a view showing the vapor-liquid equilibrium characteristics at 71° C. of a butane and 10%-hexane solution in which methane is dissolved.

Similarly, FIG. 5 shows the vapor-liquid equilibrium characteristics at 71° C. of a hydrocarbon solvent consisting of butane and 10% hexane in which methane is dissolved. In this case, it is seen that the liquid state of methane is maintained before the mole percent of methane becomes about 70%. As compared with FIG. 2, where the hydrocarbon solvent consisting of 100% butane is used, FIG. 5 shows a wider range of molar ratios of methane in which the methane can exist in a liquid state, indicating a lower pressure for a corresponding level of methane density. It is thus evident that the hydrocarbon solvent including 10% hexane is more stable as liquid than the 100% butane hydrocarbon solvent.

As can be seen from the above, by using a hydrocarbon solvent including a hydrocarbon that is liquid at room temperature, such as hexane, the liquid state of methane can be maintained over a wider temperature range and a wider range of mole ratios of methane. Therefore, higher-density methane can be stored, which can increase the quantity of methane which can be stored. Consequently, stable methane can be stored in a large quantity, even if it is used over a wide temperature range, for example, for the application on a motor vehicle.

In the above description, the hydrocarbon solvents consisting of two ingredients were explained as examples, whereas hydrocarbon solvents consisting of three or more ingredients may be used suitably. Examples of hydrocarbons that do not readily liquefy at room temperature include not only the above-mentioned propane and butane. For example, dimethyl ether can also be used.

Embodiment 2

The gas liquefying and storing system for methane-base gas according to the present invention can be applied in a motor vehicle, in which case, it would be advantageous if the gasoline or light oil that is normally used as fuel in the vehicle could be used as the hydrocarbon solvent for liquefying methane. This would, for example, allow use of the existing support infrastructure for motor vehicles. Another good point is that, for bi-fuel motor vehicles with an engine, of course, gasoline or light oil can be used as fuel. Gasoline is a composite liquid of hydrocarbons of C5 to C8. Light oil is also a composite liquid of hydrocarbons of C7 to C12. The present inventors have verified that gasoline or light oil remains a liquid and can sufficiently liquefy methane over a range of temperatures in the environments to which it is applied.

Figure 6:
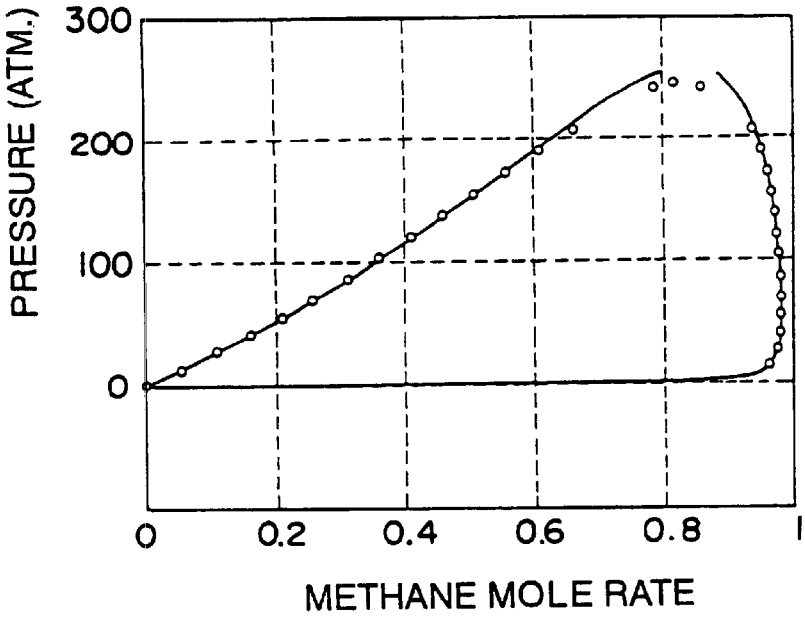
FIG. 6 is a view showing the vapor-liquid equilibrium characteristics at 71° C. of gasoline in which methane is dissolved.

FIG. 6 shows the vapor-liquid equilibrium characteristics at 71° C. of gasoline in which methane is dissolved. As can be seen from FIG. 6, the liquid state of methane is maintained until the mole percent of methane becomes about 80%. As the hydrocarbon solvent for liquefying and storing methane, therefore, gasoline or light oil can be considered highly preferable.

Embodiment 3

Figure 7:
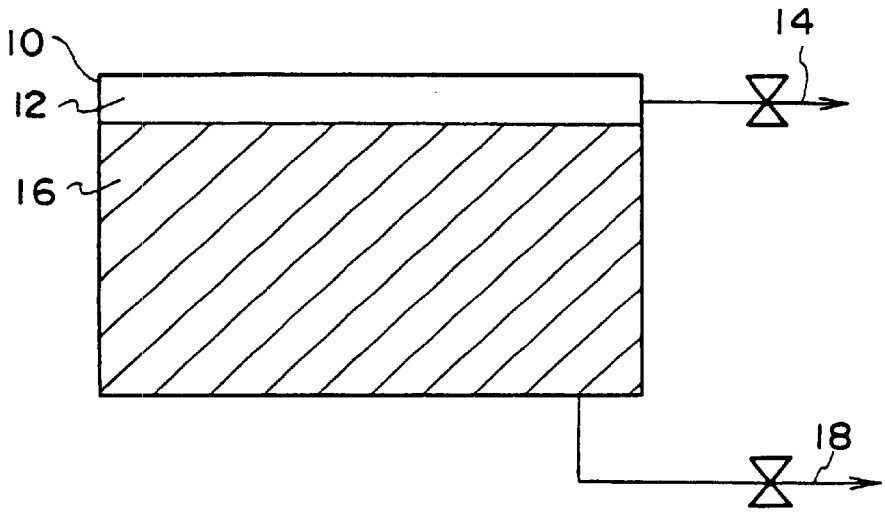
FIG. 7 is a cross section of the equipment for implementing a preferred Embodiment 3 of the gas liquefying and storing system for gas whose principal ingredient is methane according to the present invention.

FIG. 7 shows a cross section of the equipment for implementing a preferred Embodiment 3 of the gas liquefying and storing system for methane-base gas according to the present invention. As shown in FIG. 7, a storage container 10 is furnished with a vapor-phase outlet 14 for discharging the methane from a vapor-phase portion 12 of the container and a liquid-phase outlet 18 for discharging the hydrocarbon solvent from a liquid-phase portion 16 of the container. The liquid-phase outlet 18 is located at the bottom of the storage container 10.

The equipment is designed to receive gasoline or light oil as the hydrocarbon solvent in the liquid-phase portion 16 shown in FIG. 7 and store the methane dissolved in the solvent. Thus, the equipment can store gasoline or light oil and methane at the same time and maintain high energy density in the storage container 10. In addition, because only a single storage container 10 is required for storing fuel, this embodiment is beneficial for application in motor vehicles.

Because methane is stored by dissolving it in gasoline or light oil in this embodiment, the liquid-phase methane can be stored under a lower pressure than for, for example, the pressure at which compressed natural gas (CNG) can be stored. When pressure required to compress natural gas (CNG) is assumed to be 200 Mpa, the pressure defined in Japanese regulations, and the same pressure is applied, a greater amount energy of higher density can be stored by the method according to this embodiment.

When the methane stored in the storage container 10 according to this embodiment, is used, gas bearing about 90% methane with a ratio of constituents being generally constant, existing in the vapor-phase portion 12 of the storage container 10, is discharged through the vapor-phase outlet 14. Because methane has been dissolved in the hydrocarbon solvent contained in the liquid-phase portion 16, when the gas is discharged from the vapor-phase portion 12, some of the dissolved methane vaporizes in the vapor-phase portion 12. When the dissolved methane in the liquid-phase portion 16 has been used up, the container is recharged with methane by forcing methane to blow into the vapor-phase portion 12.

A noticeable feature of this embodiment is that the hydrocarbon solvent in the liquid-phase portion 16 can be discharged through the liquid-phase outlet 18. This enables the immediate use of gasoline or light oil as fuel, providing flexible selection among fuel types in use.

Embodiment 4

Figure 8:
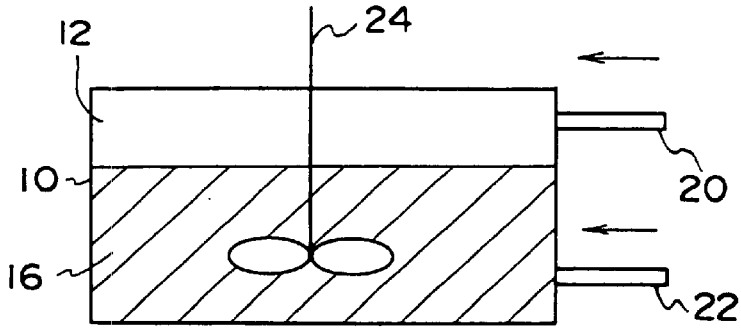
FIG. 8 is a cross section of the equipment for implementing a preferred embodiment 4 of the gas liquefying and storing system for gas whose principal ingredient is methane according to the present invention.

FIG. 8 shows a cross section of the equipment for implementing a preferred embodiment 4 of the gas liquefying and storing system for methane-base gas according to the present invention. As shown in FIG. 8, the storage container 10 is furnished with a methane inlet 20 through which methane gas is forced into the vapor-phase portion 12 and a solvent inlet 22 through which the hydrocarbon solvent flows into the liquid-phase portion 16. In addition, an agitator 24 for agitating the solvent in the liquid-phase portion 16 is installed.

After the hydrocarbon solvent is supplied through the solvent inlet 22, entering the storage container 10 and forming the liquid-phase portion 16, and methane is supplied through the methane inlet 20 to the vapor-phase portion 12, the methane begins to be dissolved in the hydrocarbon solvent in the liquid-phase portion 16. However, the methane can not be sufficiently dissolved in the liquid-phase portion 16 merely by increasing the pressure of the methane supply. To enhance methane solubility, bubbles may be injected in the solvent by forcing methane directly into the liquid-phase portion 16. However, experimental results reveal that this method still does not provide sufficient methane solubility. Consequently, in this embodiment, an agitator 24 is installed in the storage container 10. When methane is supplied through the methane inlet 20, the agitator 24 can agitate the hydrocarbon solvent in the liquid-phase portion 16. Experimental results show significant improvement of the methane solubility.

Table 1 lists the methane solubility results for three cases wherein compressed methane is forced into the container while the solvent is agitated according to the method of the present embodiment; compressed methane is forced into the container, but the solvent is not agitated (supplied from above the liquid level); and compressed methane is forced directly into the liquid-phase portion 16 through bubbling.

TABLE 1

| Methane supply method | Methane Solubility (%) |
|---|---|
| Methane forced from above the liquid level (without bubbling) | 2 |
| Methane forced from below the liquid level (with bubbling) | 15 |
| Methane forced while the solvent is agitated | 80 |

As can be readily seen from Table 1, when methane is forced into the container while the solvent in the liquid-phase portion 16 is agitated by the agitator 24, as according to the method of the present embodiment, the methane solubility in the hydrocarbon solvent is significantly enhanced.

For example, even for Embodiment 3 in which methane is dissolved in gasoline or light oil, the quantity of methane to be stored can be increased by installing the agitator 24 in the storage container 10 as in this embodiment and agitating the solvent in the liquid-phase portion 16 while liquefying the methane.

Embodiment 5

Figure 9:
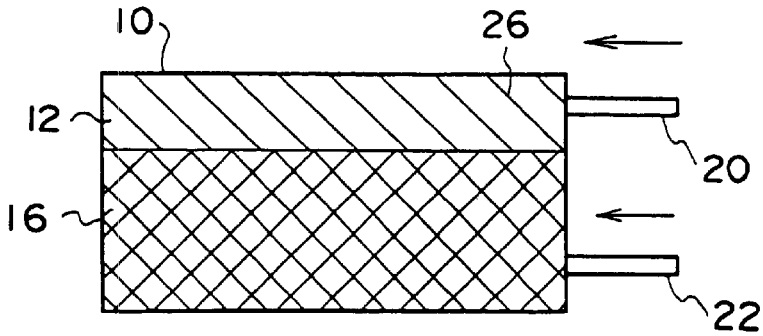
FIG. 9 is a cross section of the equipment for implementing a preferred embodiment 5 of the gas liquefying and storing system for gas whose principal ingredient is methane according to the present invention.

FIG. 9 shows a cross section of the equipment for implementing a preferred Embodiment 5 of the gas liquefying and storing system for gas whose principal ingredient is methane according to the present invention.

As shown in FIG. 9, the storage container 10 holds organic porous material 26. This organic porous material 26 may, for example, be a sponge made of organic material. According to this embodiment, through the solvent inlet 22, the hydrocarbon solvent enters the storage container 10 in which the organic porous material 26 is installed, while methane is supplied through the methane inlet 20. The organic porous material 26 occupies the vapor-phase portion 12 and the liquid-phase portion 16 of the storage container 10, thereby enabling more methane to be liquefied and stored with less hydrocarbon solvent. This is possible because methane liquefaction by dissolution in the hydrocarbon solvent is attributed to the property that methane molecules are attracted to hydrocarbon molecules. Therefore, when the storage container 10 holds an organic porous material 26, a portion of the methane molecules are also attracted to the molecules of the organic porous material 26. This facilitates methane liquefaction, and the quantity of the hydrocarbon solvent can therefore be decreased.

Although in the entire volume of the storage container 10 is filled with the organic porous material 26 in the example shown in FIG. 9, it is suitable that the organic porous material 16 be fitted only in the space of the liquid-phase portion 16 that receives the hydrocarbon solvent.

If, for example, when butane is used as the hydrocarbon solvent and methane is dissolved in the solvent at 140 atm and 5° C., the mole percent of butane in the composite solution will be about 20%. However, if the above-mentioned organic porous material 26 is fitted in the storage container 10, the mole percent of butane can be decreased to about 14% under the same conditions.

Embodiment 6

The embodiments described above uses a methane liquefying and storing method on which methane is dissolved in a hydrocarbon solvent such as propane, butane, pentane, hexane, gasoline, or dimethyl ether (DME). When methane is dissolved in any hydrocarbon solvent, the density of methane to be stored can be further increased if the solution of the methane-dissolved hydrocarbon solvent is put into a critical state.

Figure 10:
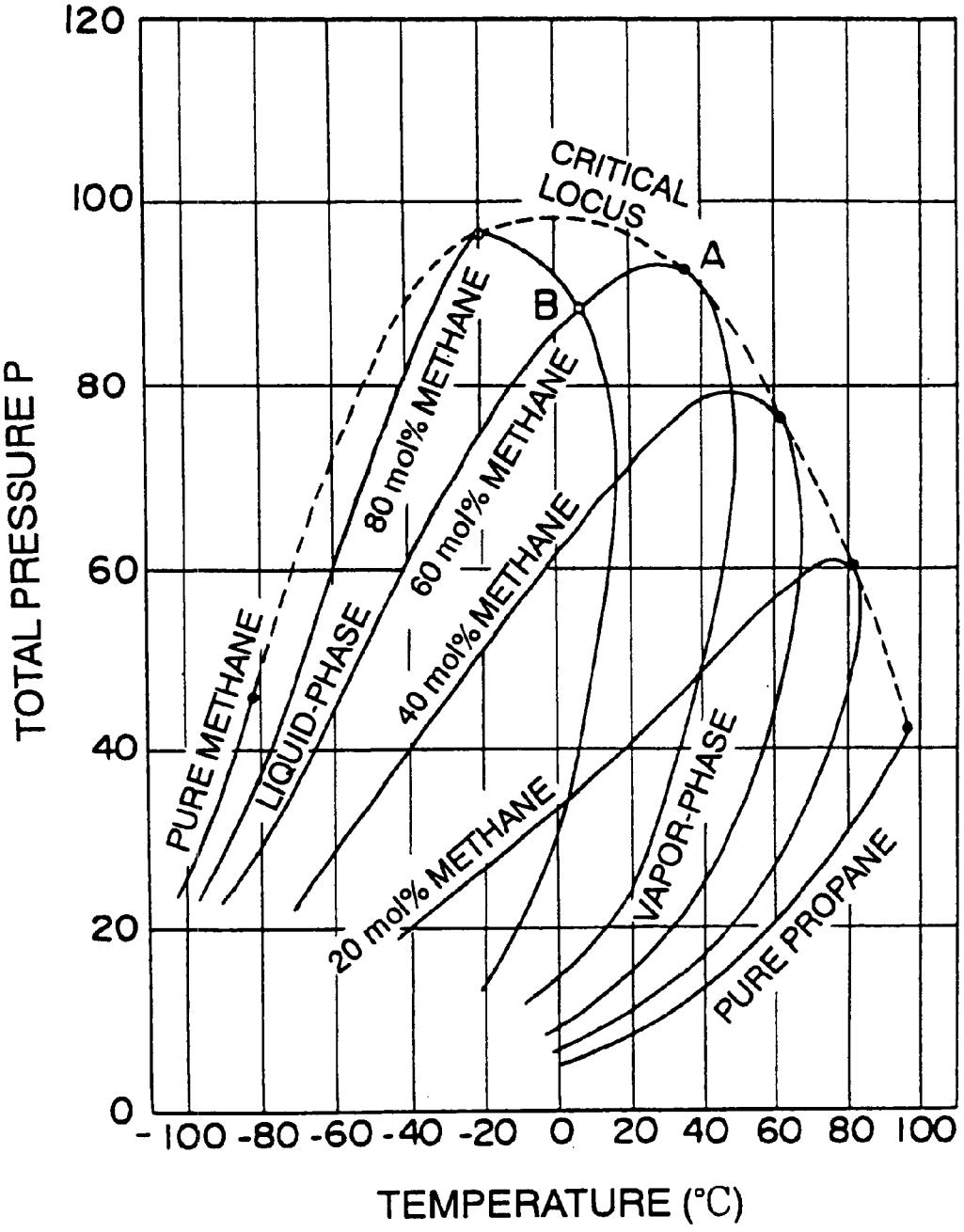
FIG. 10 is a view showing the temperature-pressure curves of mixed methane and propane solutions mixed at different ratios.
Figure 11:
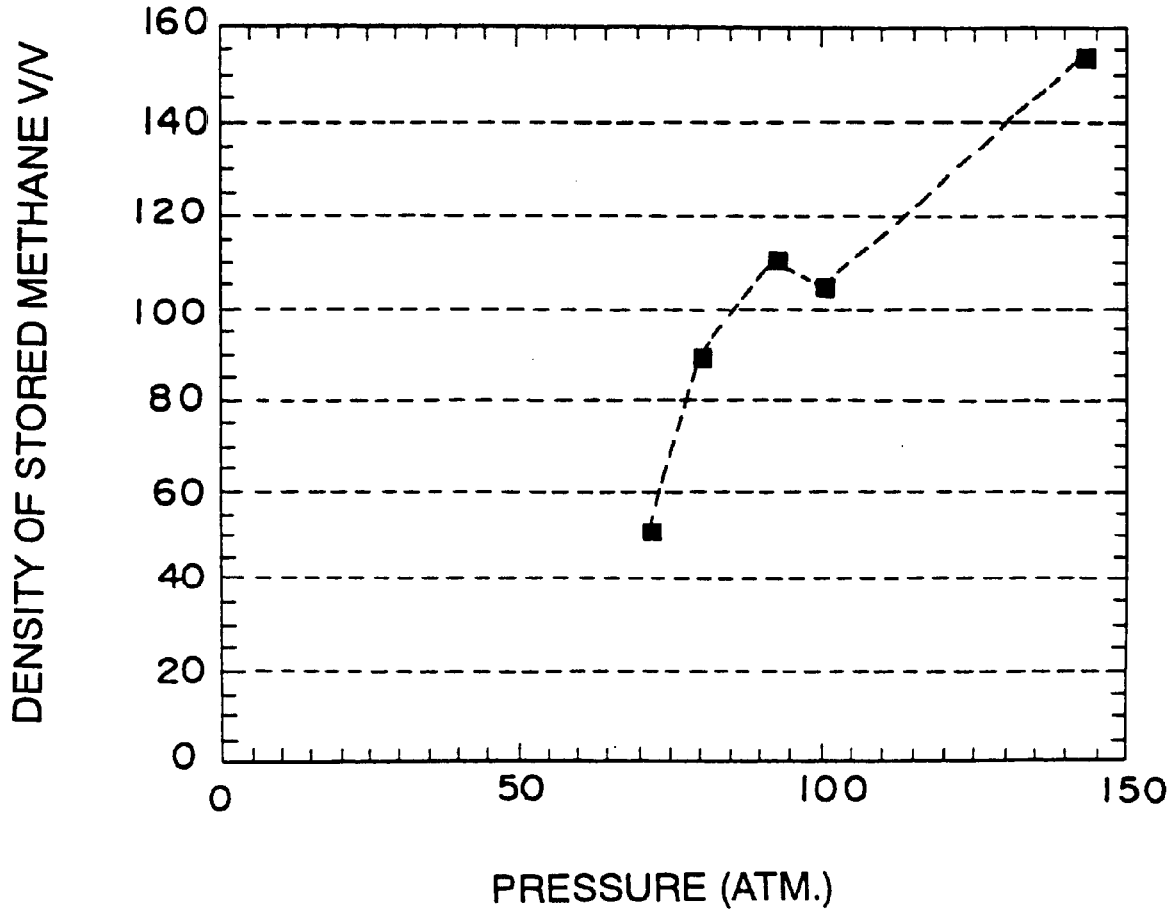
FIG. 11 is a view showing the density of the stored methane in the mixed methane and propane solutions at 30° C.

FIG. 10 shows the temperature-pressure curves of mixed methane and propane solutions mixed at different ratios. As can be seen from FIG. 10, when, for example, compressed methane is forced into the container and dissolved in a propane solution at 30° C., while the pressure of methane supply rises, the critical locus is exceeded at about 93 atm and the solution is put into a critical state. FIG. 11 shows the density of the stored methane at different pressures during this process. The density of the stored methane is represented as the quantity of the dissolved methane in the mixed methane and propane solution. As can be seen from FIG. 11, the density of the stored methane generally rises as the pressure increases, though it somewhat falls once near the critical pressure. From FIGS. 10 and 11, it is thus seen that more methane can be stored by forcing methane into the container at up-to-ultimate supply pressures and attaining the methane dissolution in the critical state.

Next, the following describes how the temperature factor effects the process of methane dissolution in different hydrocarbon solvents when the methane is forced into a container.

Figure 12:
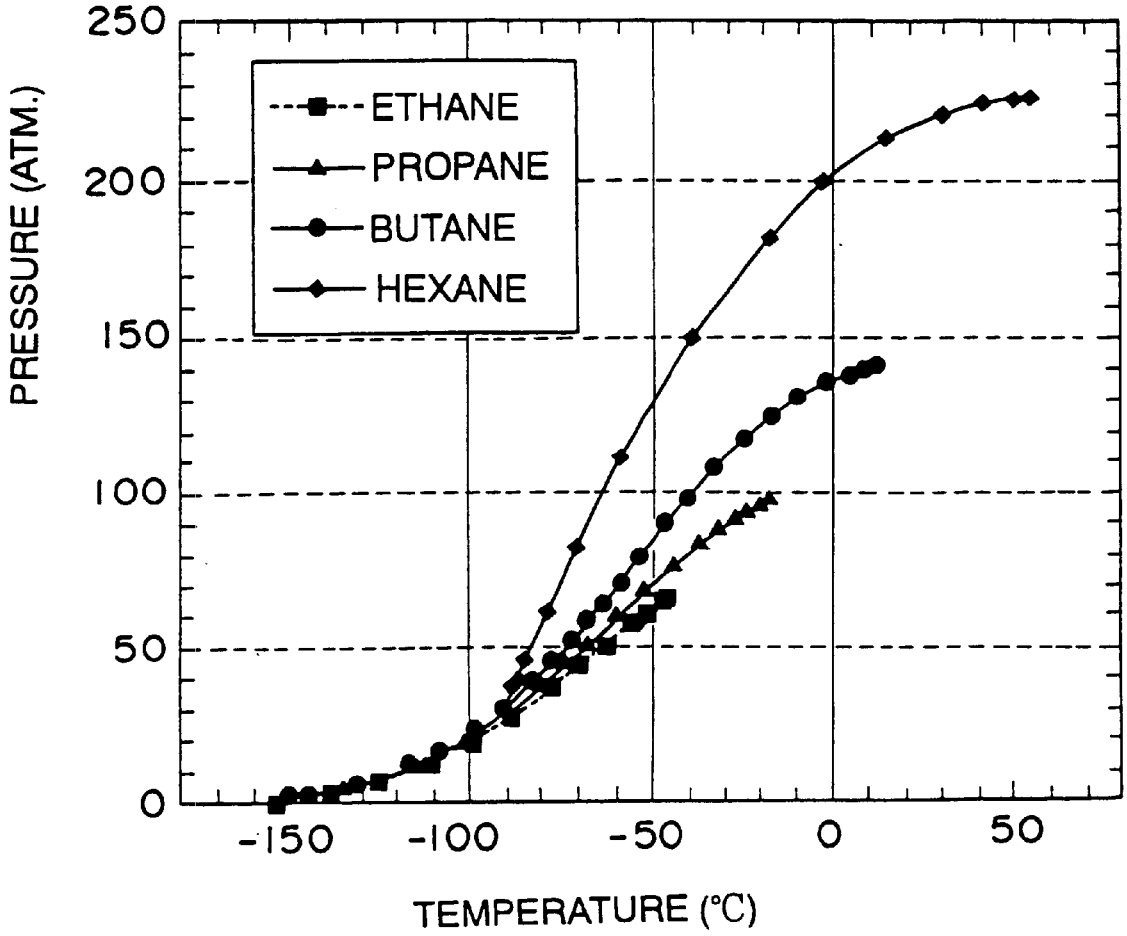
FIG. 12 is a view showing the liquid-phase curves of different types of hydrocarbon solutions for which the methane density is 80%.
Figure 13:
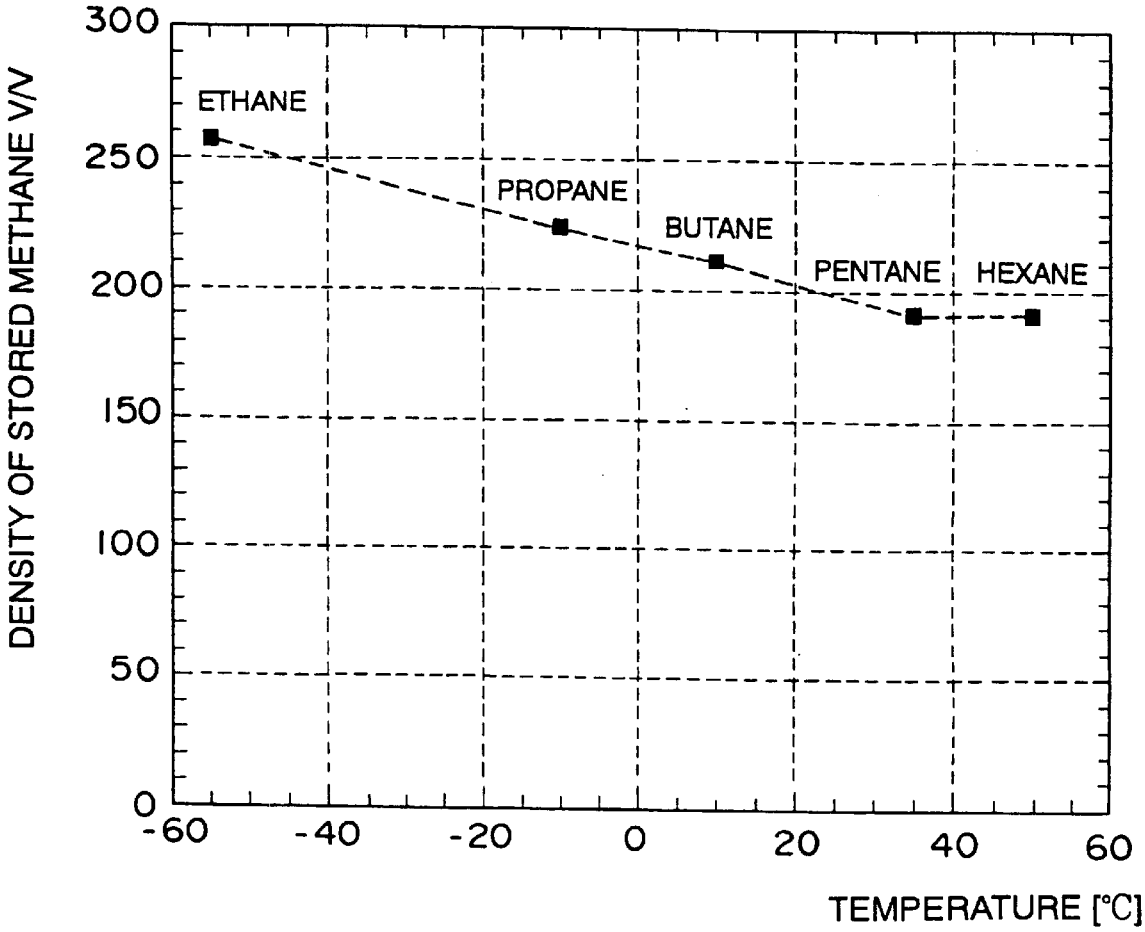
FIG. 13 is a view showing the density of the stored methane at the critical points of the hydrocarbon solution types shown in FIG. 12.

FIG. 12 shows the liquid-phase curves of different types of hydrocarbon solutions in which 80-mol % methane is dissolved. The high-temperature end of each curve indicates the critical point of the corresponding hydrocarbon solution. As seen from FIG. 12, the critical points shift to higher temperature and pressure as the carbon number of each hydrocarbon increases. FIG. 13 shows the density of the stored methane at these critical points. Although it appears that the density of the stored methane decreases as the carbon number increases in FIG. 13, this is because of different temperatures at different critical points.

Figure 14:
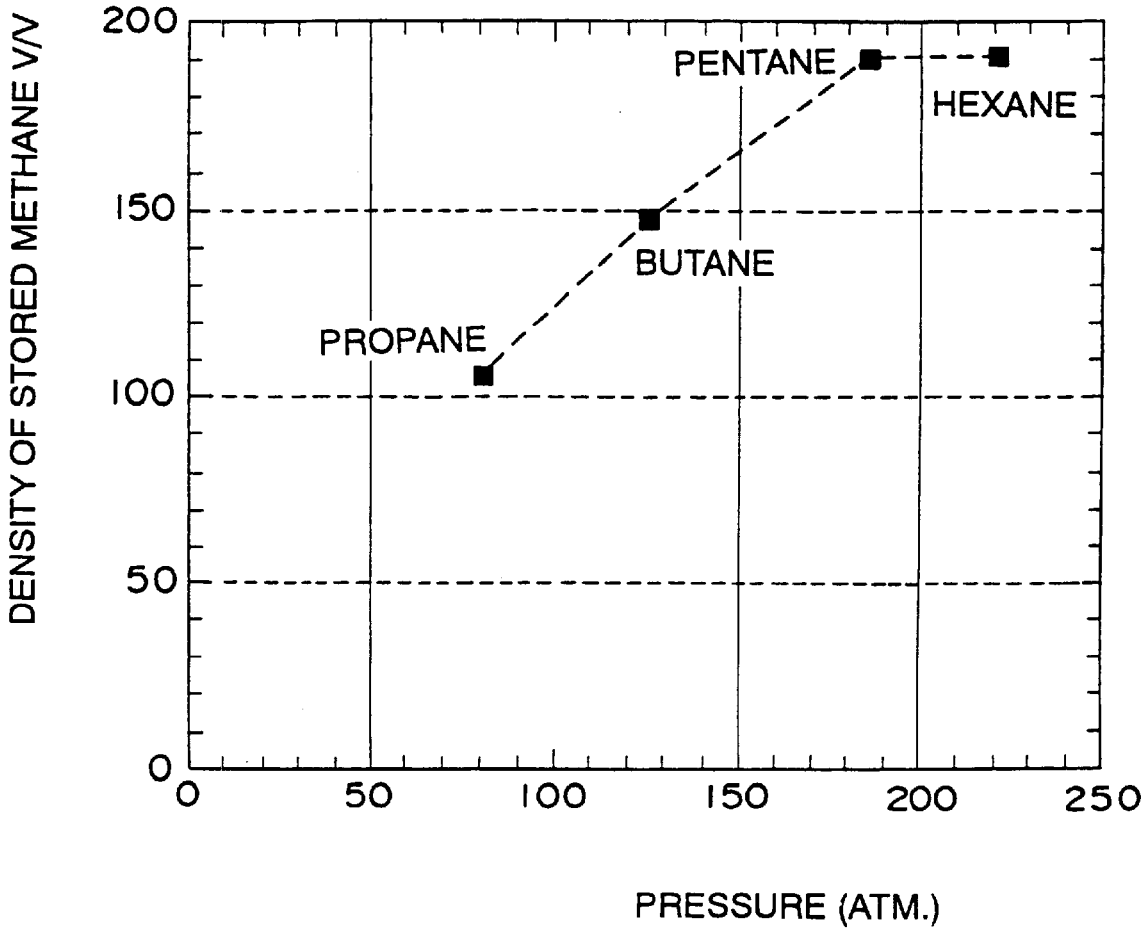
FIG. 14 is a view showing the density of the stored methane in the hydrocarbon solution types shown in FIG. 12 at 35° C.

After the methane solubility is adjusted, the density of methane in these hydrocarbon solutions at a fixed temperature of 35° C. is shown in FIG. 14, where ethane is omitted because it is no longer liquid at this temperature, even if the dissolved methane quantity is reduced. As seen from FIG. 14, the density of the stored methane with pentane and hexane is higher than with other hydrocarbons. This is because the critical temperature of pentane and hexane is higher than that of propane and butane and the density of the stored methane in the critical state can generally be maintained at 35° C. At a constant temperature, particularly in a range of temperatures applicable to practical operation above 0° C., higher-density methane can be stored by the use of a hydrocarbon with a higher critical temperature, such as pentane and hexane. The use of a hydrocarbon with temperature characteristics that the difference between the operating temperature and the critical temperature is small or the critical temperature is higher than the operating temperature is beneficial for increasing the density of the stored methane.

Although the above description featured solutions comprising two ingredients, a solution comprising three or more ingredients may be employed.

Figure 15:
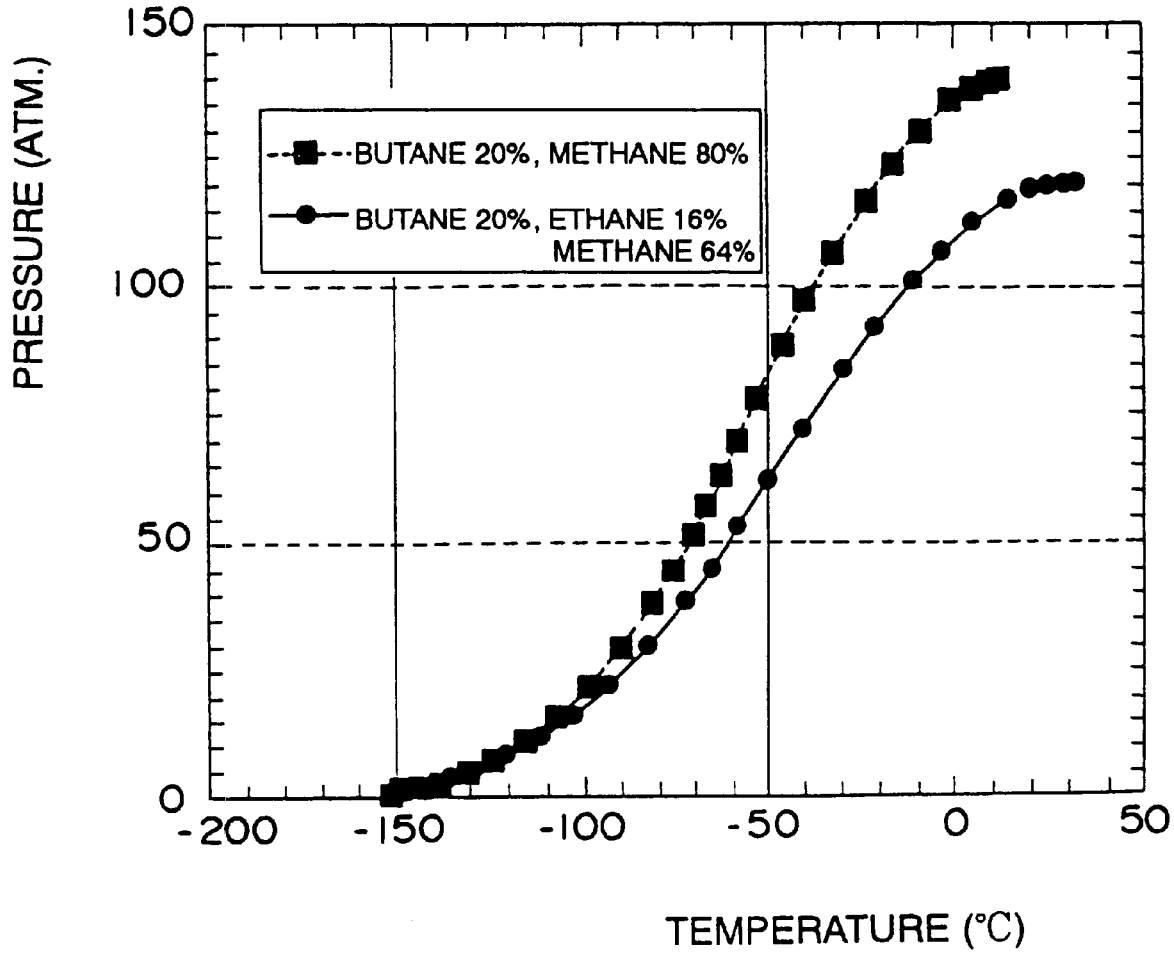
FIG. 15 is a view showing the temperature-pressure curves for two-ingredient and three-ingredient solutions in which methane is dissolved.

FIG. 15 shows two temperature-pressure curves, one for a composite liquid comprising 20% butane and 80% methane and the other for a composite liquid comprising 20% butane, 16% ethane, and 64% methane. As can be seen from FIG. 14, the solution comprising three ingredients, including an additive of 16% ethane, shows a higher critical temperature. Because changing the hydrocarbon types mixed with methane can thus alter the characteristics of the composite solution; the methane dissolution can be adjusted flexibly according to the application.

Embodiment 7

If methane and a hydrocarbon with a carbon number of 3 or higher, such as propane, butane, pentane, and hexane (C3 to C6) are mixed, the methane is dissolved in the hydrocarbon and liquefied by the cohesive power of the hydrocarbon. FIGS. 16 through 19 respectively show the characteristics of the mixtures of methane and each of the above hydrocarbons in which methane is dissolved at different rates in terms of temperature-pressure correlation. As indicated in these Figures, at each methane rate in each mixture, a critical state exists in which no further liquefaction occurs even if pressure rises.

The present inventors have found that storing methane in such super-critical state can increase the density of the stored methane beyond that when simple methane is stored as compressed gas (CNG). In methane-hydrocarbon mixtures, hydrocarbon atoms lessen mutual repulsion of methane atoms and work as buffers.

Figure 20:
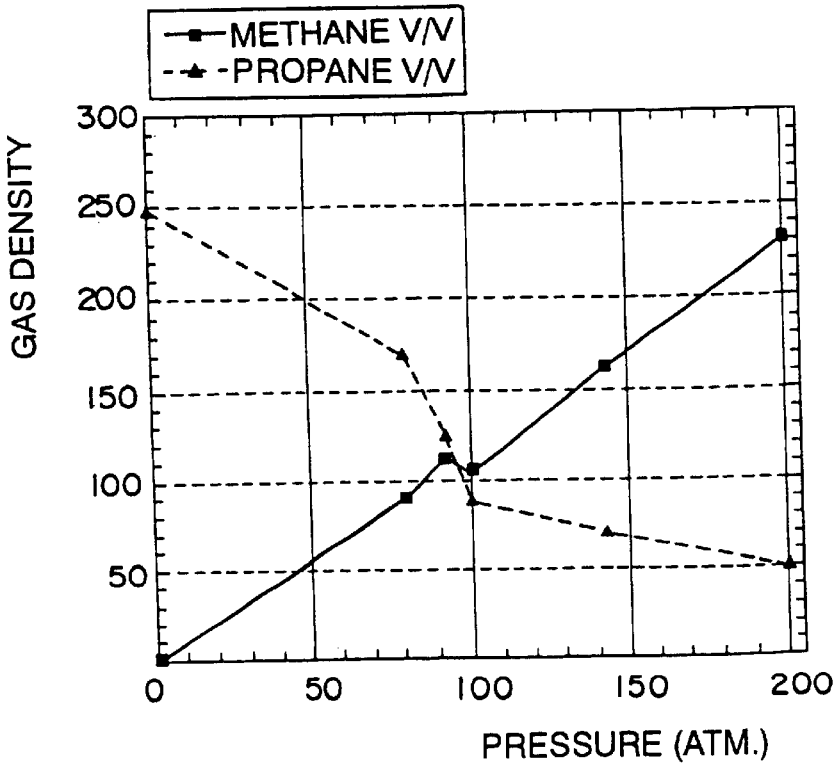
FIG. 20 is a view showing methane density and propane density, changing as methane is gradually added to the propane solvent.
Figure 21:
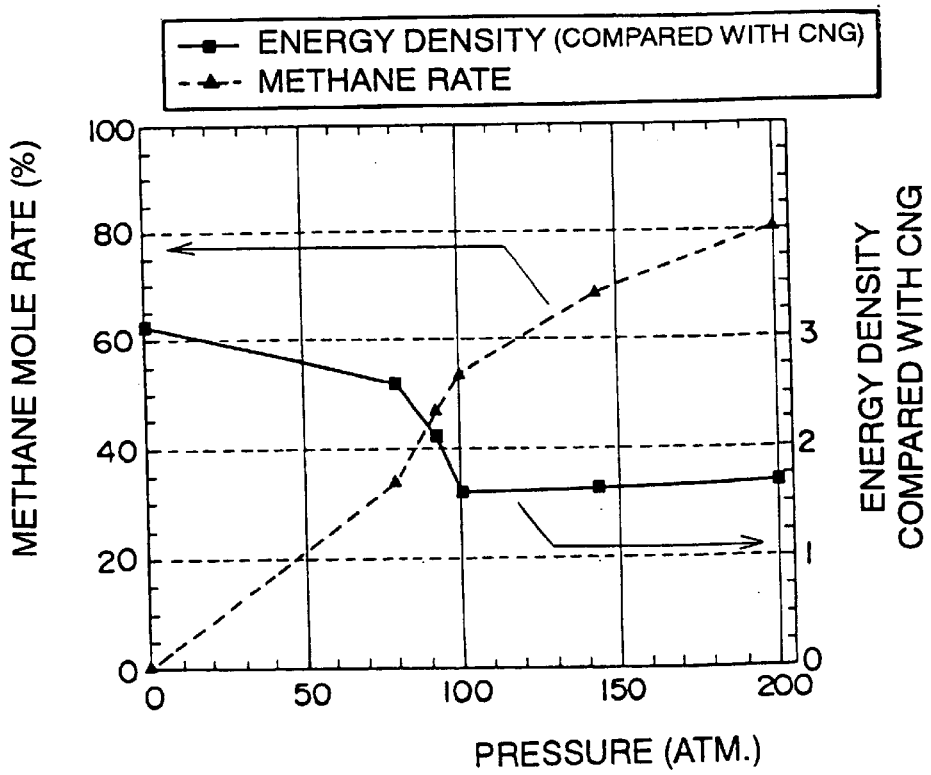
FIG. 21 is a view showing the transition of the methane mole ratio and energy density for the case shown in FIG. 20.

FIG. 20 shows the measurements of the methane density and the propane density that change as methane is gradually added to the propane solvent at 35° C. FIG. 21 shows the correlation between the energy density of the methane-propane mixture and the molar ratio of methane (%) during this process. In FIGS. 20 and 21, pressure rises as methane is gradually added to the propane solvent and the liquid phase of the methane-propane mixture was existing before the pressure reached 80 atm. When methane is further added and the pressure exceeds 80 atm, the liquid phase of the mixture terminates and the mixture is changing to the super-critical state. The mole percent of methane in the liquid phase at 80 atm was 35%. In a domain of pressure rise from 80 to 100 atm for methane addition, the methane-propane mixture was unstable, and was placed in the transitional state from the liquid phase to the super-critical state.

As shown in FIG. 20, across the above stages, the density of the stored methane increased up to 90 atm and decreased once at 100 atm, the point at which the complete super-critical state was entered. Then, the pressure rose as the methane ratio in the mixture increased, and the density of the stored methane also increased. At 200 atm reached during further methane addition, the stored methane density attained a volumetric rate of V/V (stored gaseous volume under atmospheric pressure/stored volume)=220, whereas the stored propane density being a volumetric rate of V/V=50. As compared with the stored CNG density being V/V=200 at 200 atm, it can been seen that methane can be stored at higher density when stored in a super-critical state.

As shown in FIG. 21, when the mole percent of methane in the mixture became 35% during the methane addition to the propane solvent, that is, the pressure reached 80 atm, the transition to the super-critical state began. During this transitional state, the mole ratio of methane increased rapidly, and became 55% when the pressure attained 100 atm and the complete super-critical state was entered. Further methane addition increased both the mole percent of methane and the pressure. The methane mole percent of 81.5% and the propane mole percent of 18.5% were measured at the pressure of 200 atm reached during the process of further methane addition. The change of the energy density of the mixture during this process is also shown in FIG. 21, indicating that the energy density falls during the transition to the super-critical state, lower than that in the liquid phase state. After the mixture was put to the super-critical state, its energy density remained approximately constant, while the pressure rose slightly. This energy density was, however, 1.6 times as large as that of methane in the compressed natural gas (CNG) state because the propane constituent was mixed with methane.

The above phenomenon is observed similarly when another hydrocarbon of a carbon number of 3 or higher, other than propane, is employed. This is also true even if a methane-ethane composite whose principal ingredient is methane and a hydrocarbon of a carbon number of 3 or higher are mixed, because the ethane properties approximate those of methane. Therefore, by mixing methane or a hydrocarbon of a carbon number of 2 or lower with methane being the principal ingredient, with a hydrocarbon of a carbon number of 3 or higher, such as propane, butane, etc., so that the amount of the former will be 93% to 35% and the amount of the latter 7% to 65%, and by storing the resultant mixture in super-critical state, a higher density of methane can be stored and higher energy density achieved as explained above. The super-critical state is, however, unstable during the transition to that state during the addition of methane to a hydrocarbon of a carbon number of 3 or higher. It is thus desirable to utilize constituent ratios in which the super-critical state is readily stabilized. Specifically, the mixture should be prepared such that the ratio of a hydrocarbon of a carbon number of 3 or higher will be 7% to 45% and the ratio of methane or a hydrocarbon of a carbon number of 2 or lower, bearing methane as the principal ingredient, will be 93% to 55%. By thus producing a methane-hydrogen composite, mixed according to the ratio ranges specified above, and storing it in super-critical state, both stored methane density and energy density can be increased.

Embodiment 8

Figure 22:
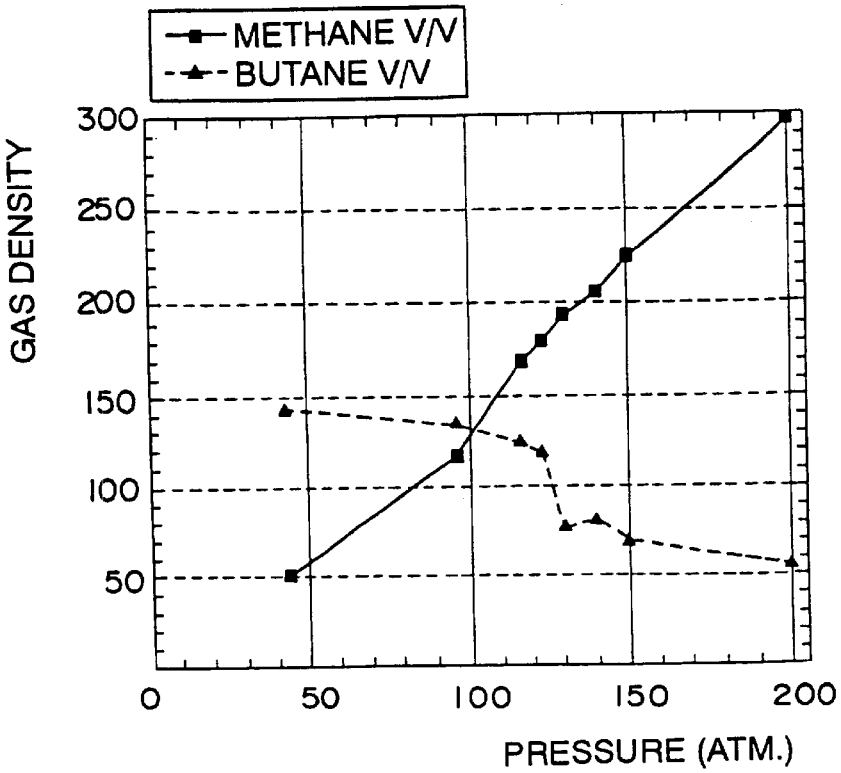
FIG. 22 is a view showing methane density and butane density, changing as methane is gradually added to the butane solvent.
Figure 23:
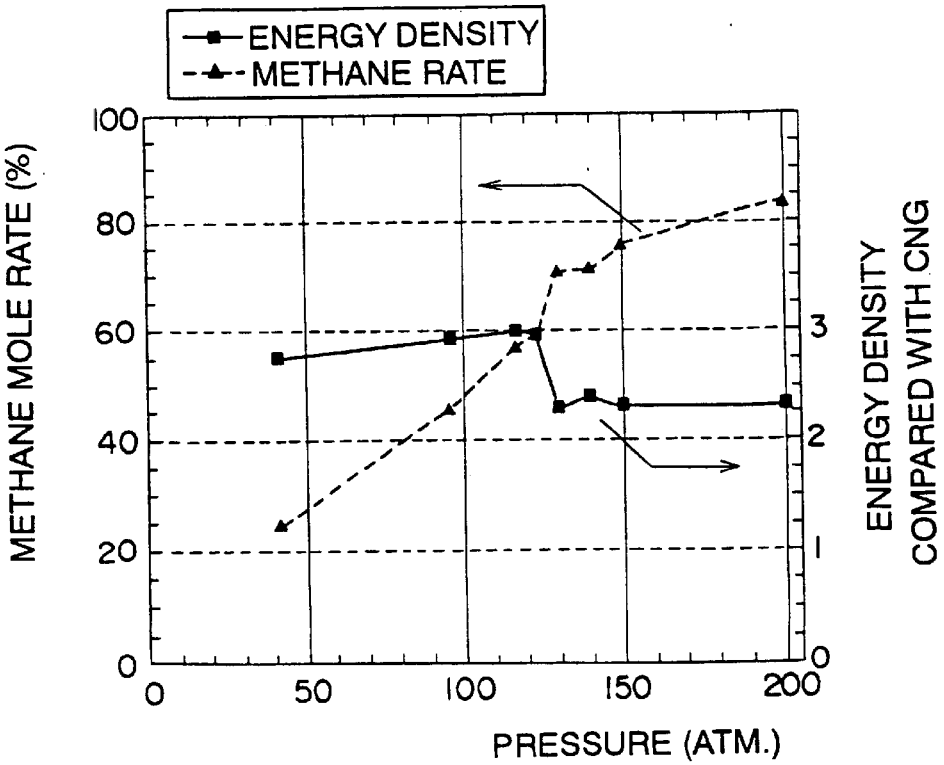
FIG. 23 is a view showing the transition of the methane mole ratio and energy density for the case shown in FIG. 22.

In a preferred Embodiment 8 of the present invention, butane is used as the hydrocarbon with a carbon number of 3 or higher. FIG. 22 shows the changes in butane density and the methane density as methane is gradually added to the butane solvent at 21° C. FIG. 23 shows the transitions of the energy density of the methane-butane mixture and the mole percent of methane during this process. The liquid phase of the mixture exists before the pressure reaches 120 atm as methane is added. When methane is further added, the mixture enters the transitional state from the liquid phase to the super-critical state, which is an unstable domain. This transitional state continues until the pressure has risen to about 130 atm. As shown in FIG. 22, when methane is gradually added to the butane solvent, the stored methane density increases as the pressure rises without being affected much by the phase change from liquid phase to transitional state, eventually to super-critical state. At 200 atm of pressure under which methane is further added to make the methane-butane mixture after the mixture enters the super-critical state, the stored methane density attained V/V=300, whereas the stored butane density was V/V=55.

As shown in FIG. 23, at 120 atm of pressure under which methane is added to make the methane-butane mixture, the liquid phase of the mixture exists with the mole percent of methane being 55%. At 130 atm of pressure under which methane is further added, the mixture enters the super-critical state with the mole percent of methane being 73%. The system internal state becomes stable when being placed in the super-critical state. As for the case where the propane solvent is used, in the butane solvent mixed with methane, the mole percent of methane rises rapidly as soon as the mixture enters the super-critical state, approximating the molar ratio of methane as natural gas.

The energy density of the methane-butane mixture, as shown in FIG. 23, decreases to lower than that in the liquid phase state when the mixture has changed to the super-critical state. After its super-critical state is fixed, however, its energy density remains approximately constant, independent of the pressure rise. When methane has been added under an ultimate pressure of 200 atm, the methane mole percent is 84.5%, and the butane mole percent being 15.5%. At this time, the energy density of the mixture is about 2.1 times that of compressed natural gas.

Even when butane is employed as the solvent, storing the methane-butane composite in super-critical state can increase the stored methane density and energy density.

Embodiment 9

Figure 16:
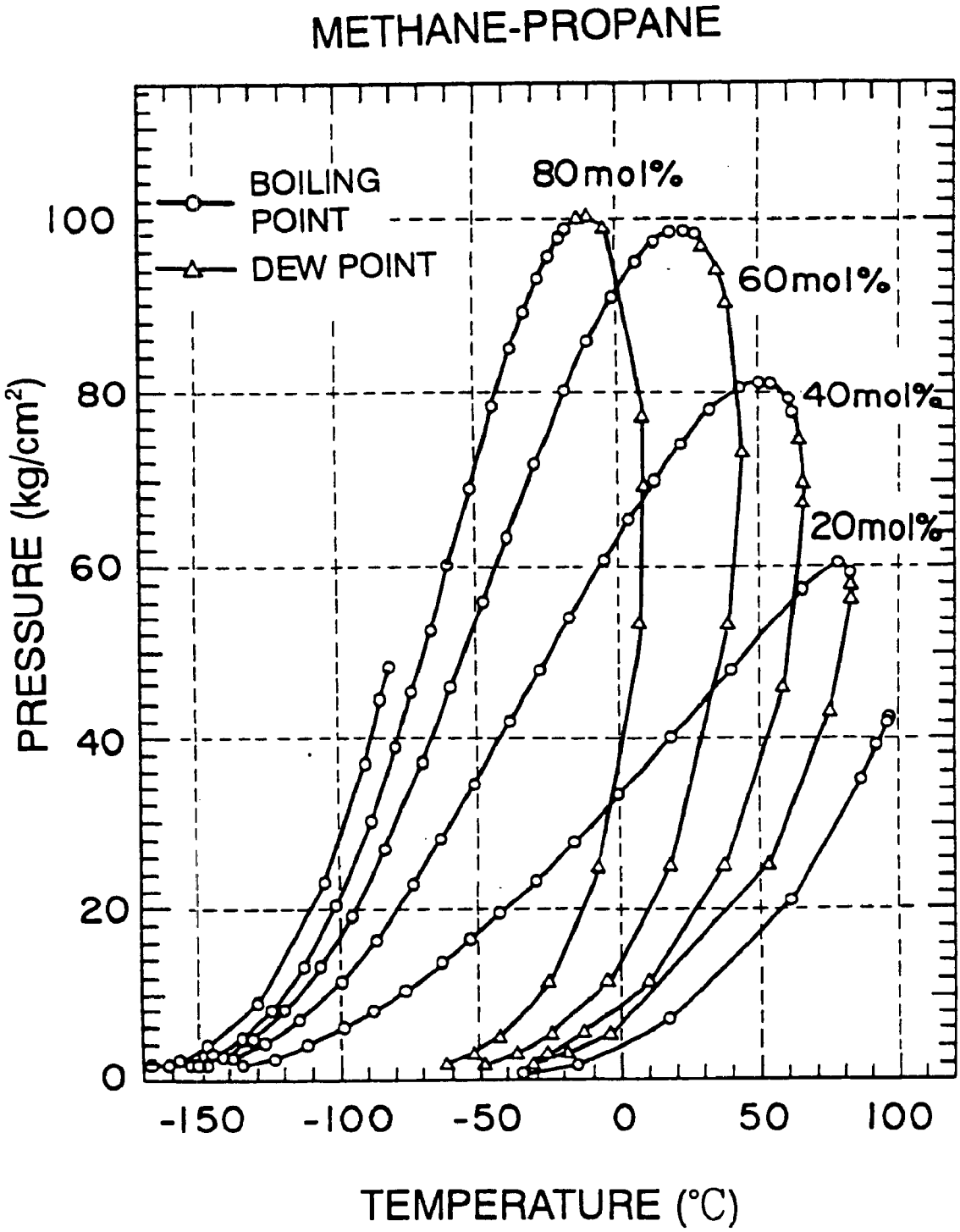
FIG. 16 is a view showing the temperature-pressure correlation of a methane-propane composite.

In a preferred embodiment 9 of the present invention, propane is used as a hydrocarbon of a carbon number of 3 or higher. FIG. 16 shows the temperature-pressure correlation of a methane-propane composite made by dissolving methane in propane. As seen from FIG. 16, for the 80% mole percent of methane, its dew-point curve does not extend to the domain of temperature of 15° C. or higher, whatever pressure is applied. Therefore, the methane-propane composite is not liquefied under whatever pressure and can be discharged from the storage container, with the constant rates of its constituents being maintained in its super-critical or gas state.

Therefore, when propane is used as a hydrocarbon of a carbon number of 3 or higher, the fuel that is not liquefied even at room temperature can be used.

Embodiment 10

Embodiment 10 and subsequent embodiments of the gas liquefying and storing system for methane-base gas according to the present invention concern the art of maintaining constant ratios of the constituents of the stored material when the material is discharged from the storage container for use.

Figure 24:
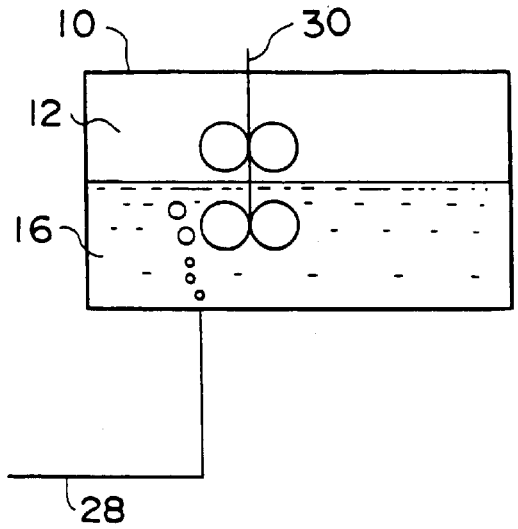
FIG. 24 is a view showing an example of the storage container for mixing methane into a hydrocarbon of a carbon number of 3 or higher.

To mix methane and a hydrocarbon with a carbon number of 3 or higher, according to the embodiments 7 through 9 described above, the hydrocarbon and methane are supplied to a storage container 10, as shown in FIG. 24. Into the storage container 10, a hydrocarbon of a carbon number of 3 or higher, such as propane, butane, or pentane, is first supplied through charging piping 28, and then compressed methane is forced into the container through the charging piping 28. Because the charging piping 28 is connected to the bottom of the storage container 10 as shown in FIG. 24, the methane bubbles through the previously supplied liquid hydrocarbon. This bubbling produces an agitating effect and can hasten the transition of the liquid to its super-critical state. In addition to the bubbling, an agitator 30 to agitate the stored material, being the methane-bearing hydrocarbon in the storage container 10, may also be installed.

Initially, a liquid phase 16 and a vapor phase 12 exist in the storage container 10. When the super-critical state has been entered during the forcing of methane into the hydrocarbon of carbon number 3 or higher in the manner described above, the liquid phase 16 terminates. In the super-critical state, the rates of the constituent elements of the contents of the storage container 10 are set constant, and thus the stored material comprising the constant rates of the constituents can be discharged. The above means of placing the contents of the storage container 10 into a super-critical state is an example of a composition adjusting means of the gas liquefying and storing system for a gas whose principal ingredient is methane according to the present invention.

Figure 25:
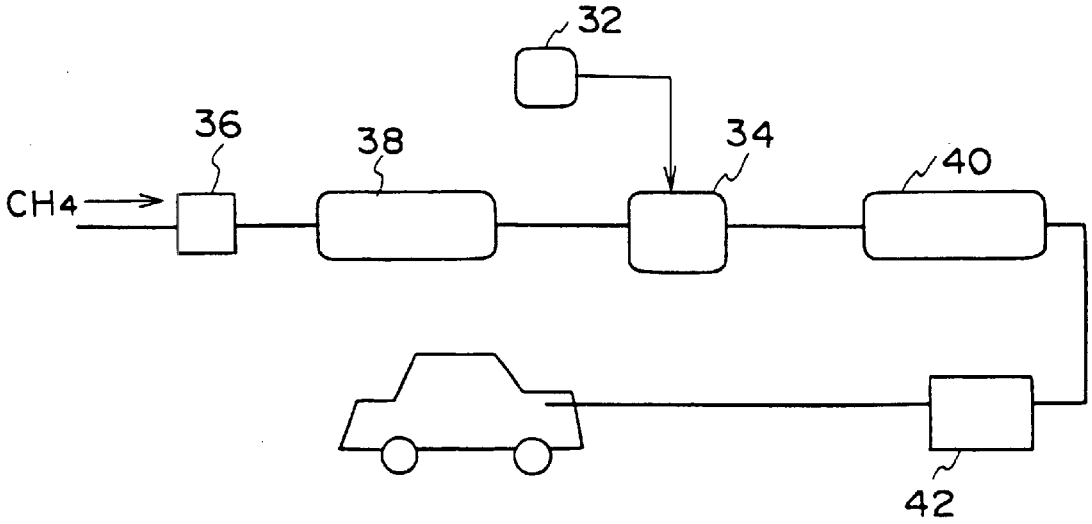
FIG. 25 is a view showing an example case where a mobile-body-component storage container is charged with the methane-bearing hydrocarbon from the storage container.

FIG. 25 shows an example case wherein a mobile-body-component storage container mounted on a mobile body, such as a motor vehicle, is charged with the methane-bearing hydrocarbon in a super-critical state, made by the method shown in FIG. 24. In FIG. 25, from a hydrocarbon tank 32 filled with a hydrocarbon of carbon number 3 or higher, the hydrocarbon is supplied to a mixer 34. Then, the methane accumulated in a methane accumulator 38 after being compressed up to 200 to 250 atm by a booster 36 is released to blow into the mixer 34. The mixer 34 is equipped with a specific agitator, which is not shown. The methane-bearing hydrocarbon made by thus mixing the methane and the hydrocarbon of carbon number 3 or higher, and placed in a super-critical state at about 200 atm, is accumulated in a composite gas accumulator cylinder 40. A charger 43 charges the mobile-body-component storage container with the methane-bearing hydrocarbon in super-critical state accumulated in the composite gas accumulator cylinder 40.

It should be noted that present fuel charging stations often have a service for supplying a gas, such as 13A (wobbe index 12600–13800 (kcal/m$^3$), burning velocity 35-47 (cm/sec), ex. methane 88%, ethane 6%, propane 4%, i-butane 0.8%, n-butane 1.2%), and that such gas can be used instead of methane.

As the storage container 10 shown in FIG. 24 is gradually charged with the methane-bearing hydrocarbon that is a mixture of methane and a hydrocarbon of carbon number 3 or higher, the temperature of the storage container 10 rises. Because the temperature rise of the storage container 10 causes the practical charging rate to decrease, it is necessary to cool the storage container 10.

Figure 26:
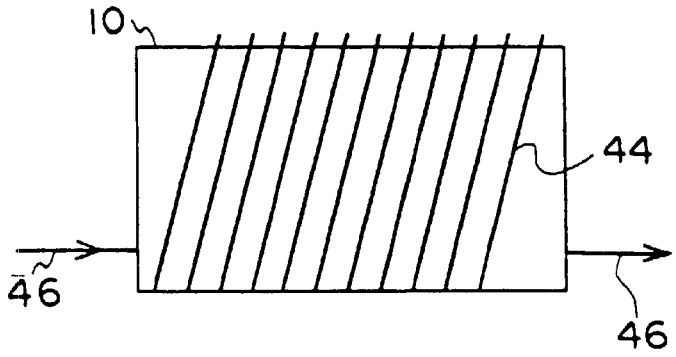
FIG. 26 is a view showing an example of the storage container cooling method.

FIG. 26 shows an example of the method of cooling the storage container 10. In FIG. 26, a cooling pipe 44 is wrapped around the storage container 10 and cooling liquid is supplied from a cooling liquid supply pipe 46 to the cooling pipe 44. When, for example, a 1001-tank was used as the storage container 10 and charged with gas comprising 83% methane and 17% butane at an ambient temperature of 25° C. and a cooling liquid temperature of 10° C., the temperature inside the tank rose to 30° C. A temperature rise of at most 5° C. from the ambient temperature was observed. On the other hand, when the tank was charged with compressed natural gas (CNG) under the same condition, a temperature rise inside the tank of about 25° C. above the ambient temperature was observed.

The methane-bearing hydrocarbon made according to the present invention thus produced a greater cooling effect, most likely as a result of the hydrocarbon property that its liquid phase exists at lower pressure and changes to a super-critical state as the pressure rises. Therefore, the liquid phase existing in the tank under lower pressure condition before the transition to the super-critical state cools the tank, producing a considerable cooling effect.

Embodiment 11

Figure 17:
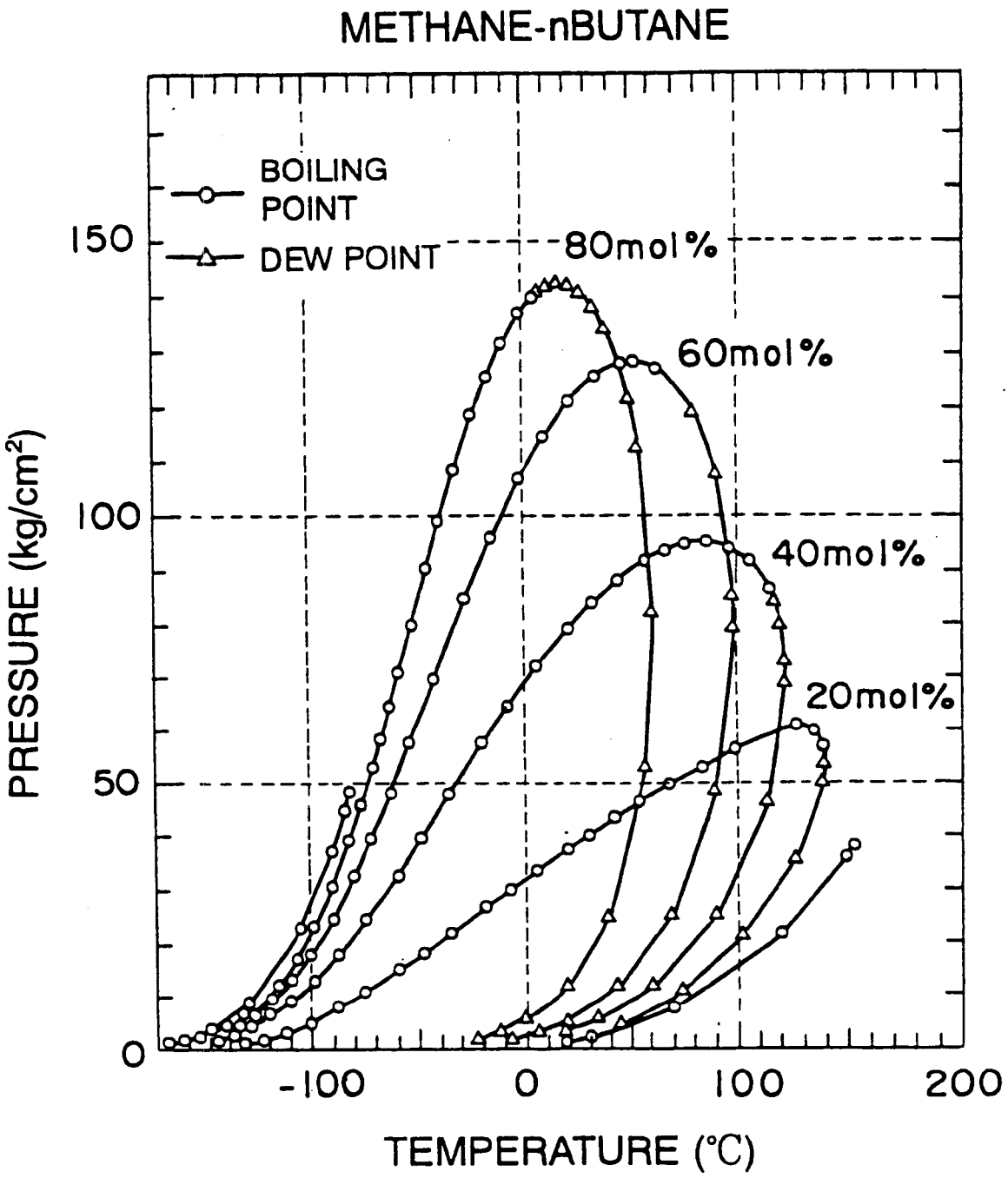
FIG. 17 is a view showing the temperature-pressure correlation of a methane-butane composite.
Figure 18:
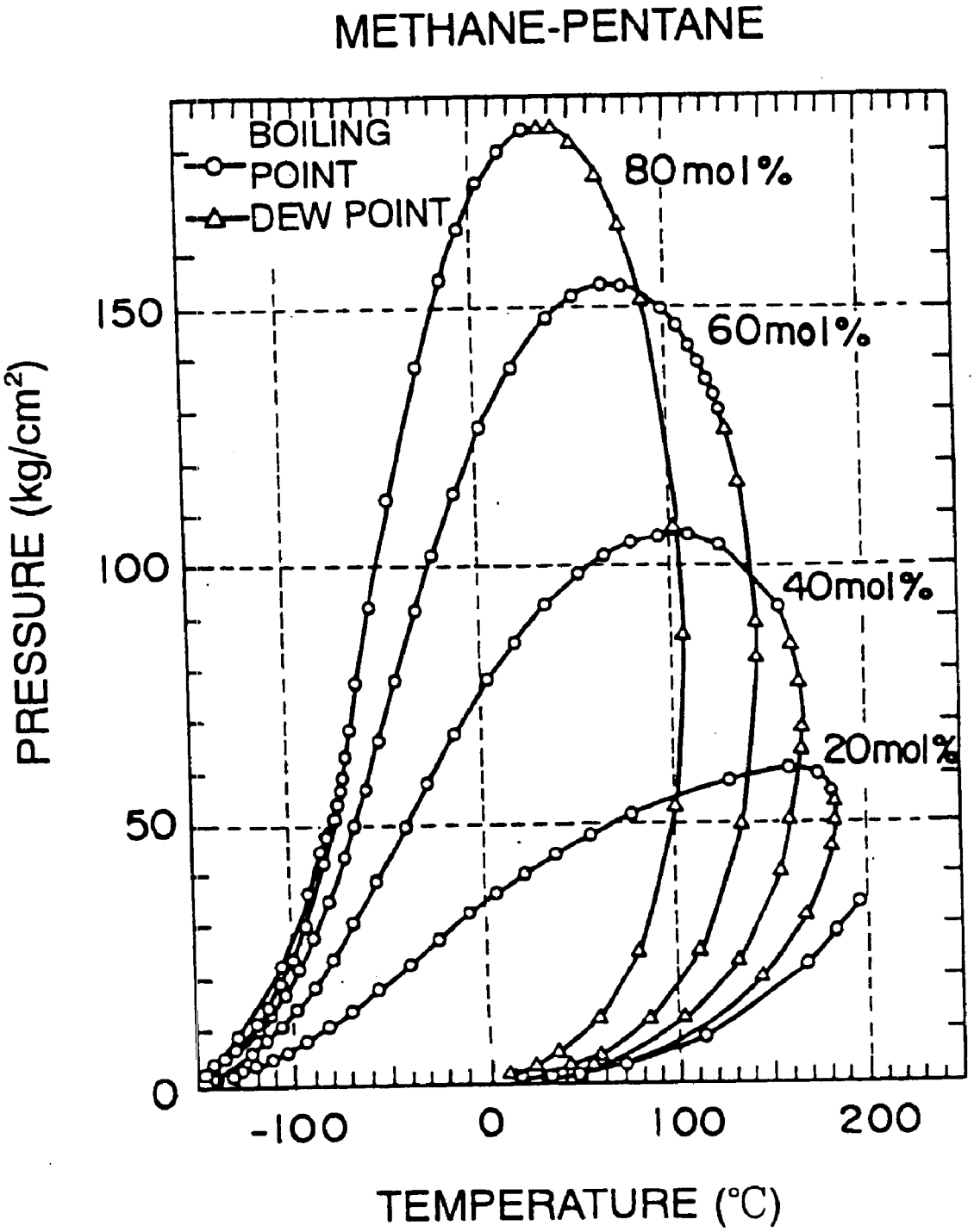
FIG. 18 is a view showing the temperature-pressure correlation of a methane-pentane composite.
Figure 19:
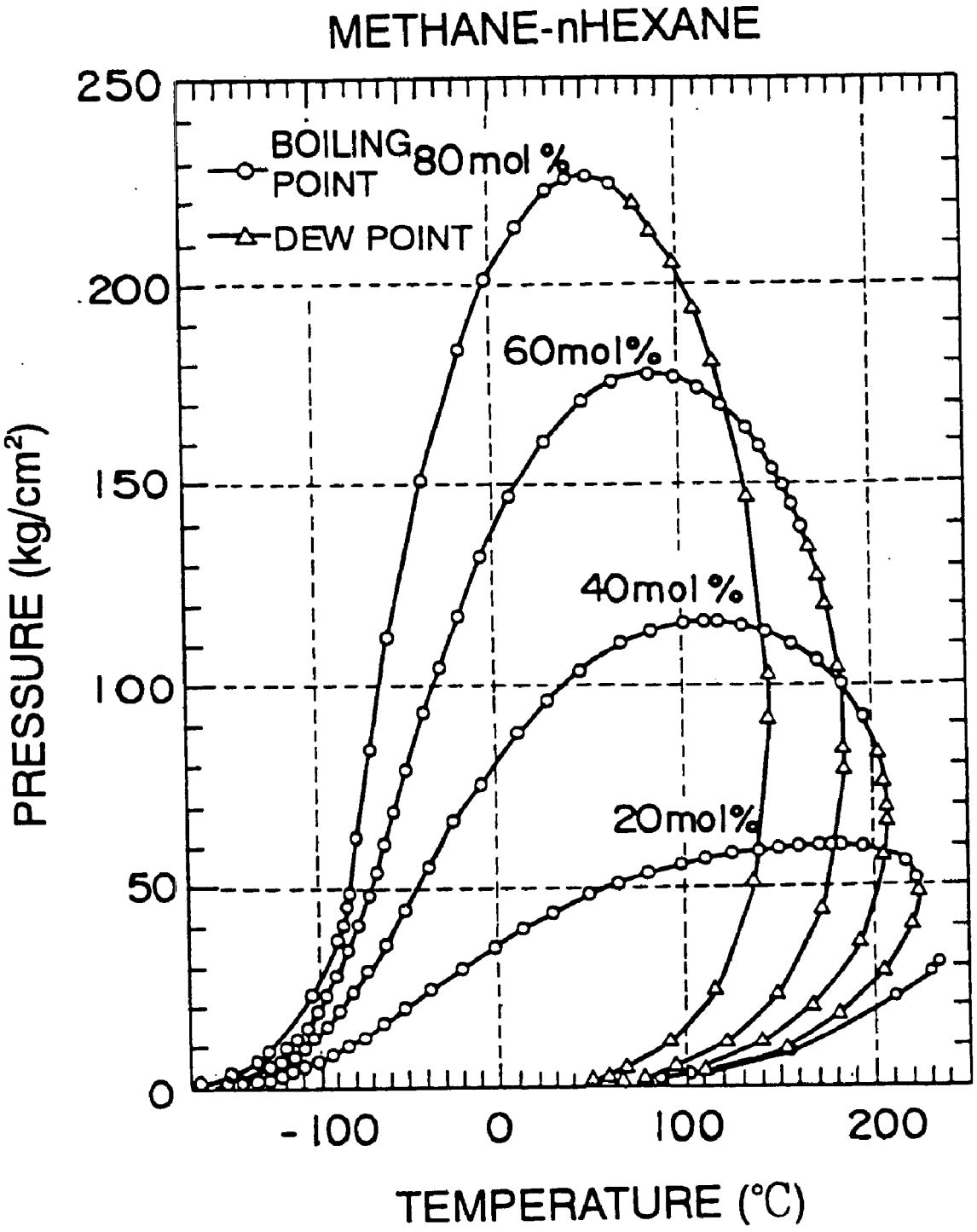
FIG. 19 is a view showing the temperature-pressure correlation of a methane-hexane composite.

FIG. 17 above shows the temperature-pressure correlation of a methane-butane composite made by adding methane to the butane solvent. As indicated in FIG. 17, for an 80% molar ratio of methane, some pressure across its dew-point curve is found at room temperature such as 15° C. Therefore, even if the methane-butane composite in its super-critical state is initially stored in the storage container, the gas will liquefy at a certain pressure when the pressure in the container decreases as the stored methane is used. For the above ratio of methane, no pressure across the dew-point curve is found in the temperature domain of 60° C. Or higher, and this indicates that methane liquefies if pressure falls under general application criteria.

When the vapor and liquid phases exist in the storage container 10 as described above, the methane density in each phase is different. In the vapor phase, methane is rich, and, in the liquid phase, butane is rich. To discharge such methane-bearing hydrocarbon such that the ratios of its constituents will correspond to the ratios fixed when the mixture is discharged in its super-critical state, a combination of the vapor phase component and the liquid phase component must be discharged at a constant ratio at the same time and then blended together before use. By this parallel discharge of both vapor and liquid phases, fuel comprising the same ratios of constituents as expected in its super-critical state can be obtained, because the methane rate as a whole in the storage container 10 is the same as that in the hydrocarbon in its super-critical state.

The above means of discharging the material stored in the storage container 10 by parallel discharge in both the vapor and liquid phases and the merging of the discharged materials is an example of the composition adjusting means included in the present invention. An example of implementing this means will next be explained below.

Figure 27:
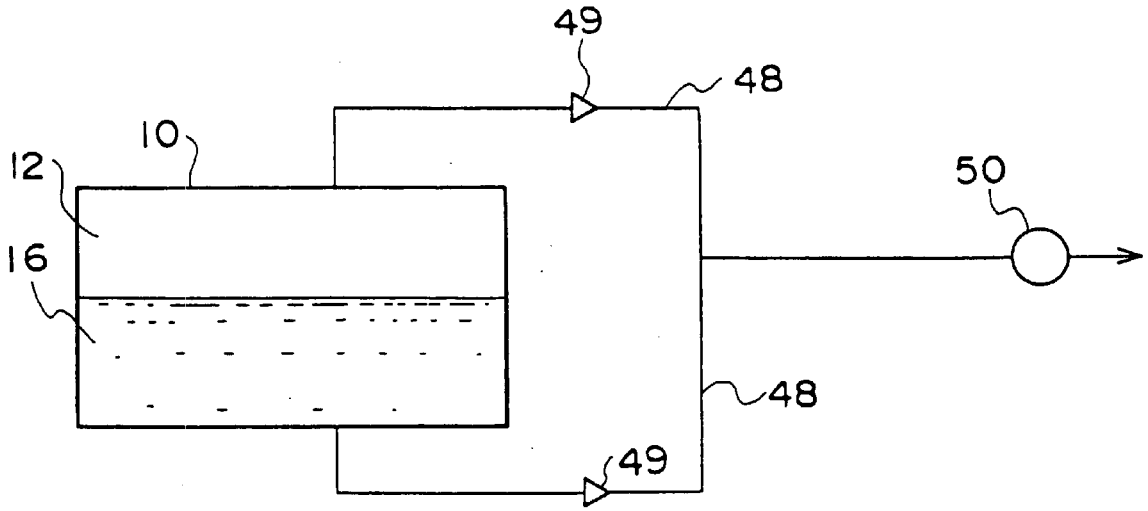
FIG. 27 is a view showing an example case where the methane-bearing hydrocarbon is discharged from both liquid and vapor phases of the storage container.

FIG. 27 shows an example case wherein the methane-bearing hydrocarbon is discharged from both the liquid phase 16 and the vapor phase 12 sections of the storage container 10. In this case, because the density of the liquid phase 16 is higher than that of the vapor phase 12, the diameter of one line of discharge piping 48 from the liquid phase 16 must be smaller than the diameter of the other line of the discharge piping 48 from the vapor phase 12 to offset the difference. The methane-bearing hydrocarbon discharged from the liquid phase 16 and that discharged from the vapor phase 12 are blended together in the discharge piping 48, pressure-regulated by a pressure regulator 50, and supplied to another system in which it is used as fuel.

For example, for a methane-bearing hydrocarbon comprising 17% mole-rate butane and 83% mole-rate methane, vapor-liquid separation occurs at about 21° C. and 130 atm. For such a sample, the diameter of one line of the discharge piping 48 from the liquid phase 16 should be about two thirds of the diameter of the other line of the discharge piping 48 from the vapor phase 12. Then, the rates of the constituents of the methane-bearing hydrogen discharged from the storage container 10 will be equivalent to the rates fixed when during discharge in the super-critical state.

A check valve 49 is installed on each line of the discharge piping 48 to prevent the discharged fuel from returning to the storage container 10.

Figure 28:
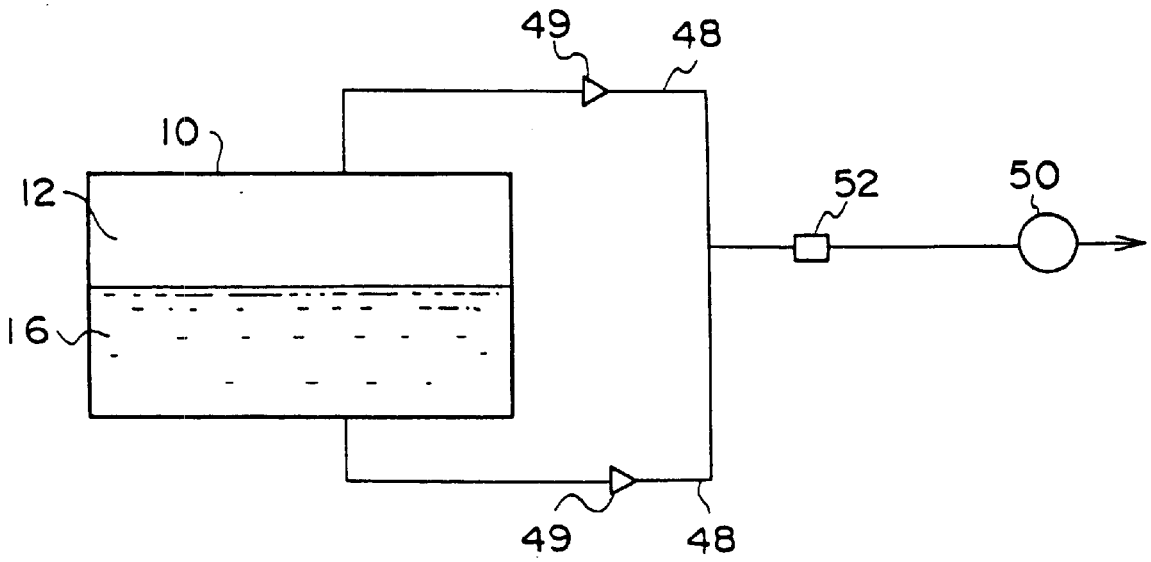
FIG. 28 is a view showing an example of modification to the method shown in FIG. 27.

FIG. 28 shows one example of modification to the method of discharging the methane-bearing hydrocarbon from the storage container 10. In FIG. 28, an agitator 52 is installed on the discharge piping 48 along the route to another system. With this agitator 52, the methane-bearing hydrocarbon discharged from the liquid phase 16 and that discharged from the vapor phase 12 can be sufficiently blended together, so that uniform fuel can be obtained. An example possible structure of the agitator 52 would be a set of vanes installed on a bearing shaft. Because this type of agitator rotates by the discharge pressure of the methane-bearing hydrocarbon, no additional energy source is required.

Figure 29:
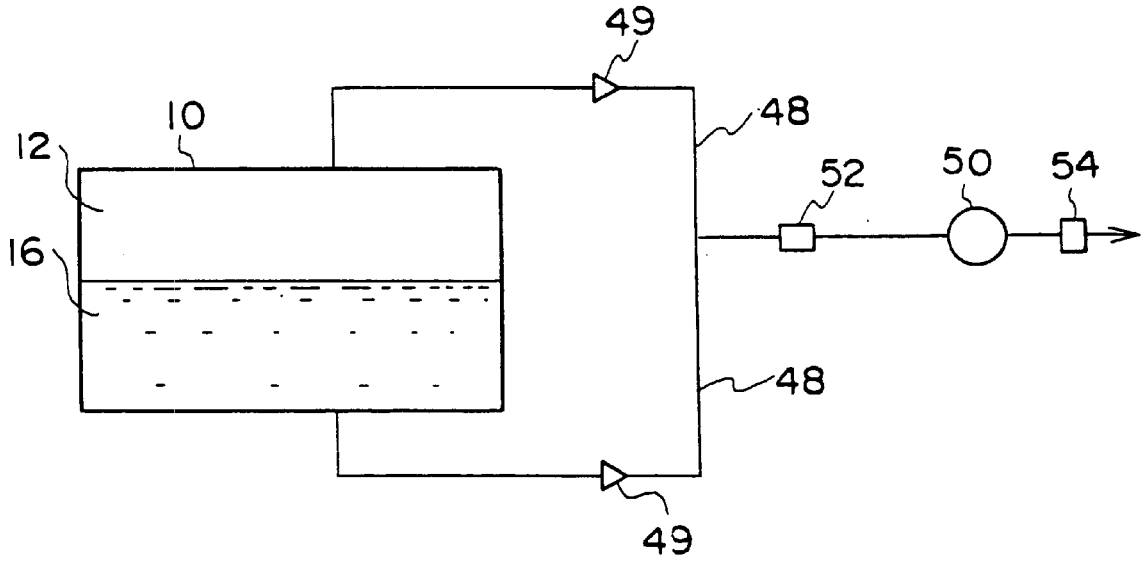
FIG. 29 is a view showing another example of modification to the method shown in FIG. 27.

FIG. 29 shows another example of modification to the method of discharging the methane-bearing hydrocarbon from the storage container 10. In FIG. 29, a heating chamber 54 is installed on the discharge piping on the way to another system. In this heating chamber 54, the methane-bearing hydrocarbon blended after discharge from the liquid phase 16 and the vapor phase 12 of the storage container 10 is heated and blended. This step can completely vaporize the liquid included in the methane-bearing hydrocarbon. Thus, the well blended methane-bearing hydrocarbon with even more uniform composition can be produced.

The above heating chamber 54 may be positioned upward or downward of the pressure regulator 54. As the heat source of this heating chamber 54, engine coolant, for example, may be used. It is appropriate to set the temperature inside the heating chamber 54 to fall within a range of 40° C. to 60° C.

Figure 30:
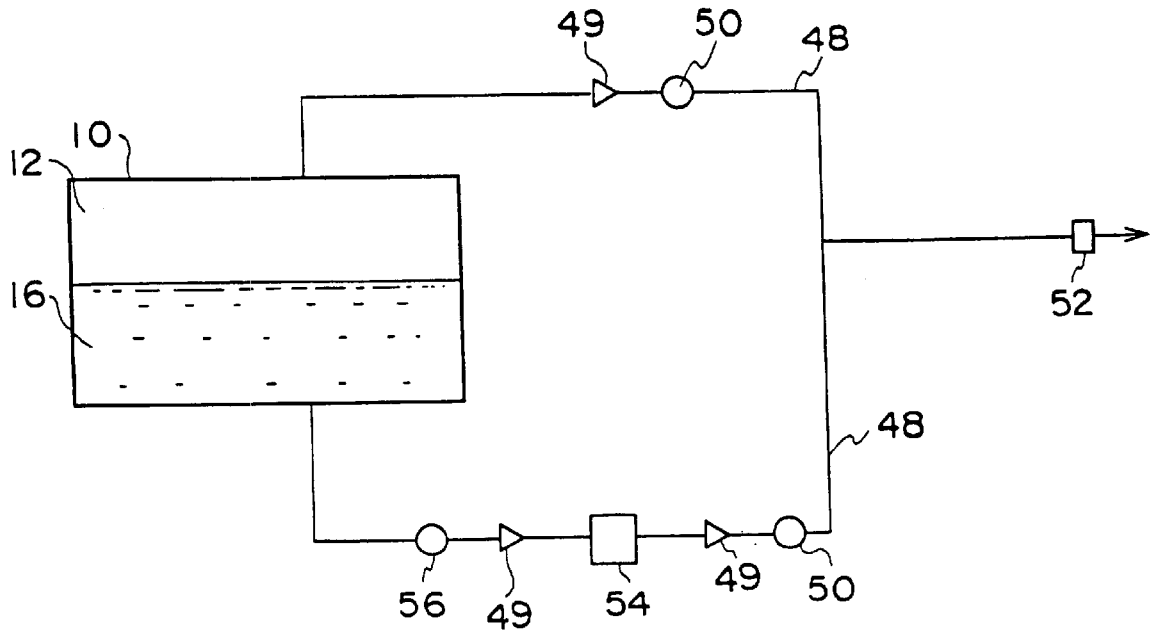
FIG. 30 is a view showing another example of modification to the method shown in FIG. 27.

Furthermore, FIG. 30 shows another example of modification to the method of discharging the methane-bearing hydrocarbon from the storage container 10. In FIG. 30, the liquid methane-bearing hydrocarbon discharged from the liquid phase 16 is carried to the heating chamber 54 where it is vaporized. By merging the thus generated vapor gas and the gaseous methane-bearing hydrocarbon discharged from the vapor phase 12 at a given ratio, fuel with constant constituent ratios can be supplied to another system, such as an engine in which it is used. In such a case, the ratio of the vapor gas generated from the heating chamber 54 to the gaseous methane-bearing hydrocarbon discharged from the vapor phase 12 of the storage container 10 is not necessarily 1:1 when being blended, but should be set appropriately, with the rates of the constituents being taken into consideration. This can stabilize the rates of the constituents of the methane-bearing hydrocarbon to a greater extent.

The liquid methane-bearing hydrocarbon discharged from the liquid phase 16, after its discharge volume is adjusted by a valve 56, is carried through a check valve 49 to the heating chamber 54. The heating chamber 54 whose temperature is set to fall within a range of 40° C. to 60° C. by means of, for example, engine coolant, vaporizes the liquid methane-bearing hydrocarbon carried into it. The hydrocarbon vaporized in the heating chamber 54, after being pressure-regulated by one pressure regulator 50, is blended together with the gaseous methane-bearing hydrocarbon which has been discharged from the vapor phase 12 and also pressure-regulated by another pressure regulator 50. With these pressure regulators 50, the pressure to deliver the vapor gas generated from the heating chamber 54 and the gas discharged from the vapor phase 12 of the storage container 10 should be regulated appropriately. These gas volumes are thus controlled at a certain ratio, as described above, so that the methane-bearing hydrocarbon gas can be obtained with the same rates of its constituents as expected for the whole material in the storage container 10. In addition, the agitator 52 installed on the discharge piping 48 on the way to another system can make the gas composition more uniform.

Figure 31:
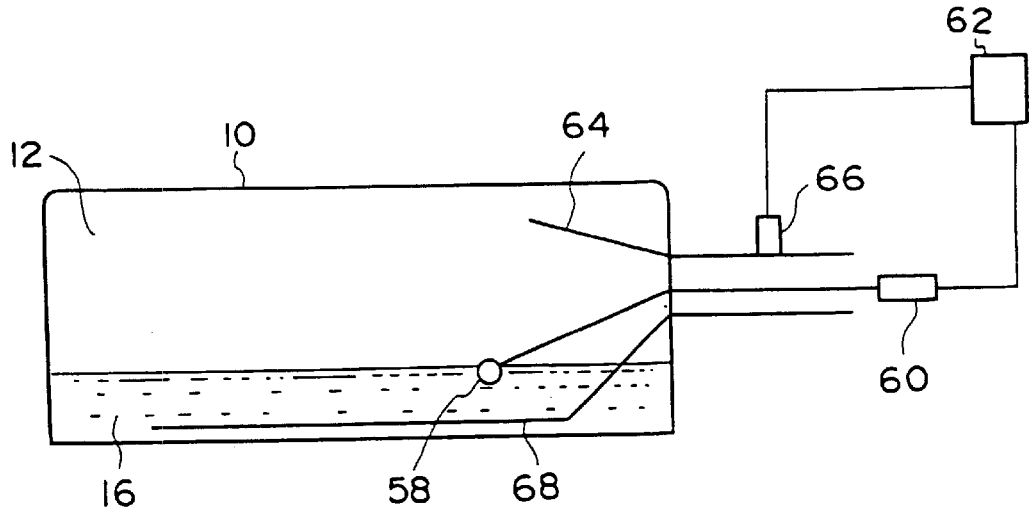
FIG. 31 is a view showing another example of modification to the method shown in FIG. 27.

Furthermore, FIG. 31 shows another example of modification to the method of discharging the methane-bearing hydrocarbon from the storage container 10. FIG. 31, a float 55 is additionally installed to enable detection of the liquid phase 16 in the storage container 10. Because the float 55 floats on the surface of the liquid, the quantity in the storage container 10 can be determined by determining the vertical displacement of the float. A position sensor 60 detects the position of the float 58 and outputs the value to an arithmetic element 62. The float 58, the position sensor 60, and the arithmetic element 62 together constitute a liquid quantity detector included in the preset invention.

In addition, a pressure sensor 66 is attached to a nozzle of vapor-phase portion 64 for discharging the gaseous methane-bearing hydrocarbon from the vapor phase 12 of the storage container 10. The output of this pressure sensor 66 is also input to the arithmetic element 62.

When the liquid phase 16 is detected by sensing the position of the float 58, the arithmetic element 62 calculates the generated liquid quantity, based on the output from the position sensor 60. At the same time, the pressure sensor 66 senses the pressure in the vapor phase 12. Its output, together with the temperature sensed by a thermometer (not shown), is delivered to the arithmetic element 62 where the quantity of the methane-bearing hydrocarbon in the liquid phase is calculated. The remaining quantity in the storage container 10 can thus be determined with a great deal of precision. Because the rates of the constituents of initial fuel in the storage container 10 are known in advance, the rates of the constituents in the liquid phase 16 and the vapor phase 12 can be calculated from the temperature at measurement.

Based on the thus calculated rates of the constituents in the liquid phase 16 and the vapor phase 12, the gaseous and liquid methane-bearing hydrocarbons are discharged respectively from the nozzle of vapor-phase portion 64 and the nozzle of liquid-phase portion 68 at an appropriate ratio. By merging these hydrocarbons together, fuel can be obtained with the same rates of its constituents as fixed when it is discharged in its super-critical state.

The above method has been explained on the assumption that the pressure in the storage container 10 decreases due to the discharge of the methane-bearing hydrocarbon from the container 10, and, as a result, the super-critical state of the hydrocarbon changes to the liquid phase 16. However, for hydrocarbons containing a predetermined rate of methane, such as, for example, those shown in FIGS. 17, 18, and 19, at or above a certain temperature the hydrocarbons do not exist in a liquid phase. When the storage container 10 is heated by allowing, for example, engine coolant delivered from the engine system to flow through the cooling pipe 44 at the container 10, shown in FIG. 26, the super-critical state can be maintained, even when the pressure in the storage container 10 falls. The methane-bearing hydrocarbon having constant rates of its constituents can thus be discharged in its super-critical state, eliminating the need of separate discharge of the hydrocarbon from the liquid phase 16 and the vapor phase 12. To regulate the temperature in order to maintain the super-critical state in the storage container 10, the use of engine coolant as described above is preferable.

Because the temperature of engine coolant delivered from the engine system is normally about 90° C., if butane is used as the hydrocarbon, the 70–80% range of molar ratios of methane enables the discharge of the methane-bearing hydrocarbon, preventing the liquid phase 16 from occurring.

The cooling pipe 44 applied in the manner described above is one example of the composition adjusting means included in the present invention.

Embodiment 12

Figure 32:
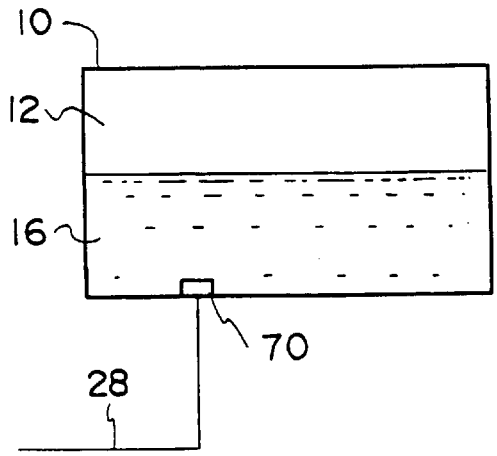
FIG. 32 is a view showing an example of the storage container used for the gas liquefying and storing system for gas whose principal ingredient is methane according to the present invention.

FIG. 32 shows an example of the storage container 10 which may be used in the gas liquefying and storing system for methane-base gas according to the present invention. In FIG. 32, a specific hydrocarbon and methane are supplied through a charging pipe 28 connected to the bottom of the storage container and mixed. Because the charging pipe 28 is attached to the bottom of the storage container 10, the liquid hydrocarbon should first be supplied. The compressed methane or the gas whose principal ingredient is methane bubbles when forced into the hydrocarbon, producing an agitating effect and facilitating the transition to a super-critical state. In addition, at the joint of the charging pipe 28 and the storage container 10, an agitating-vanes assembly 70 is installed that rotates by the pressure released by the blow of the methane or the gas whose principal ingredient is methane, further enhancing the agitating effect.

Figure 33:
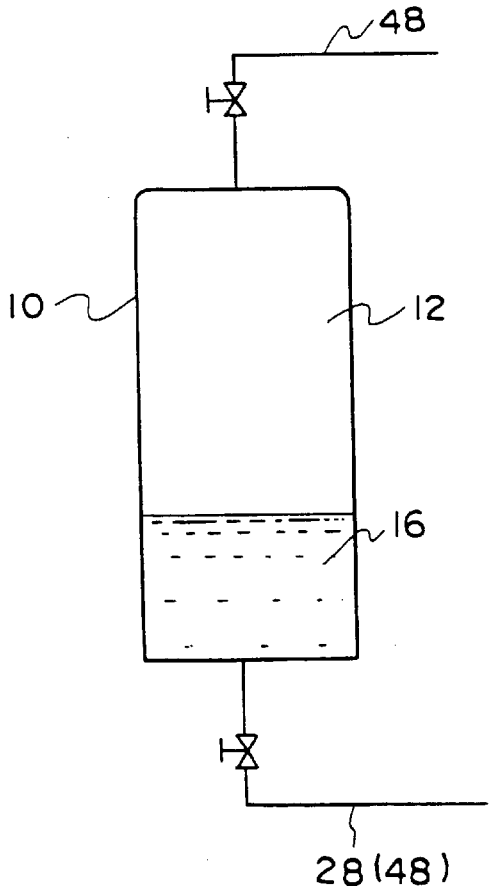
FIG. 33 is a view showing an example of a methane storage container that stands on its edge.

FIG. 33 shows another example of the storage container 10 that is used for the gas liquefying and storing system for methane-base gas. In the example shown in FIG. 33, the storage container 10 is standing on its edge. When the hydrocarbon liquid for dissolving methane enters the storage container 10, therefore, the liquid level rises sooner, causing the methane blow to blow bubbles more easily. In addition, the agitating-vanes assembly 70 may be installed at the joint of the charging pipe 28 and the storage container 10, as shown in FIG. 32.

The above charging pipe 28 and agitating-vanes assembly 70 are an example of an agitating means included in the present invention.

Because the charging pipe 28 is attached to the bottom of the storage container 10, it also functions as one line of the discharge piping 48 from the liquid phase 16. At the top of the storage container 10, the other line of the discharge piping 48 from the vapor phase 12 is also connected to the container. Therefore, if the methane-bearing hydrocarbon in its super-critical state stored in the storage container 10 changes to the liquid phase due to pressure decrease, the gaseous and liquid hydrocarbons can be discharged respectively through the top line and the bottom line of the discharge piping 48. Then, the hydrocarbons discharged separately can blend together according to the method explained in the above Embodiment 11, and the methane-bearing hydrocarbon with uniform rates of its constituents can be obtained.

When the storage container 10 is set to stand on its edge as in this embodiment, installation space can be used more efficiently, such as when it is installed on a motor vehicle.

Figure 34:
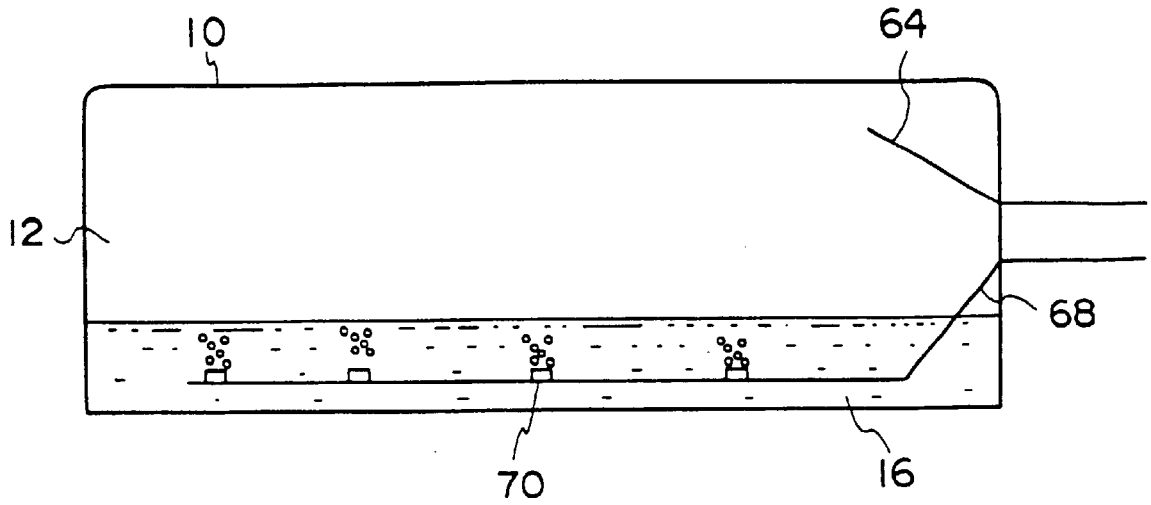
FIG. 34 is a view showing an example of a storage container that is laid on its side.

FIG. 34 shows another example of the storage container used for the gas liquefying and storing system for gas whose principal ingredient is methane according to the present invention. In FIG. 34, the storage container is a tank laid on its side. Similar to the example in FIG. 31, this storage container 10 is furnished with the nozzle of liquid-phase portion 68 for discharging the liquid methane-bearing hydrocarbon from the liquid phase 16 and the nozzle of vapor-phase portion 64 for discharging the gaseous methane-bearing hydrocarbon from the vapor phase 12. The nozzle of vapor-phase portion 64 corresponds to the upper line of the discharge piping 48 shown in FIG. 33 and the nozzle of liquid-phase portion 68 corresponds to the lower line of the discharge piping 48 shown in FIG. 33. When the hydrocarbon in a super-critical state changes to the liquid phase 16, the gaseous and liquid hydrocarbons can be discharged respectively from the nozzle of vapor-phase portion 64 and the nozzle of liquid-phase portion 68. By appropriately blending the constituents, the methane-bearing hydrocarbon can be obtained with the same rates of its constituents as fixed when it is discharged in its super-critical state.

The storage container 10 of this example is charged with a hydrocarbon and methane by allowing them to enter through the nozzle of the liquid-phase portion 68. First, a specific hydrocarbon liquid must enter the storage container 10 through the nozzle of liquid-phase portion 68, and then compressed methane gas is forced into the storage container 10 through the same nozzle 68. On the nozzle of liquid-phase 68, agitating-vanes assemblies 70 are installed at the jets for jetting hydrocarbon and methane. When the gaseous methane is forced into the liquid hydrocarbon, the agitating-vanes assemblies 70 rotate by the pressure released from the compressed methane, thus increasing the agitating effect and facilitating the transition to the super-critical state. It is also appropriate to install a plurality of agitating-vanes assemblies 70, as shown in FIG. 34.

Figure 35:
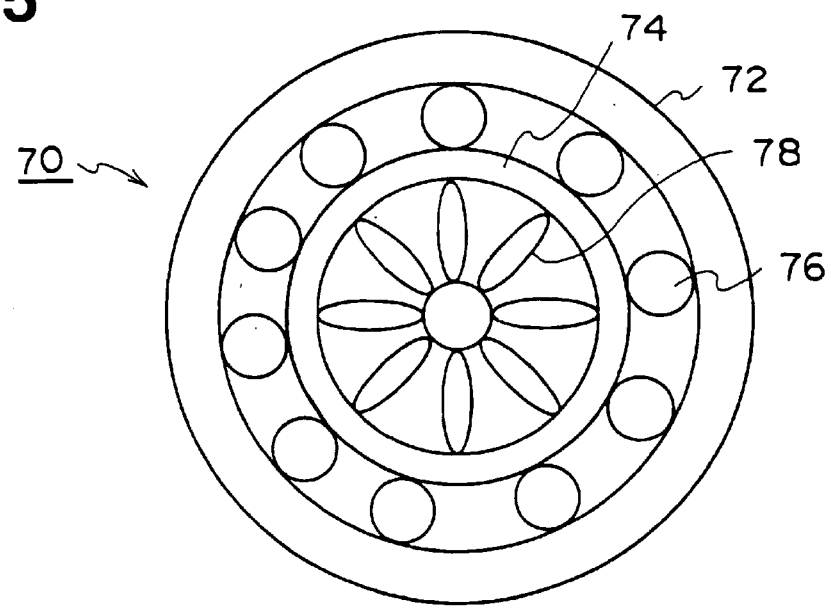
FIG. 35 is a view showing an example of the agitating-vanes assembly used in the container shown in FIG. 34.

FIG. 35 shows an example of the agitating-vanes assembly 70 shown in FIG. 34. In FIG. 35, the agitating-vanes assembly 70 is a ball bearing type. A ball bearing 76 is fit between an outer race 72 and an inner race 74 so that these races can rotate relatively to each other. The inner race 74 houses a set of vanes that rotate with the inner race 74 when the blown methane gas hits against them. The vanes 74 furnished within the inner race 74 can thus agitate efficiently the liquid in the storage container 10 when they rotate by the release of the pressure from the compressed methane. No additional power for rotating the vanes is required, because the pressure of the compressed methane is the power for rotating the vanes.

Embodiment 13

Figure 36:
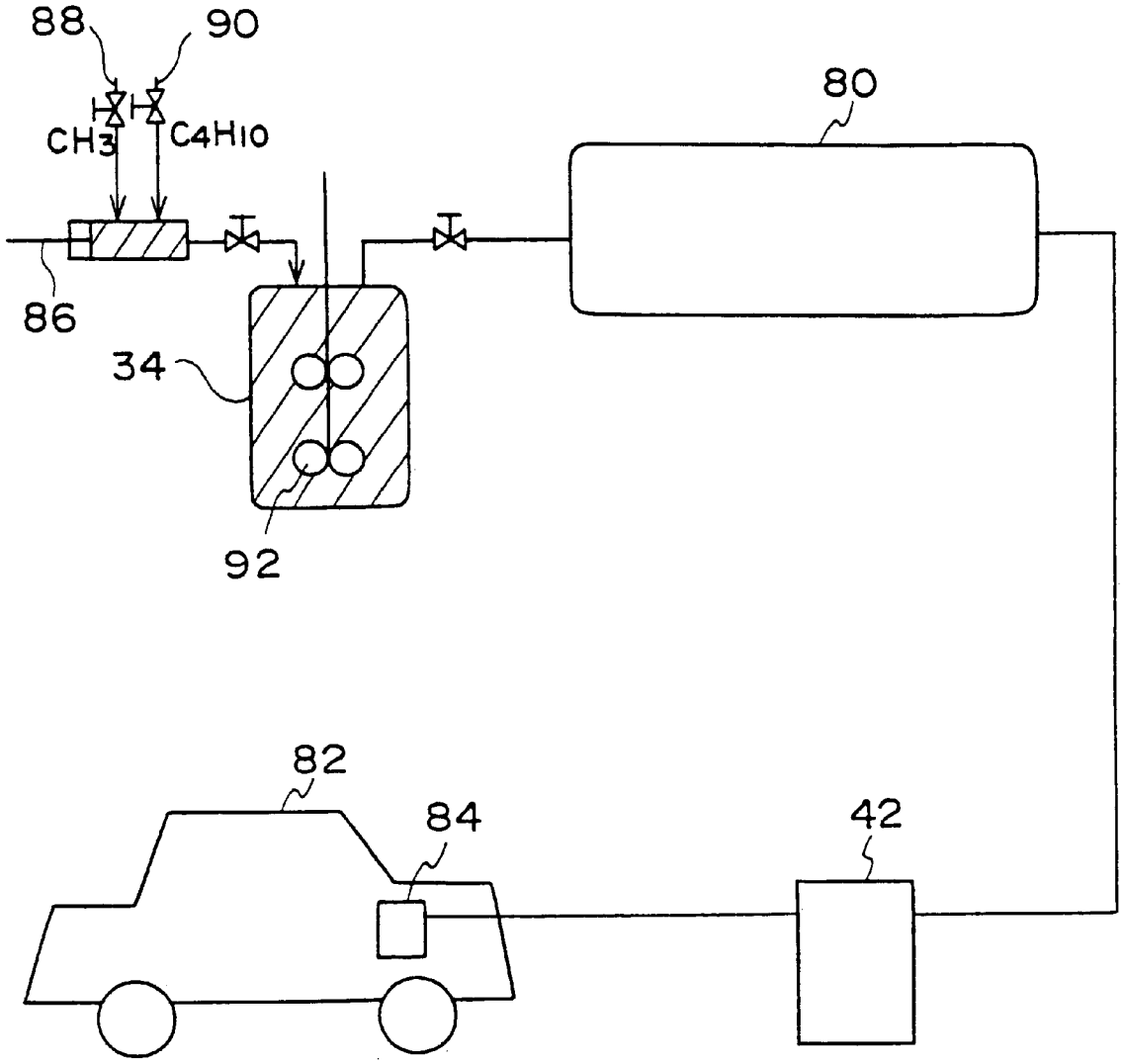
FIG. 36 is a view showing a example of the gas liquefying and storing system for gas whose principal ingredient is methane according to the present invention.

FIG. 36 shows a configuration for implementing the gas liquefying and storing system for methane-base gas according to the present invention. In FIG. 36, a stationary storage container 80 stores a hydrocarbon with a carbon number of 3 or higher and methane or a hydrocarbon of a carbon number of 2 or lower, containing methane as the principal ingredient, in a super-critical state. This stationary storage container 80 is installed in a stationary station for supplying methane-bearing hydrocarbons to mobile bodies.

A charger 42 is connected to the stationary storage container 80, and via the charger, a mobile-body-component storage container 84 mounted on a mobile body such as a motor vehicle is charged with the methane-bearing hydrocarbon in the super-critical state. The mobile-body-component storage container 84 can thus be charged with such hydrocarbon in a super-critical state.

As mobile-body-component storage containers 84 are charged with the methane-bearing hydrocarbon, the pressure in the stationary storage container 80 decreases. As shown in FIGS. 16 through 19 above, different methane-bearing hydrocarbons, each of which is produced by mixing methane with a different hydrocarbon, may liquefy at certain temperatures and pressures, according to the mole percent of methane. When, in the super-critical state, pressure decreases at a given temperature, pressure level intersects the dew-point curve at a certain temperature at which the liquid phase begins. When, for example, butane and methane are mixed, the 80% mole-percent methane-bearing hydrocarbon remains in a super-critical state at 20° C. and 140 atm or higher, but enters a liquid state when the pressure falls below 140 atm.

To maintain the mixture within the stationary storage container 80 in the super-critical state, when some methane-bearing hydrocarbon in the container is used to charge a mobile-body-component storage container 84, resupply may be required for the container to cover the corresponding shortage. The stationary station involved in the present invention is furnished with a mixer 34 and a piston 86 for charging the stationary storage container 80. To the piston 86, a methane supply pipe 88 and a butane supply pipe 86 are connected. The butane supply pipe 90 is not limited to butane, but an alternative may be used that can supply an appropriate hydrocarbon of a carbon number of 3 or higher. A stirrer 92 is installed in the mixer 34.

With the mixer 34 and the piston 86, methane-bearing hydrogen in super-critical state is supplied to the stationary storage container 80 in the following manner. First, methane and butane are supplied to the piston 86 through the respective methane supply pipe 88 and the butane supply pipe 90, and the piston 86 forces these into the mixer 34. This operation is repeated until the pressure in the mixer becomes great enough for the mixture of methane and butane to enter a super-critical state, while the stirrer 92 stirs the contents of the mixer 34 to hasten the transition to the super-critical state. Next, the methane-bearing hydrocarbon set in its super-critical state in the mixer 34 is fed to the stationary storage container 80. of course, it is possible to use another hydrocarbon of a carbon number of 3 or higher instead of butane.

When the pressure at which the methane-bearing hydrocarbon is stored in the mobile-body-component storage container 84 is about 200 atm, the pressure in the stationary storage container 80 must be maintained at about 250 atm. Therefore, it is important to supply the methane-bearing hydrocarbon to the stationary storage container 80 to cover the shortage of the contents so that the above pressure will be maintained.

Figure 37:
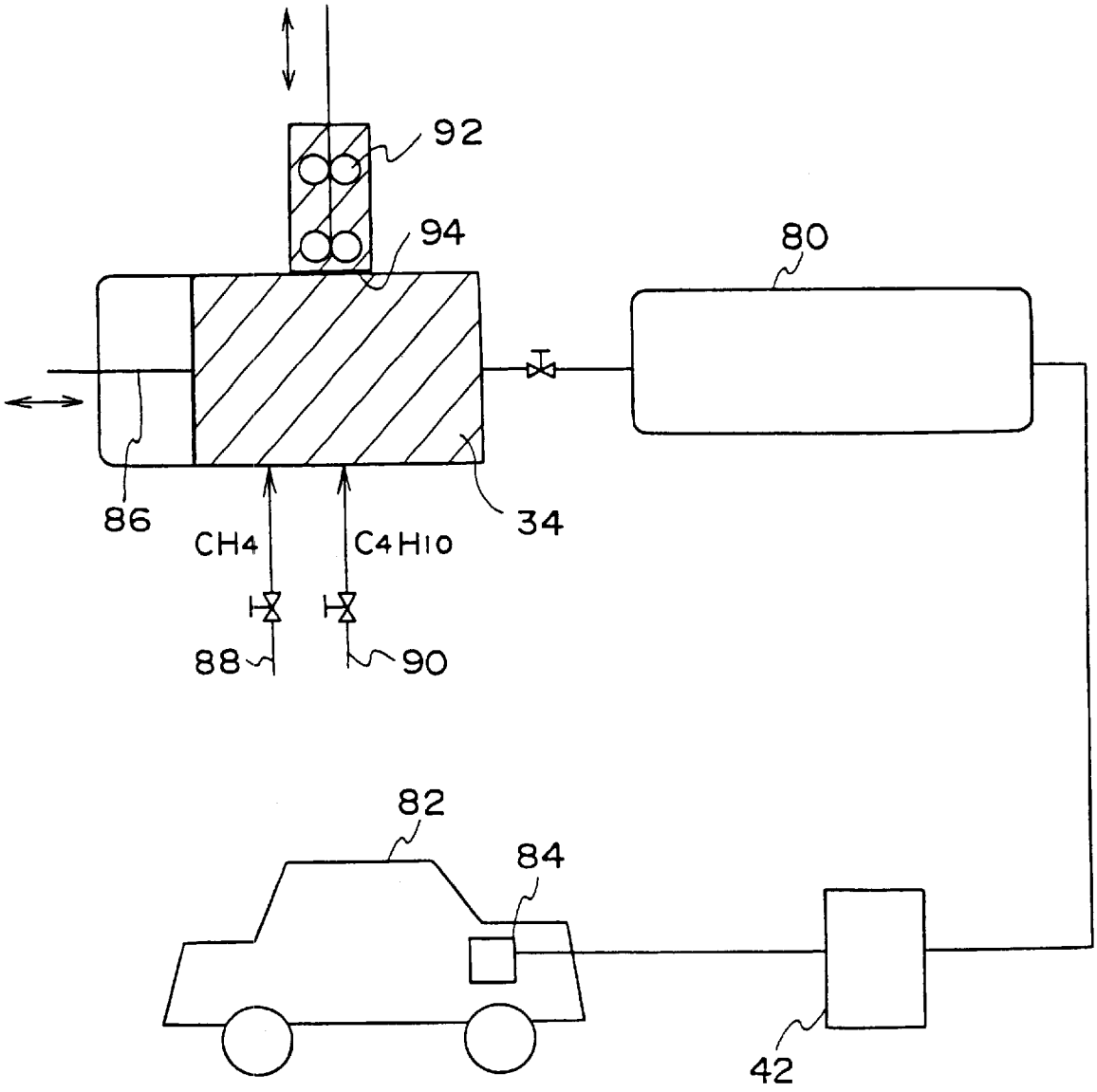
FIG. 37 is a view showing a example of modification to the gas liquefying and storing system for gas whose principal ingredient is methane according to the present invention.

FIG. 37 shows an example of modification to the above scheme for implementing the gas liquefying and storing system for gas whose principal ingredient is methane according to the present invention. In FIG. 37, the mixer 34 and the piston 86 are integrated into one unit. With this configuration, the stirrer 92 is normally located outside the mixer 34 and retracts into the mixer 34 when necessary to stir the contents of the mixer 34. While the stirrer 92 is outside the mixer 34, a shutter 94 closes the entrance for the stirrer 92. Methane-bearing hydrocarbon is supplied to the stationary container 80 as follows: methane and butane are respectively supplied through the methane supply pipe 88 and the butane supply pipe 90 to the mixer 34; the stirrer 92 stirs the contents of the mixer 34, and withdrawn from the mixer 34; and the piston 86 pushes the methane-bearing hydrocarbon in super-critical state into the stationary storage container 80. Other than butane, another hydrocarbon of a carbon number of 3 or higher may be preferably employed. In this modification, the pressure in the stationary storage container 80 must be maintained at about 250 atm.

Figure 38:
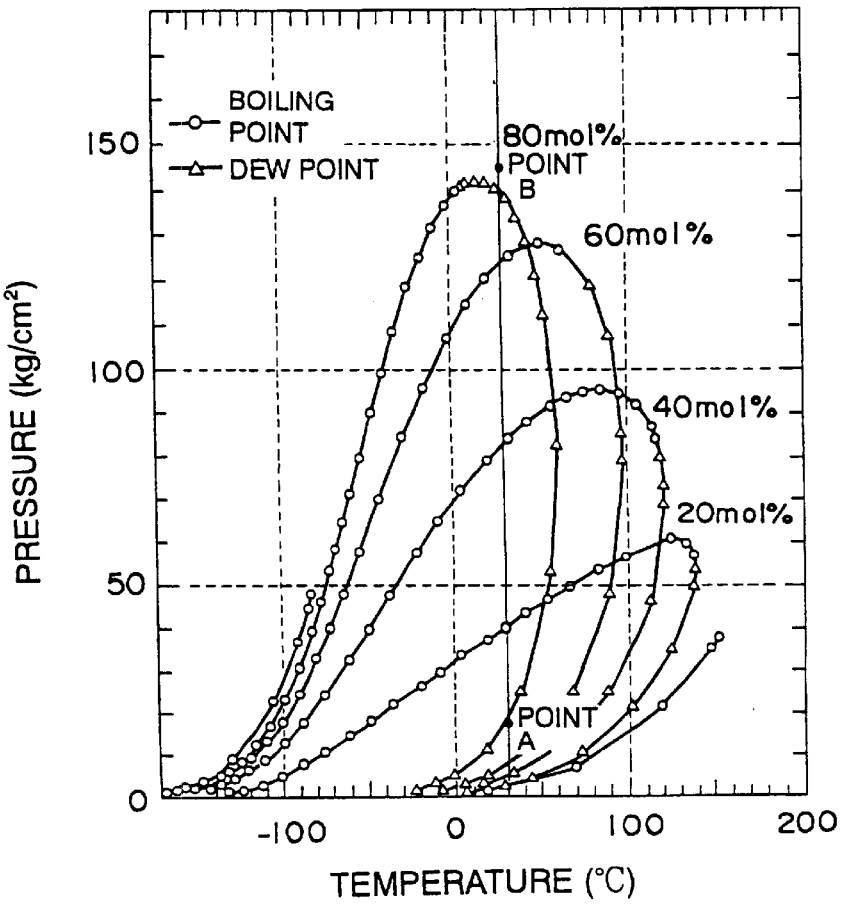
FIG. 38 the temperature-pressure correlation of a methane and butane composite.

During the process that pressure rises as the piston 86 compresses the methane-bearing hydrocarbon, some pressure level may intersect the dew-point curve, when the liquid phase of the hydrocarbon appears. FIG. 38 shows he temperature-pressure correlation of a methane-butane composite, which corresponds to that shown in FIG. 17. In FIG. 38, when pressure increases at 30° C., the pressure levels of 20 atm and 140 atm intersect the dewpoint curve. Hence, at this temperature, the liquid phase exists in the domain from 20 atm to 240 atm. This adverse effect of the liquefaction of the methane-bearing hydrocarbon can be reduced by applying two stages of compressing the methane-butane mixture gas. First, rapid compression from less than 20 atm, for example, point A, to above 140 atm, for example, point B, should be performed and followed by the second compression from point B to 250 atm. Undergoing two or more stages of compression, the methane-bearing hydrocarbon can be more readily compressed to a high pressure. This can be accomplished by arranging a plurality of pistons 86 in the line along which the methane-bearing hydrocarbon is supplied to the stationary storage container 86.

When the mobile-body-component storage container 84 mounted on a mobile body 82 shown in FIGS. 36 and 37 is charged with methane-bearing hydrocarbon, it is necessary to measure its charge quantity. However, as shown in FIG. 38, the methane-bearing hydrogen may, depending on temperature and pressure, liquefy. To obtain correct measurements, the charge quantity must be measured in the super-critical state; there should be no possibility of liquid phase occurring. It is desirable to control temperature and pressure at the charger 42 to prevent the liquid phase from occurring in the charger 42. It is preferable that the charger 42 be furnished with a heating facility (not shown), so that the super-critical state can be maintained even when the charger pressure, which can be regarded as being equivalent to the pressure in the stationary storage container 80, falls.

The above piston 86 and mixer 43 constitute injection equipment involved in the present invention.

Embodiment 14

The methane stored in super-critical state by the gas liquefying and storing system for methane-base gas explained above can be used to supply energy to, for example, fuel cells. Because the methane storing method according to the present invention enables higher-density methane to be stored as explained above, the tank capacity, for example, for fuel-cell-powered motor vehicle application, could be reduced, and consequently such vehicles can be made more compact by virtue of lighter fuel system construction.

Figure 39:
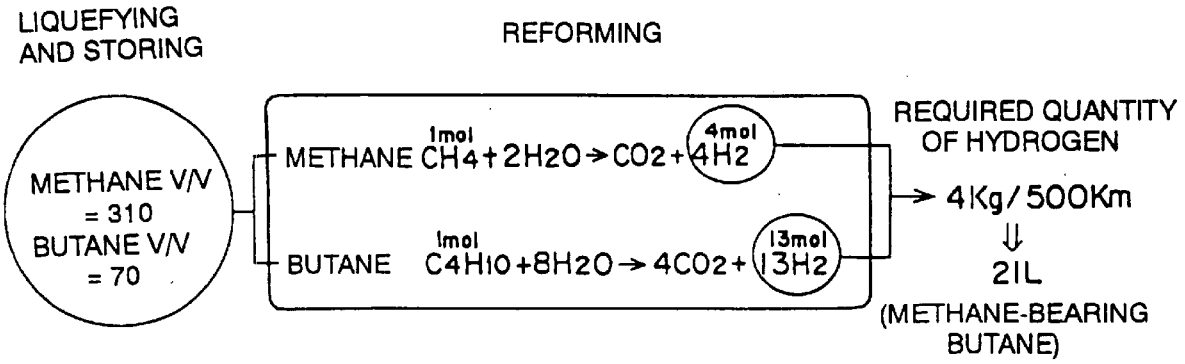
FIG. 39 is a view showing a process of reforming the methane-bearing hydrocarbon stored by the gas liquefying and storing system for gas whose principal ingredient is methane according to the present invention.

FIG. 39 shows the process of reforming the methane-bearing hydrocarbon (methane-bearing butane) to be used for fuel cells, assuming that the hydrocarbon has been prepared by dissolving methane in butane. In FIG. 39, in the reforming apparatus, methane and butane are separately decomposed and hydrogen is extracted. When, for example, a fuel-cell-powered motor vehicle runs 600 km, 4-kg hydrogen is needed, 4 moles of hydrogen are derived from 1 mole of methane and 13 moles of hydrogen are derived from one mole of butane. To derive 4-kg of hydrogen from the methane-bearing butane hydrogen with the rates of the constituent elements shown in FIG. 39 (methane V/V=310, butane V/V=70), 21 liters of hydrogen in a super-critical state are required. Table 2 compares the calculated quantity of methanol required for the motor vehicle to run 500 km and the corresponding quantity of methane.

TABLE 2

Comparison of fuel tank types to be mounted on a motor vehicle

| Fuel and storing method | For 500-km run Weight (kg) | Capacity (lit.) | Remarks |
|---|---|---|---|
| Reforming | | | |
| Methanol | 41 | 41 | Reforming efficiency is a theoretical value. |
| Liquefied and stored methane | 19 | 21 | |

As seen from Table 2, 41 liters of methanol is required for the vehicle to run 500 km. When, however, the methane-bearing-butane composite made by dissolving methane in butane and stored in its super-critical state is used as fuel for fuel cells, the vehicle can run 500 km on just 21 liters of fuel. Thus, a smaller tank is sufficient for storing the methane-bearing butane fuel for the corresponding distance to run.

In the gas liquefying and storing system according to the invention, methane is stored after being dissolved in a hydrocarbon of a carbon number of 3 or higher, such as propane, butane, etc. Because a hydrocarbon such as propane and butane is decomposed more readily than methane, the reforming reaction for extracting hydrogen can be performed at lower temperature. For example, steam reforming of methane requires a temperature of about 900° C., whereas methane dissolved in butane and stored in super-critical state can be decomposed for reforming at about 700° C. For the latter, therefore, the heat loss of hydrogen can be reduced, and reforming performed at higher efficiency.

Because of the lower temperature for steam reforming for the methane-bearing hydrocarbon stored by the above system according to the present invention, the water used for reforming can be easily withdrawn and the quantity of water to be supplied for steam reforming can be reduced to a great extent.

FIG. 40 shows three manners of electric power supply and their overall efficiency: electric power generation at power stations, typically a thermal power plant where natural gas is used as raw material to generate electricity; compressed natural gas (CNG) is reformed and supplied to fuel cell (FC); and natural gas stored in super-critical state by the storing method according to the present invention is reformed and supplied to FC. As can be seen from FIG. 40, the manner of supplying fuel cells with the methane-bearing hydrocarbon in super-critical state stored by the methane storing method according to the present invention can attain the highest overall efficiency of electric power generation because the hydrocarbon stored according to the present invention can be reformed at higher efficiency as explained above.

Embodiment 15

Figure 41:
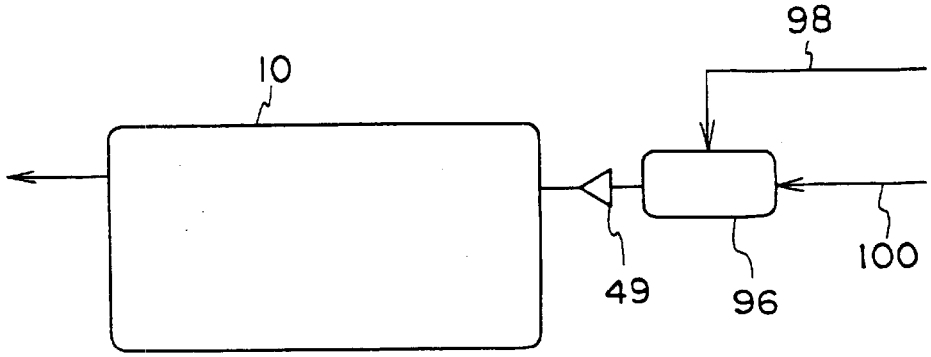
FIG. 41 is a view showing a method of charging the storage container at low pressure with a hydrocarbon of a carbon number 3 or higher in the gas liquefying and storing system for gas whose principal ingredient is methane according to the present invention.

FIG. 41 shows, as a preferred Embodiment 15 of the present invention, a configuration scheme of the storage container 10 and the equipment for supplying the storage container 10 with a hydrocarbon of a carbon number 3 or higher and methane or a hydrocarbon of a carbon number of 2 or lower, bearing methane as the principal ingredient. In FIG. 14, a chamber 96 is connected to the storage container 10 via a check valve 49. To the chamber 96, two pipes are connected. One of these is a solvent supply pipe 98 for supplying a hydrocarbon of a carbon number 3 or higher, and the other is a methane supply pipe 100 for supplying methane or a hydrocarbon of a carbon number of 2 or less, and having methane as the principal ingredient.

When, from the storage container 10, the methane-bearing hydrocarbon is supplied to a user fuel system, such as fuel cells, both the methane and the hydrocarbon of a carbon number of 3 or higher in the storage container 10 diminish. Thus, the storage container 10 must be replenished with both methane and a hydrocarbon of a carbon number of 3 or higher. Because of its properties to high pressure, even if methane or a hydrocarbon of a carbon number of 2 or lower, bearing methane as the principal ingredient, is compressed up to as high as 200 atm so that the internal super-critical state of the storage container 10 will be maintained, the container 10 can sufficiently be charged. For a hydrocarbon of a carbon number of 3 of higher, on the other hand, the storage container 10 can also be charged if high pressure is applied to it, but difficulties, including a problem of liquefaction, are commonly encountered when a hydrocarbon having more carbons is compressed up to high pressure.

In the present embodiment, therefore, the chamber 96 is first supplied through the solvent supply pipe 98 with a given quantity of a hydrocarbon of a carbon number of 3 or higher under low pressure. Then, the storage container 10 is charged with high-pressured methane through the methane supply pipe 100 and via the chamber 96. When the storage container 10 is charged with methane, the hydrocarbon of a carbon number of 3 or higher, which have previously been injected into the chamber 96, is carried with methane. High-pressure application to the hydrocarbon can thus be avoided and the storage container 10 can easily be charged.

The above chamber 96 corresponds to a temporary charging container included in the present invention.

Embodiment 16

Figure 42:
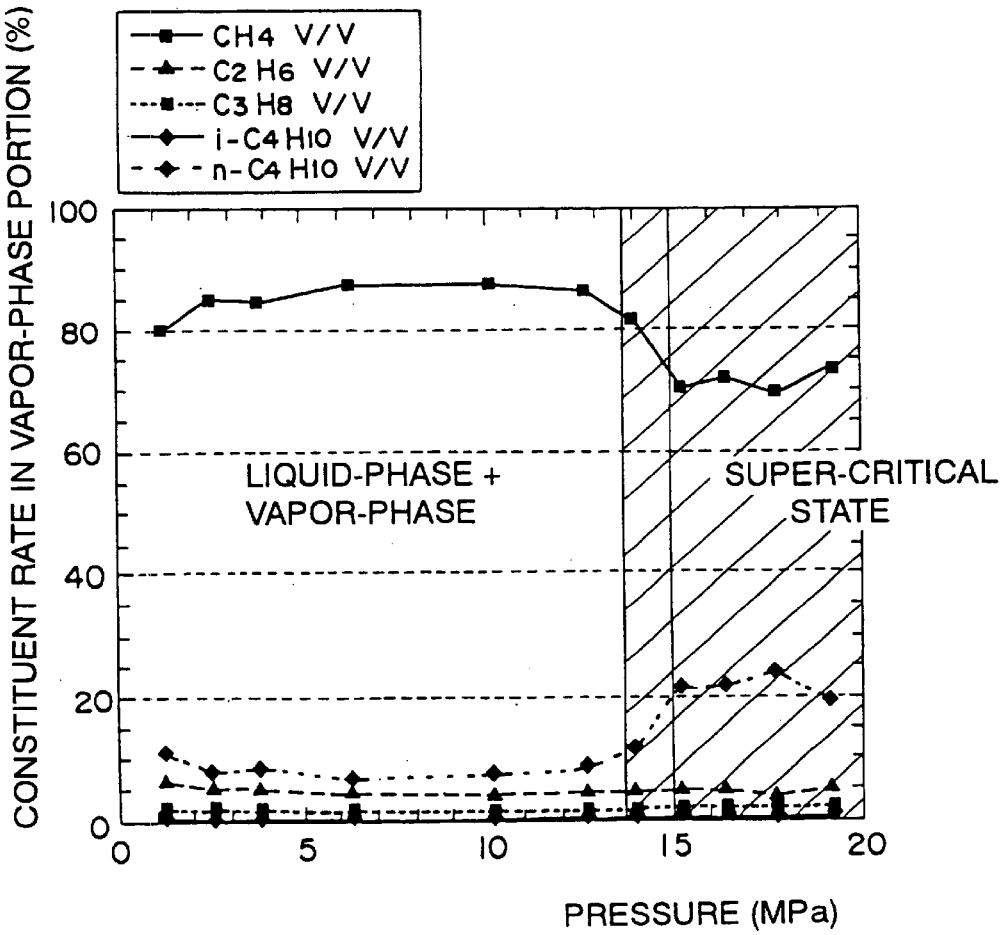
FIG. 42 is a view showing the ratios of the constituent elements of the vapor-phase portion contents of the storage container in the super-critical state and the state of coexistent vapor and liquid phases.
Figure 43:
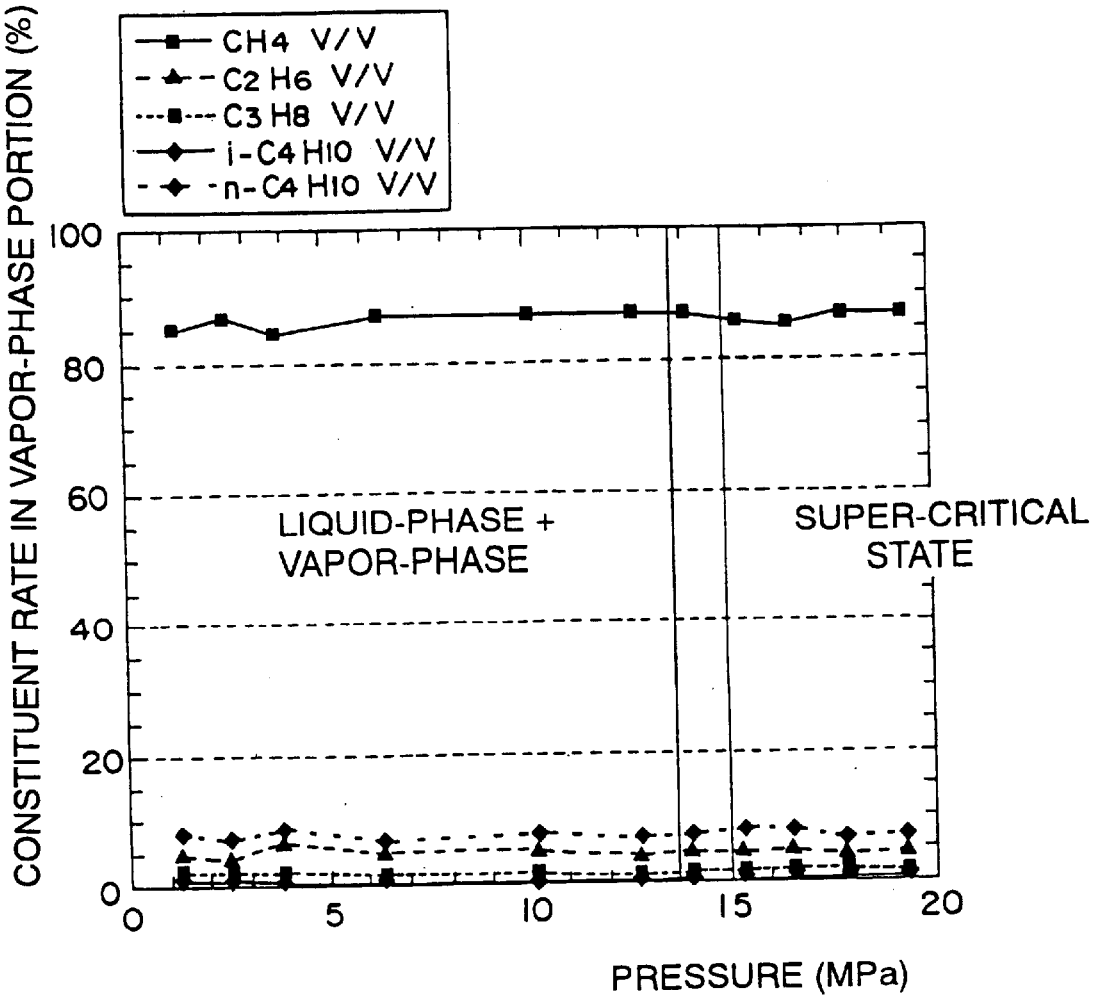
FIG. 43 is a view showing the ratios of the constituent elements of the vapor-phase portion contents of the storage container in the super-critical state and the state of coexistent vapor and liquid phases when the storage container is charged with the composite with the same ratios of its constituents as the ratios of the constituent elements of the vapor-phase portion of the content of the storage container in the state of coexistent vapor and liquid phases shown in FIG. 42.

When butane is used as a hydrocarbon of a carbon number of 3 or higher, and natural gas such as 13 A is dissolved in the butane and put into a super-critical state, the ratios of the constituent elements of the composite are as shown in the super-critical domain in FIG. 42. These ratios are the ratios of the constituents of the gas to be discharged from the storage container 10. When the super-critical state changes to the state in which vapor and liquid phases coexist (the domain of liquid phase+vapor phase, shown in FIG. 42), the mixture becomes rich with butane in a liquid phase, and, consequently, the gas in the vapor-phase portion consists of more methane and less butane. The example shown in FIG. 42 explains the state of coexistent vapor and liquid phases at 21° C., wherein the n-butane rate is stable at 7%, more or less. Then, it has been found that, if the n-butane rate in the storage container 10 is initially adjusted to 7%, approximately constant rates of the constitutes of the gas can be maintained, whether in the vapor-phase portion during the state of coexistent vapor and liquid phases or during the super-critical state, as shown in FIG. 43. Therefore, it is preferable to set the rates of the constituents of the methane-bearing hydrocarbon with which the storage container 10 is charged equal to the rates of those that exist in the vapor-phase portion during the state of coexistent vapor and liquid phases in the container. In this way, the methane-bearing hydrocarbon with approximately constant rates of its constituents can be discharged the vapor-phase portion of the storage container 10 during the state of coexistent vapor and liquid phases or from the container 10 during the super-critical state.

For the example shown in FIG. 43, the constituents of the hydrocarbon are 82.2% $CH_4$, 6% $C_2H_6$, 4% $C_3H_8$, 0.8% i-$C_4H_{10}$, and 7% n-$C_4H_{10}$. Whether in the super-critical state or in the state of coexistent vapor and liquid phases of the storage container 10, the rates of the constituents of the stored material to be discharged from the container 10 can be maintained approximately constant, preventing an adverse effect on the combustion characteristics of an engine on the user vehicle side.

Embodiment 17

Figure 44:
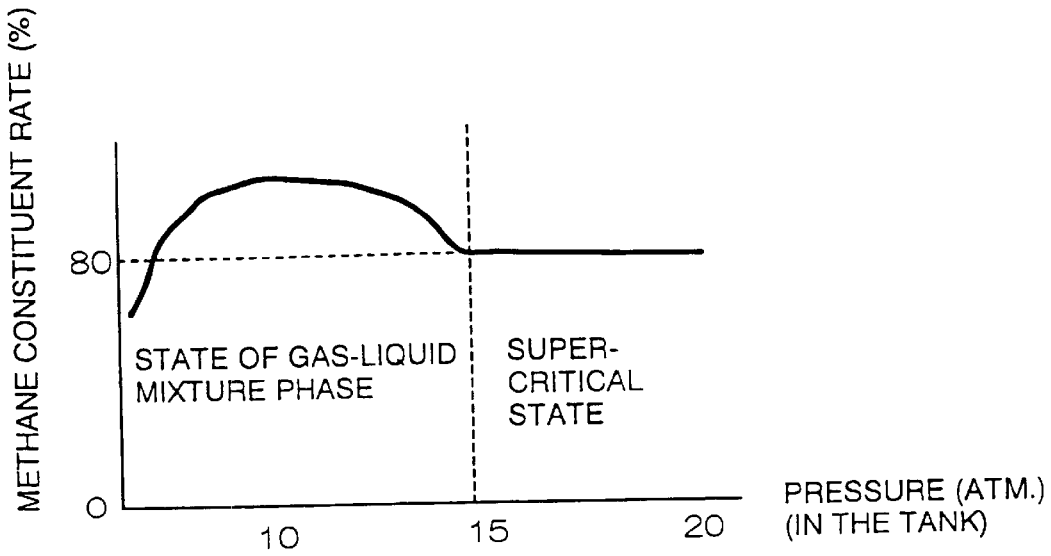
FIG. 44 is a view showing the transition of the methane constituent ratio when a butane-methane composite stored at a ratio of 20:80 in the storage container is discharged in its super-critical state and when this composite is discharged from the vapor-phase portion in the state of coexistent vapor and liquid phases.

FIG. 44 shows the changing methane constituent rate in the fuel supplied from the storage container 10 in which butane and methane have been stored at a butane-to-methane ratio of 20:80 during one period that the fuel in super-critical state is supplied to a user fuel system on a vehicle and the other period that the methane-bearing hydrocarbon is supplied as fuel from the vapor-phase portion 12 in the state of coexistent vapor and liquid states. During the super-critical state in which the fuel is supplied, the methane constituent rate in the stored material discharged from the storage container 10 is constant, and, thus, the ratios of the constituents of the methane-bearing hydrocarbon remaining in the storage container are also kept constant.

On the other hand, when the super-critical state changes to the state of coexistent vapor and liquid states as a result of pressure and temperature changes, and the stored material is supplied from the vapor-phase portion 12 of the storage container 10, the methane constituent ratio may become as high as that shown in FIG. 44. As a result, the methane rate in the methane-bearing hydrocarbon remaining in the storage container 10 changes. Even when the storage container 10, in which the methane rate has changed, contains fuel with constant constituent ratios at a butane-methane ratio of 20:80, the ratios of the constituents of the fuel in the storage container 10 become different from those at the initial charge. Consequently, problems arise such as that the methane rate in the fuel supplied to the user fuel system cannot be kept constant, and high-density methane cannot be stored at an optimum rate in the storage container 10.

To counter this effect, the following steps may be employed: measure the quantity and the rates of the constituents of the methane-bearing hydrocarbon (fuel) remaining in the storage container 10: based on the measurement data, supply the storage container 10 at a gas station as fuel supply facility with a hydrocarbon solvent such as butane and gas, such as natural gas whose principal ingredient is methane, so that the ratios of the constituents of the fuel in the storage container 10 will be equal to the ratios of initially supplied.

Figure 45:
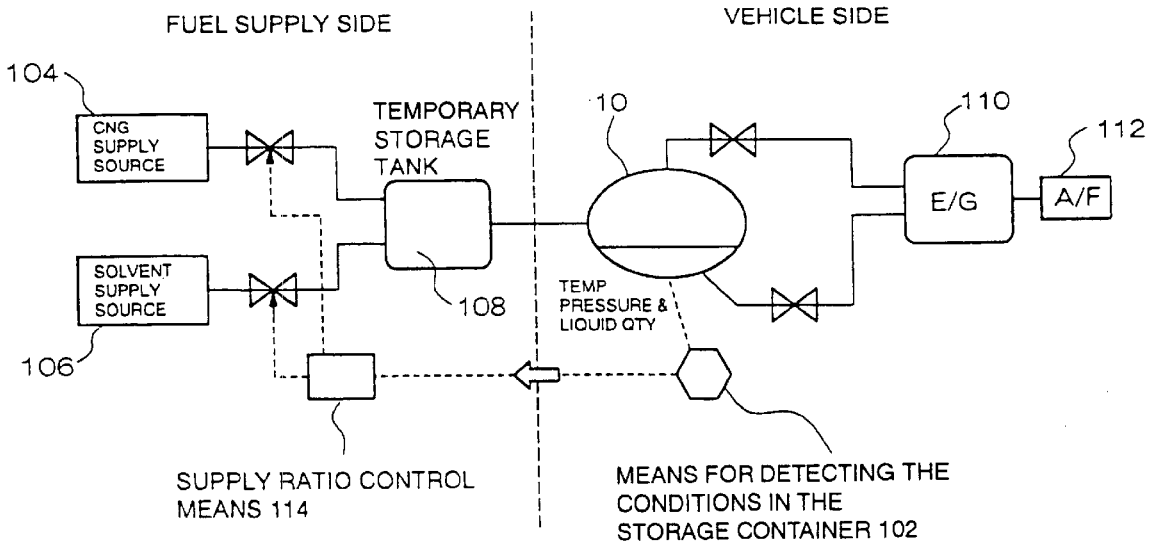
FIG. 45 is a configuration scheme of a preferred Embodiment 17 of the gas liquefying and storing system for gas whose principal ingredient is methane according to the present invention.

FIG. 45 shows a configuration scheme for implementing the Embodiment 17 in which the storage container 10 can be supplied with methane and hydrocarbon in the manner described above. In FIG. 45, when the storage container 10 on the vehicle side is supplied with fuel from the fuel supply side, a means for determining the conditions in the storage container 102 measures the rates of the constituents of the methane-bearing hydrocarbon stored in the storage container 10 and the quantity of hydrocarbon solvent and sends the measurements data to a supply ratio control means 114 on the fuel supply side. The means for determining the conditions in the storage container 102 thus comprises a composition information determining means for determining the rates of the constituents of the stored material in the storage container 10 and the quantity of the hydrocarbon solvent and a sending means for sending the results of detection to the supply side from which gas whose principal ingredient is methane and a hydrocarbon solvent are supplied to the storage container 10. Based on the supplied data, the supply ratio control means 114 calculates a ratio at which a gas, such as CNG (compressed natural gas), bearing methane as the principal ingredient and a hydrocarbon solvent are supplied to the storage container 10. According to the calculation result, the supply ratio control means 114 regulates the valve opening at a CNG supply source 104 and a solvent supply source 106 to supply a temporary storage tank 108 with CNG and a hydrocarbon solvent at a ratio suitable for the vehicle that will use the mixture as fuel. After being reserved temporarily, the CNG and hydrocarbon solvent are supplied to the storage tank 10 on the vehicle side.

During this process, the temporary storage tank 108 is first charged with hydrocarbon, then with CNG. This is because the tank 108 is difficult to charge with the hydrocarbon solvent liquid if it is previously charged with CNG that is normally compressed at a ratio as high as 20 MPa.

Pressure, temperature, and liquid quantity at the storage container 10 are input to the means for determining the conditions in the storage container 102. From the pressure and temperature, the current gas volume of the storage container can be calculated. The quantity of the hydrocarbon solvent in the storage container 10 can be determined from the position of the float or the measured electrostatic capacitance of the storage container 10. In addition, by using a table of the constituent rates, created in advance, the ratios of the constituents of the fuel stored in the storage container 10 can be calculated from the pressure and temperature.

Then, the material stored in the storage container 10 is oxidized in an internal combustion engine such as an engine 110. On the fuel use side, an air-fuel (A/F) ratio determining means 112 measures an air-fuel ratio and calculates the ratios of the constituents of the fuel consumed by the engine 110, so that what quantity of fuel to be supplied to the engine can be calculated. It is also applicable to obtain the ratios of the constituents and the quantity of the consumed fuel (hydrocarbon) in this way and to send this data to the solvent supply side. In this manner, approximately constant ratios of the constituents of the material stored in the storage container 10 can be maintained, and fuel with constant constituent ratios can be supplied to the engine 110.

Figure 46:
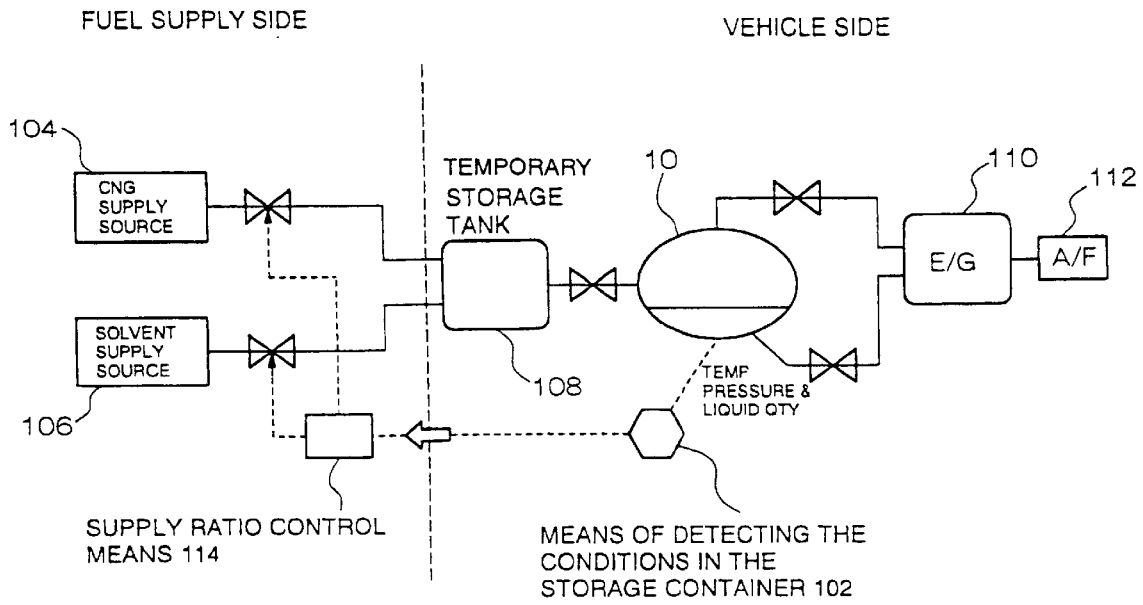
FIG. 46 is an example of modification to the gas liquefying and storing system for gas whose principal ingredient is methane shown in FIG. 45.

FIG. 46 shows an example of modification to the gas liquefying and storing system for gas whose principal ingredient is methane according to the present embodiment. In FIG. 46, the temporary storage tank 108 is installed on the vehicle side instead of the fuel supply side. Installing the temporary storage tank 108 on the fuel supply side such as gas stations is now considered difficult, but installing it on the vehicle side, as in this modification, is relatively easy. This manner enables the easy charge of motor vehicles with gas whose principal ingredient is methane and a hydrocarbon solvent without requiring the construction of a new fuel supply facilities.

In the above description of this embodiment, it is assumed that the storage container 10 is fully charged. The container may, however, be charged with a specific quantity of fuel less than the container's full capacity. To enable flexible charging of the container, the supply ratio control means 114 in this embodiment can calculate a ratio at which CNG and a hydrocarbon solvent supplied, according to the quantity to be supplied of the gas whose principal ingredient is methane. The storage container 10 on the vehicle side can thus be recharged appropriately with a given quantity of fuel less than its full capacity.

Embodiment 18

Figure 47:
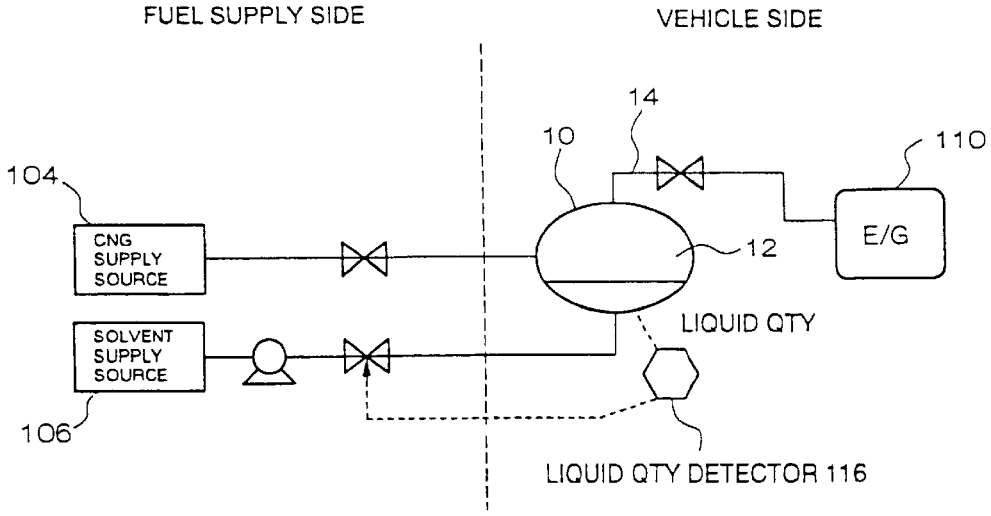
FIG. 47 is a configuration scheme of a preferred Embodiment 18 of the gas liquefying and storing system for gas whose principal ingredient is methane according to the present invention.

FIG. 47 shows a configuration scheme of a preferred Embodiment 18 of the gas liquefying and storing system for gas whose principal ingredient is methane according to the present invention. For the storage container 10 installed on the vehicle side, in FIG. 47, the content of only its vapor-phase portion 12 is exclusively discharged through a vapor-phase outlet 14 provided at the top of the storage container 10. The liquid quantity of the hydrocarbon solvent in the storage container 10 is detected by a liquid quantity detector 116.

With discharge from only the vapor-phase portion 12 through the vapor-phase outlet 14 at the top of the storage container 10, approximately constant ratios of the constituents of the material stored can be maintained in the storage container 10, even when the material is discharged. Therefore, the vapor-phase outlet 14 according to this embodiment is an example of the composition adjusting means included in the present invention. According to the present embodiment, because only the contents of the vapor-phase portion 12 are discharged from the storage container, the consumption of the hydrocarbon solvent in which methane is dissolved can be reduced while methane consumption continues.

When the storage container 10 is replenished with fuel at the fuel supply side as in the above embodiment, normally, a CNG supply source 104 supplies only CNG. At this time, a solvent supply source 106 supplies a hydrocarbon solvent when necessary, if the liquid quantity detector 116 installed at the storage container 10 detects a decrease of the liquid in the storage container 10. Although traces of hydrocarbon solvents are also discharged from the vapor-phase portion 12 of the storage container, an appropriate amount of hydrocarbon solvent to be replenished can be determined by only the liquid quantity in the storage container 10 detected through the liquid quantity detector 116.

Figure 48:
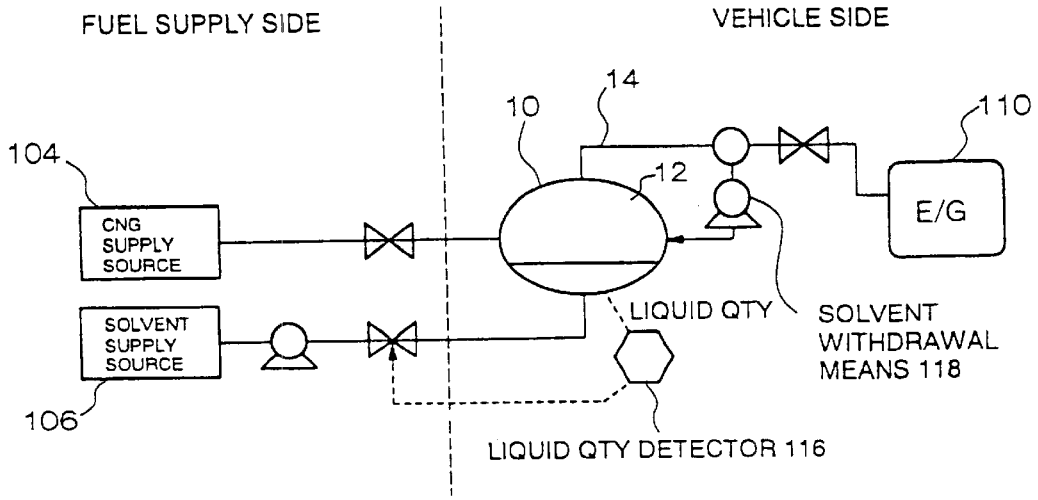
FIG. 48 is an example of modification to the gas liquefying and storing system for gas whose principal ingredient is methane shown in FIG. 47.

FIG. 48 shows an example of modification to the gas liquefying and storing system configuration for methane-base gas according to this embodiment. In FIG. 48, a solvent withdrawal means 118 is located on the route from the vapor-phase outlet 14. This solvent withdrawal means 118 withdraws a trace of hydrocarbon solvent liquid included in the gas discharged from the vapor-phase portion 12 of the storage container 10 and returns it to the storage container 10. This further helps prevent the hydrocarbon solvent in the storage container 10 from decreasing, so that the rates of the constituents of the hydrocarbon in the storage container 10 can be stabilized.

Figure 49:
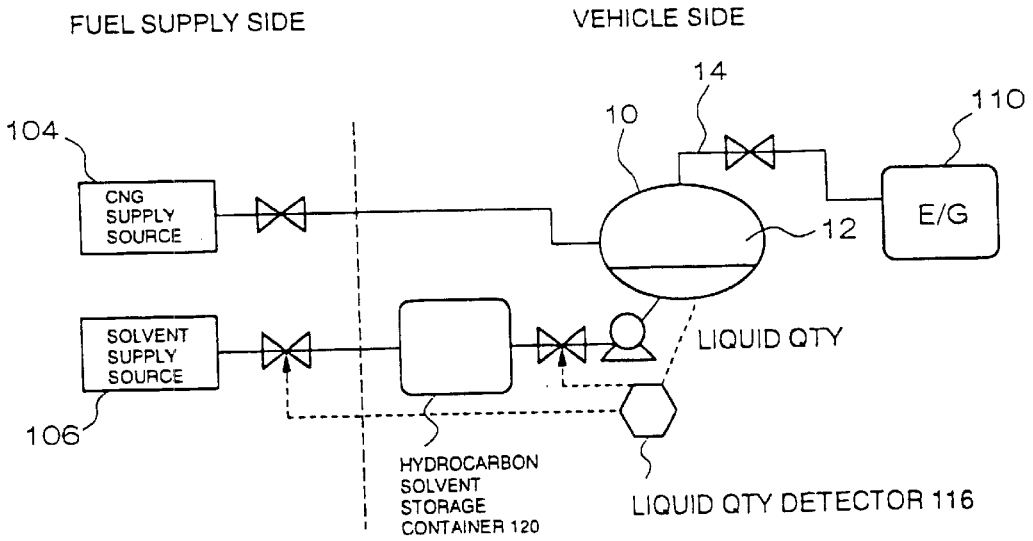
FIG. 49 is another example of modification to the gas liquefying and storing system for gas whose principal ingredient is methane shown in FIG. 47.

FIG. 49 shows another example of modification to the gas liquefying and storing system configuration for gas whose principal ingredient is methane in this embodiment. In FIG. 49, the storage container 10 is installed on the vehicle side, or, in other words, on the mobile body, and to this container 10, a hydrocarbon solvent-dedicated storage container 120 for storing only the hydrocarbon solvent is connected. A control means, for example, a control valve, is provided between the storage container 10 and the hydrocarbon solvent-dedicated storage container 120. In this manner, the frequency of fuel recharge during which a hydrocarbon solvent is supplied from the fuel supply side, such as gas stations, to the vehicle side, can be reduced.

Embodiment 19

Figure 50:
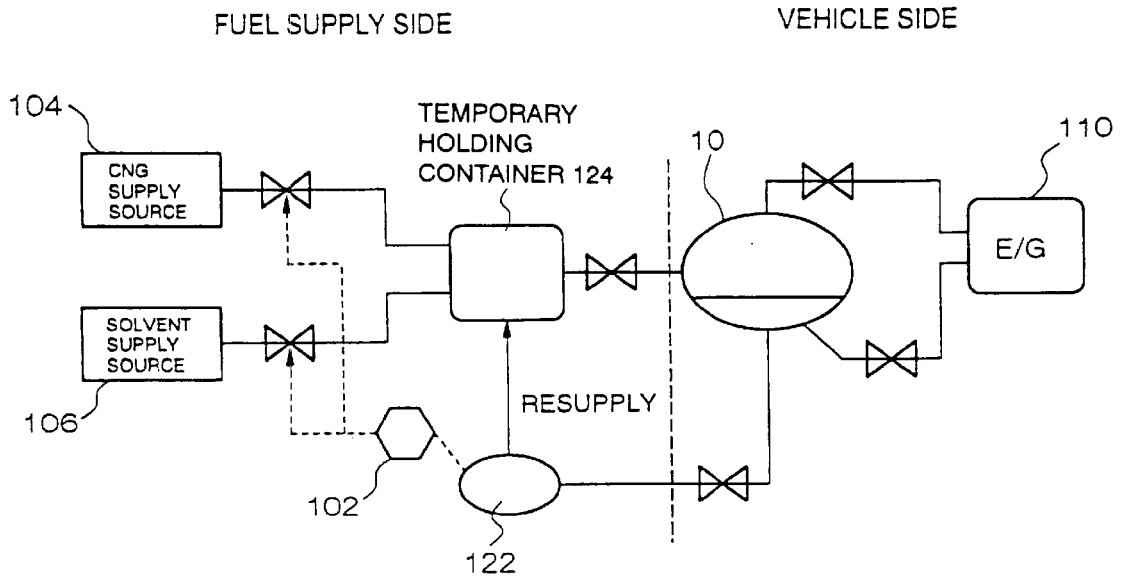
FIG. 50 is a configuration of a preferred Embodiment 19 of the gas liquefying and storing system for gas whose principal ingredient is methane according to the present invention.

FIG. 50 shows a configuration scheme of a preferred Embodiment 19 of the gas liquefying and storing system for methane-base gas according to the present invention. In FIG. 50, a withdrawal container 122 is connected to the storage container 10 to receive the withdrawn remaining fuel from the bottom of the container and, when the storage container 10 is charged with a hydrocarbon solvent and CNG, the remaining fuel in the storage container 10 is first withdrawn and carried to the above withdrawal container 122. The means for determining the conditions in the storage container 102 installed at the withdrawal container 122 detects the rates of the constituents and the quantity of the withdrawn fuel. Then, the quantities of the hydrocarbon solvent and CNG required for recharge are calculated. According to the calculation, a given quantity of hydrocarbon solvent is supplied from the hydrocarbon solvent supply source 106 to a temporarily holding container 124. Then, the withdrawn remaining fuel contained in the withdrawal container 122 is also supplied to the temporarily holding container. Afterward, a given quantity of CNG according to the above calculation is injected from the CNG supply source 104 to the temporarily holding container 124, which boosts the pressure in the temporarily holding container 124. Then, the stored material in the temporarily holding container 124 is released from this container 124 and supplied to the storage container 10.

The above configuration enables easy charging of the storage container 10 with the hydrocarbon solvent, even when the pressure in the storage container 10 is high.

Figure 51:
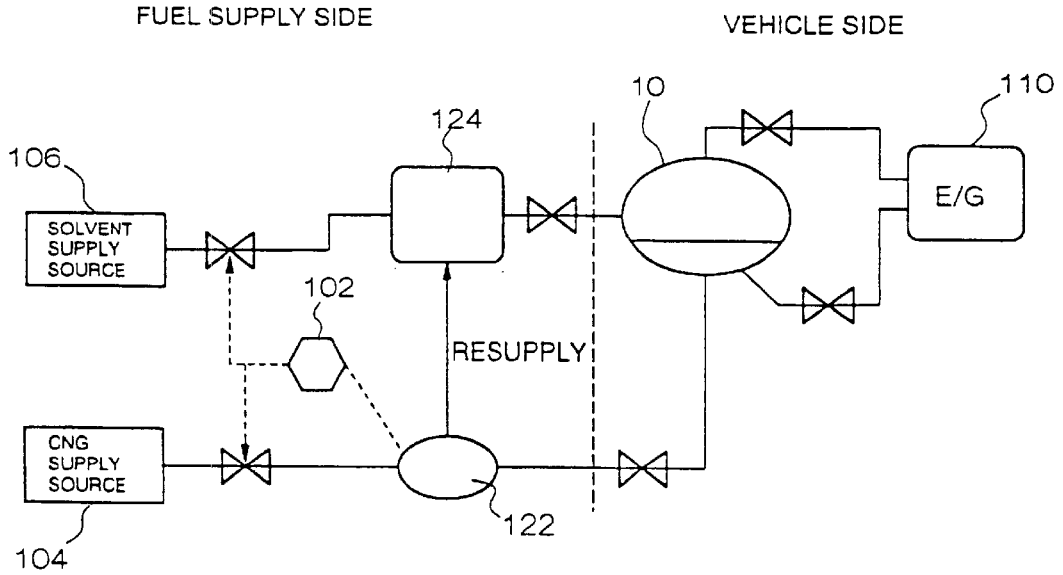
FIG. 51 is an example of modification to the gas liquefying and storing system for gas whose principal ingredient is methane shown in FIG. 50.

FIG. 51 shows an example of modification to the gas liquefying and storing system configuration in this embodiment. For the configuration shown in FIG. 51, CNG is supplied to the withdrawal container 122 instead of to the temporarily holding container 124. After the remaining fuel is withdrawn from the storage container 10 and carried to the withdrawal container 122, the pressure in the storage container 10 becomes low. Consequently, the storage container 10 can directly be charged with the hydrocarbon solvent without the aid of the CNG pressure. Therefore, only the hydrocarbon solvent is supplied to the temporarily holding container 124 and then to the storage container 10. On the other hand, the CNG is supplied to the withdrawal container 122 and the storage container 10 is charged with it together with the withdrawn remaining fuel in the withdrawn container 122. In addition, some of the remaining fuel may be carried from the withdrawal container 122 to the temporarily holding container 124 and then supplied together with the hydrocarbon solvent to the storage container 10.

Figure 52:
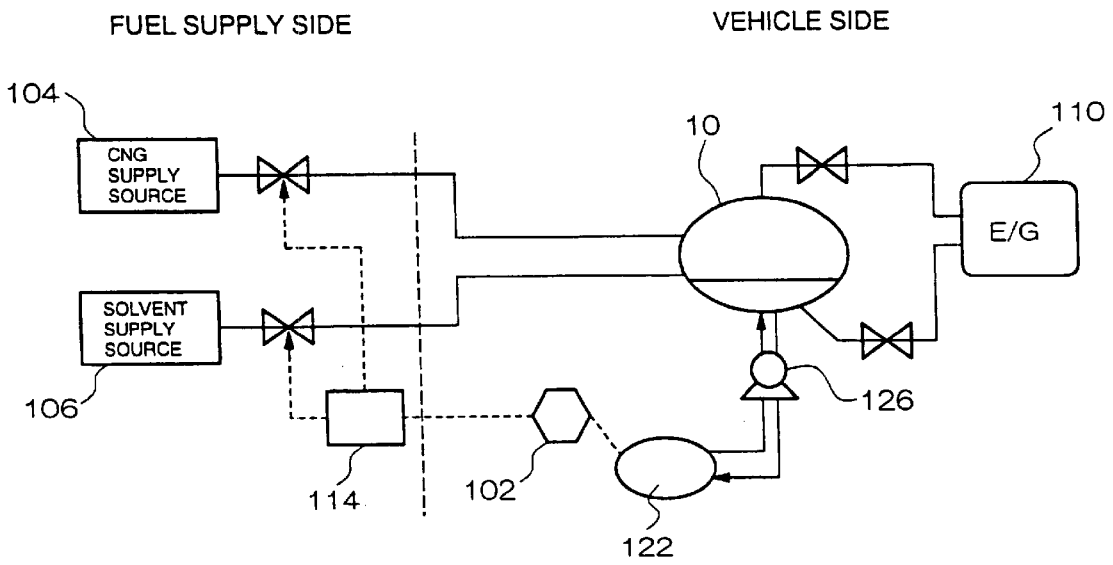
FIG. 52 is another example of modification to the gas liquefying and storing system for gas whose principal ingredient is methane shown in FIG. 50.

FIG. 52 shows another example of modification to the gas liquefying and storing system configuration of this embodiment. In FIG. 52, the withdrawal container 122 is installed on the vehicle side instead of the fuel supply side. This can eliminate the need to construct new facility at the fuel supply side.

In this modification, the means for determining the conditions in the storage container 102 determines, as in FIG. 50, the ratios of the constituents of the remaining fuel withdrawn from the storage container 10 and received by the withdrawal container 122. The result of this determination is sent to the supply ratio control means 114 on the fuel supply side and the supply ratio control means 114 calculates a ratio at which CNG and a hydrocarbon solvent are supplied in quantity required to keep the rates of the fuel constituents constant in the storage container 10. According to the results of this determination, the CNG supply source 104 and the hydrocarbon solvent supply source 106 respectively supply a given quantity of CNG and hydrocarbon solvent to the storage container 10.

By a pump 126, the withdrawn remaining fuel contained in the withdrawal container 122 is returned to the storage container 10.

Figure 53:
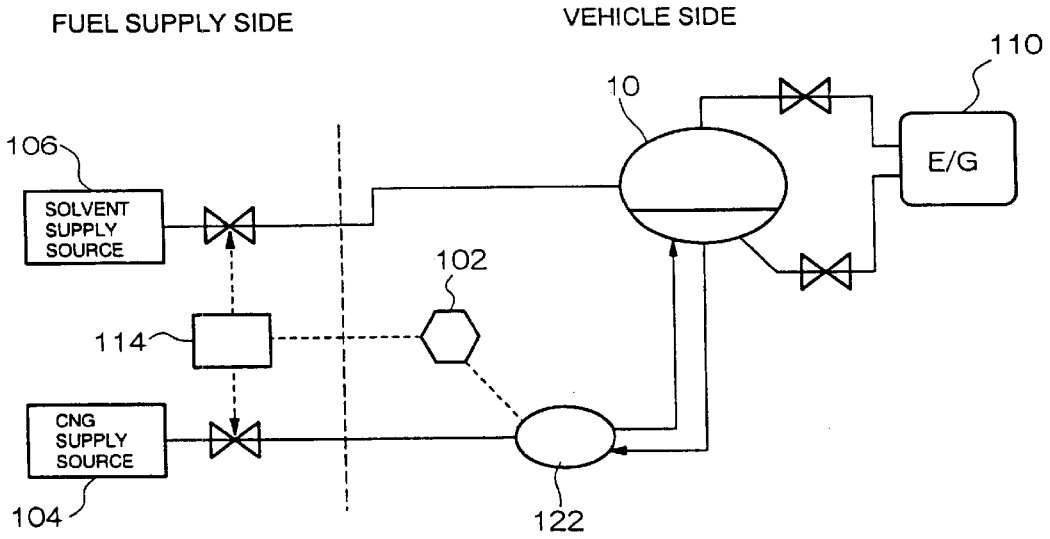
FIG. 53 is another example of modification to the gas liquefying and storing system for gas whose principal ingredient is methane shown in FIG. 50.

Moreover, FIG. 53 shows another example of modification to the gas liquefying and storing system configuration for gas whose principal ingredient is methane in this embodiment. Also in this modification, the withdrawal container 122 is installed on the vehicle side. For this modification, however, the withdrawn remaining fuel contained in the withdrawal container 122 is returned to the storage container 10 by the CNG pressure that is primarily used for supplying the CNG to the withdrawal container 122, and, thus, the pump 126 shown in FIG. 52 is not required.

Embodiment 20

Because an internal combustion engine consumes the methane-bearing hydrocarbon in the storage container 10 as fuel, it is not avoidable that traces of hydrocarbon solvents are supplied to the engine, even when the stored material is discharged only from vapor-phase portion 12 of the storage container 10. Therefore, in addition to the primary fuel that is gas whose principal ingredient is methane, hydrocarbon solvents in which the gas is dissolved need to be supplied to the storage container 10. The supply of the solvents maintains constant rates of the constituents of the material stored in the storage container 10, and consequently the rates of those discharged from the storage container 10 can also be kept constant.

When the storage container 10 is replenished with hydrocarbon solvents, a problem is encountered in that smooth injection of the solvents is difficult due to the low solvent equilibrium pressure. A possible method for resolving this problem is mixing CNG and a hydrocarbon solvent before charging the storage container 10. However, it may be difficult for such a mixture to be prepared on the fuel supply side because of infrastructure limitations.

Figure 54:
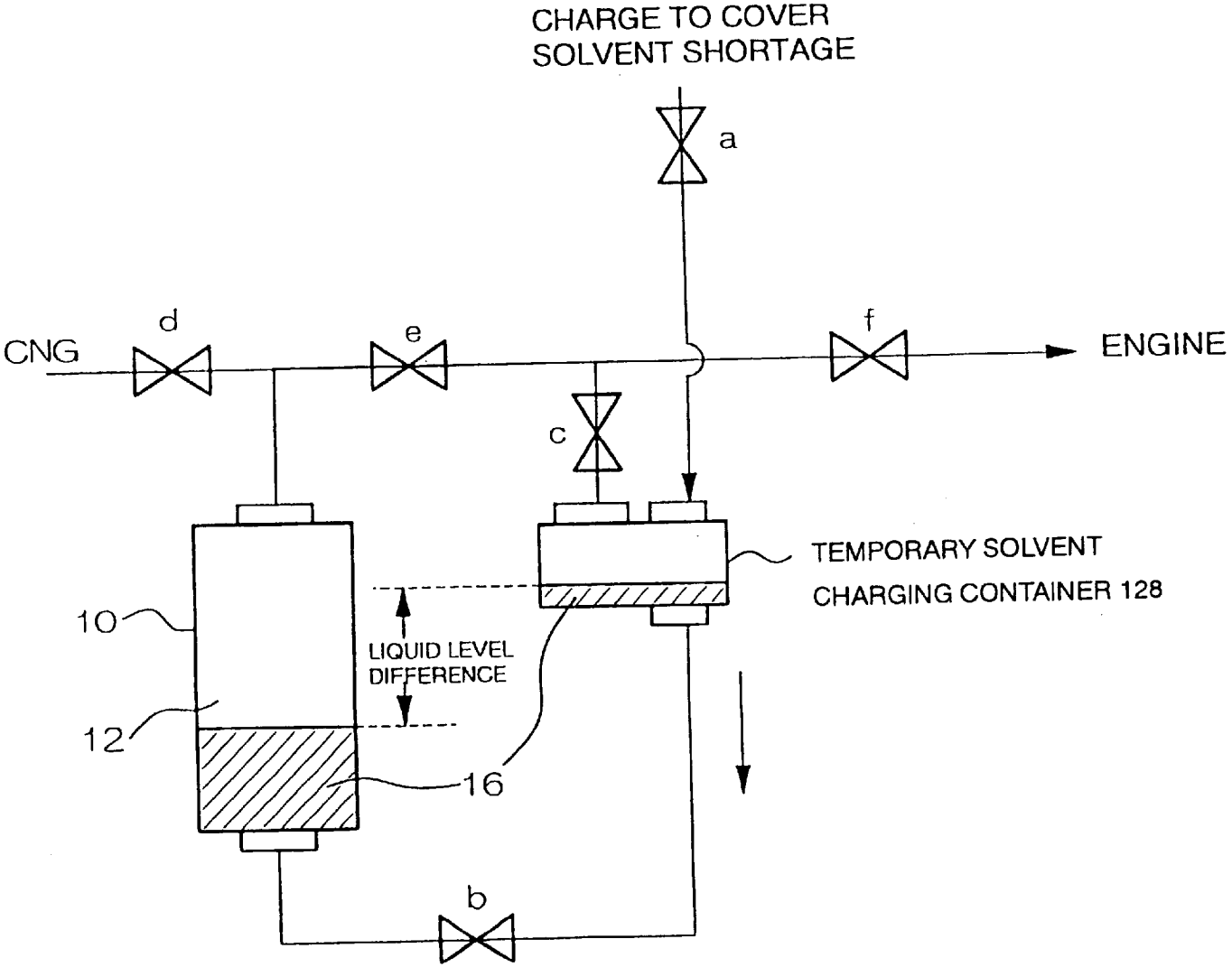
FIG. 54 is a configuration of a preferred Embodiment 20 of the gas liquefying and storing system for gas whose principal ingredient is methane according to the present invention.

FIG. 54 shows a configuration of a preferred Embodiment 20 of the gas liquefying and storing system for gas whose principal ingredient is methane according to the present invention which is able to resolve the above problem. In FIG. 54, a temporary charging container for exclusive solvent use 128 is installed so as to be positioned higher than the liquid level of the storage container 10. To replenish the storage container 10 with hydrocarbon solvents, the temporary charging container for exclusive solvent use 128 is first replenished with only the solvents for covering shortage via a valve (a) with normal pressure being set in the container 128. Then, the valve (a) is closed and a valve (b) for controlling the passage between the temporary charging container for exclusive solvent use 128 and the storage container 10 is opened, and the internal pressure of the two containers is equalized.

As shown in FIG. 54, because the temporary charging container for exclusive solvent use 128 is positioned higher than the liquid level of the storage container 10 as the preceding stage, the level of the liquid-phase portion 16 in the temporary charging container is also higher than the liquid level of the storage container 10. This liquid level difference between the two containers causes the hydrocarbon solvent to move from the temporary charging container for exclusive solvent use 128 to the storage container 10 when the internal pressure of both containers is equal.

The hydrocarbon solvent in the temporary charging container for exclusive solvent use 128 is supplied to the storage container 10 through the above process, but the gaseous hydrocarbon solvent still remains in the container 128. When the engine is activated, a valve (c) is opened and this gaseous solvent is first used so that the pressure in the temporary charging container for exclusive solvent use 128 will decrease. Then, the temporary charging container for exclusive solvent use 128 can be recharged with hydrocarbon solvents.

When the storage container 10 is charged with CNG, a valve (d) to supply CNG to the container 10 is opened. To supply the engine with the stored material, the methane-bearing hydrocarbon from the vapor-phase portion 12 of the storage, valves (e) and (f) are opened.

Figure 55:
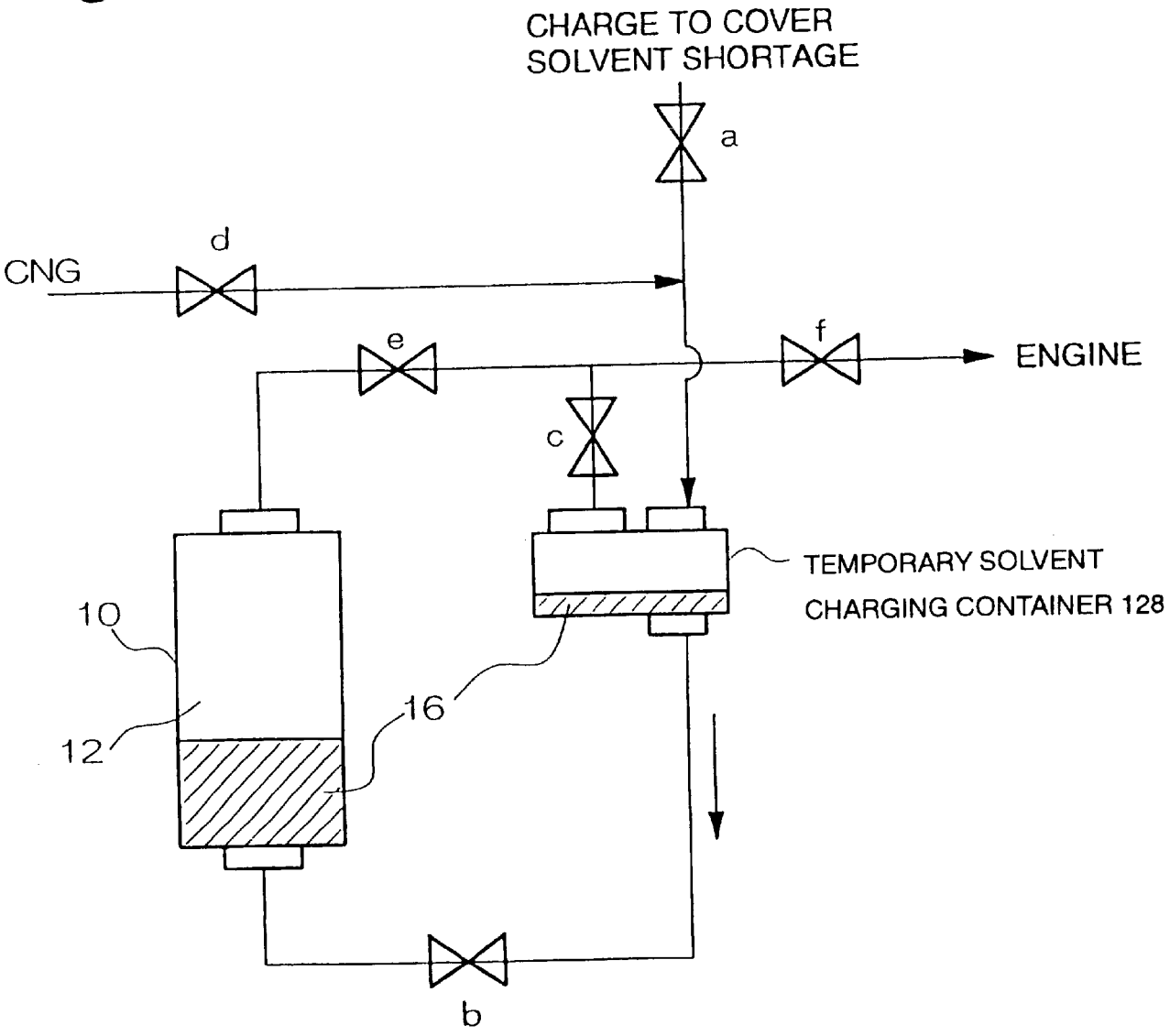
FIG. 55 is an example of modification to the gas liquefying and storing system for gas whose principal ingredient is methane shown in FIG. 54.

FIG. 55 shows an example of modification of the gas liquefying and storing system configuration of this embodiment. In FIG. 55, the source of CNG, the gas whose principal ingredient is methane is connected via the valve (d) to the line through which hydrocarbon solvents are supplied to the temporary charging container for exclusive solvent use 128. This configuration enables the replenished hydrocarbon solvent held in the temporary charging container for exclusive solvent use 128 and enter the storage container 10 as a result of the CNG pressure.

For this modification, the storage container 10 is charged with CNG via the temporary charging container for exclusive solvent use 128.

Figure 56:
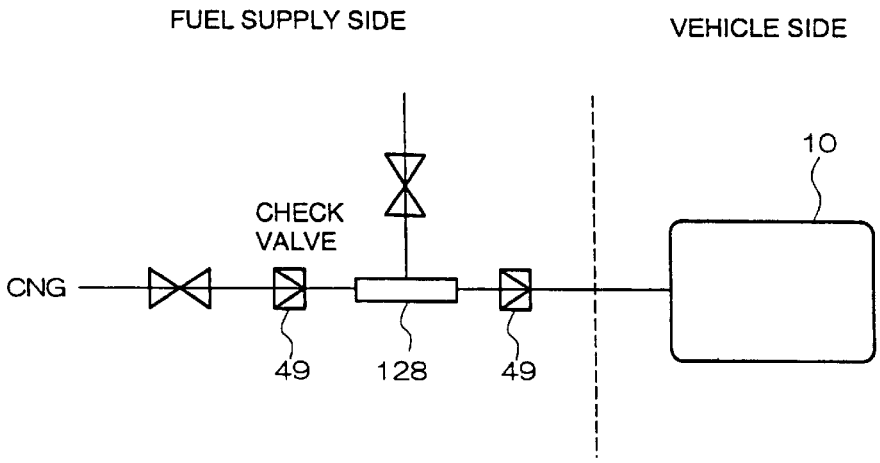
FIG. 56 is another example of modification to the gas liquefying and storing system for gas whose principal ingredient is methane shown in FIG. 54.

In each of the above configurations of this embodiment, the temporary charging container for exclusive solvent use 128 is installed on the vehicle side. On the other hand, FIG. 56 shows another example of modification wherein this container 128 is installed on the fuel supply side. In FIG. 56, the temporary charging container for exclusive solvent use 128 installed on the fuel supply side is replenished with hydrocarbon solvents which are eventually supplied to the storage container 10. These hydrocarbon solvents are fed to the storage container 10, together with the CNG supplied via the check valve 49.

Because a small amount of hydrocarbon solvent is normally carried with the methane fuel from the storage container 10 to the engine, one charge amount of hydrocarbon solvent for replenishing the storage container 10 is also small. Thus, a small capacity of the temporary charging container for exclusive solvent use 128 is sufficient. Consequently, even if the temporary charging container for exclusive solvent use 128 is installed on the fuel supply side, cost-related impediments are reduces. This modification is preferable in that a complex system need not be constructed on the vehicle side.

Embodiment 21

Figure 57:
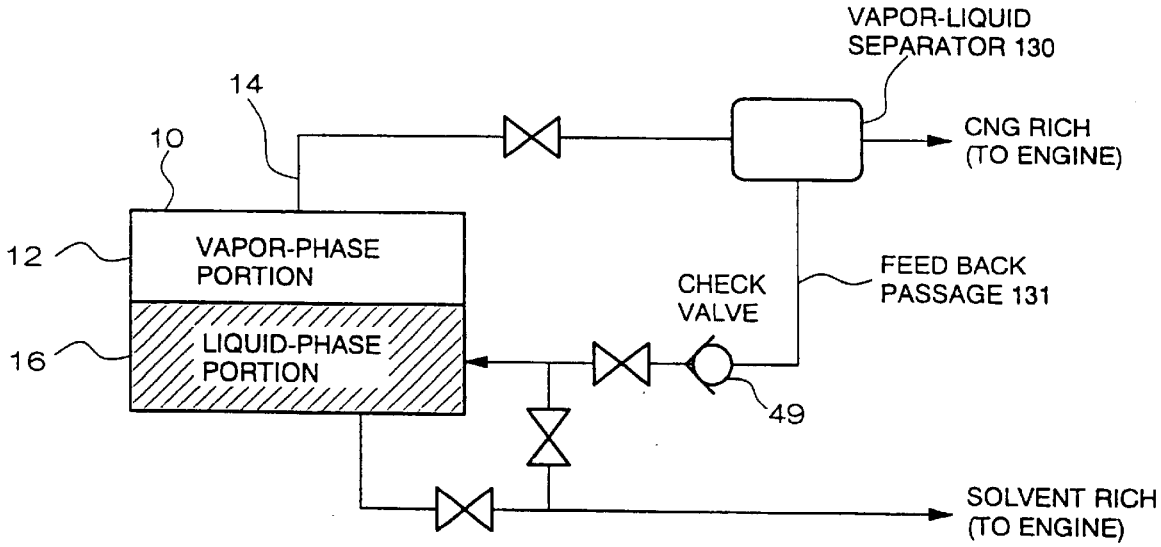
FIG. 57 is a configuration of a preferred Embodiment 21 of the gas liquefying and storing system for gas whose principal ingredient is methane according to the present invention.

FIG. 57 shows a configuration scheme of a preferred Embodiment 21 of the gas liquefying and storing system according to the present invention. In FIG. 57, the storage container 10 holds butane or gasoline used as a hydrocarbon solvent in which natural gas is dissolved and stored as the gas whose principal ingredient is methane. When gasoline is used as the hydrocarbon solvent, a super-critical state takes place in the storage container 10 when the pressure in the container 10 has risen to about 17 MPa during the injection of natural gas blow at room temperature. When butane is used as the hydrocarbon solvent, a super-critical state takes place in the storage container 10 when a pressure of about 15 MPa has been reached during the injection of natural gas. The thus attained super-critical state in the storage container 10 bears fruit, as explained above, that is, higher-density methane can be stored and constant rates of the constituents of the stored material is maintained when the material is discharged from the storage container 10. Moreover, theoretically, when the hydrocarbons exist in a super-critical state in the storage container 10, no liquid phase can exist.

However, gasoline includes miscellaneous substances as constituents, and some of these, such as aromatic additives, knock suppressors, etc. remain as a liquid layer in the storage container 10 even when the super-critical state is reached in the storage container 10. Under these conditions, when the stored material continues to be discharged from the container 10 and used as fuel, the above liquid layer gradually grows in container 10. When the super-critical state eventually changes and the pressure decrease in the storage container 10 causes the separation of the vapor-phase portion 12 and the liquid-phase portion 16, as shown in FIG. 57, the ratio of the constituents of the gasoline forming the liquid-phase portion 16 differs from the initial ratio, resulting in a problem that fuel discharged from the liquid-phase portion 16, comprising the different rates of the constituents from those of the initial gasoline, may impair engine operation.

Figure 58:
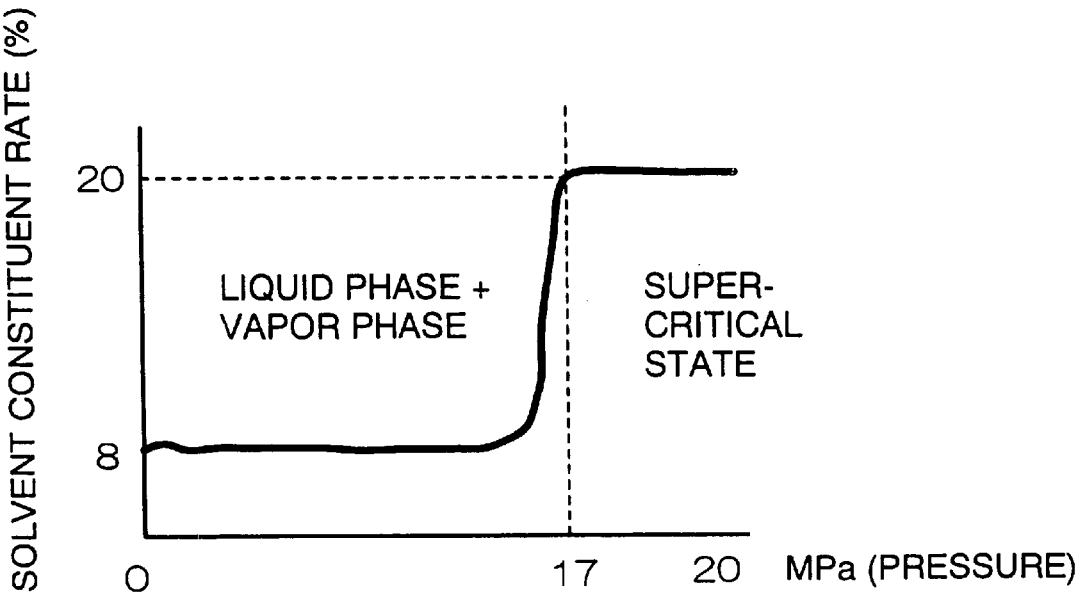
FIG. 58 is a view showing the changing hydrocarbon solvent constituent ratio when the stored material is discharged from the storage container during the super-critical state and the state of coexistent vapor and liquid phases.

FIG. 58 shows the changing hydrocarbon solvent constituent ratios when the stored material is discharged from the storage container 10 under a super-critical state and when the state of coexistent vapor and liquid phases. For the state of coexistent vapor and liquid phase, the stored material is discharged from the vapor-phase portion. As seen from FIG. 58, the hydrocarbon solvent ratio in the stored material when being discharged in the super-critical state is about 20%, while the rate when being discharged from the vapor-phase portion in the state of coexistent vapor and liquid phases decreases to about 8%. This indicates that the ratios of the constituents of the stored material fluctuate to a large extent, depending on whether the super critical state or the state of coexistent vapor and liquid phases exists in the storage container 10.

The configuration of this embodiment shown in FIG. 57 is designed such that the gaseous material is discharged through the vapor-phase outlet 14 provided at the top of the storage container 10, while an amount of liquid hydrocarbon solvent included in the discharged material is separated and withdrawn by a vapor-liquid separator 130. The hydrocarbon solvent withdrawn by the vapor-liquid separator 130 returns to the storage container 10 via a feedback passage 131 equipped with a check valve. Thus, the reduction of the hydrocarbon solvent quantity in the storage container 10 can be suppressed. Even when the super-critical state in the storage container 10 changes to one of coexistent vapor and liquid phases, as implied in FIG. 47, and when the stored material is discharged from the liquid-phase portion 16 of the container 10, the gasoline can be discharged at near its initial ratio of constituents.

Even during the state of coexistent vapor and liquid phases in the storage container 10, the contents of the vapor-phase portion are discharged from the vapor-phase outlet 14 and some hydrocarbon solvent inclusion returns to the storage container 10 after being separated by the vapor-liquid separator 130. This can further suppress the reduction of the hydrocarbon solvent in the storage container 10.

Figure 59:
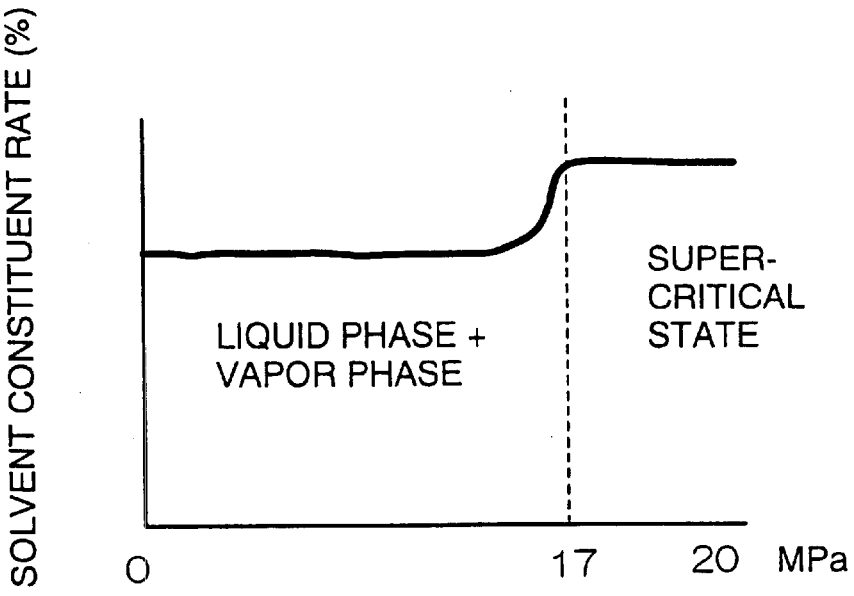
FIG. 59 is a view showing the hydrocarbon solvent constituent ratio at the outlet of a vapor-liquid separator shown in FIG. 57.

The gas separated from the hydrocarbon solvent by the vapor-liquid separator 130 is rich in CNG (natural gas) and can be used as fuel. This CNG-rich gas has a stable composition and a ratio of constituents approximating that of the natural gas dissolved and stored in the storage container 10. FIG. 59 shows the hydrocarbon solvent constituent rate at the outlet of the vapor-liquid separator 130, which changes during the supercritical state and the state of coexistent vapor and liquid phases in the storage container 10. As can be seen from FIG. 59, the hydrocarbon solvent constituent rate in the stored material discharged from the storage container 10 is generally constant for either state. Thus, the rate of the remainder of the stored material, or namely, natural gas, is generally constant when being discharged. The vapor-liquid separator 130 working as explained above is an example of the composition adjusting means included in the present invention.

Figure 60:
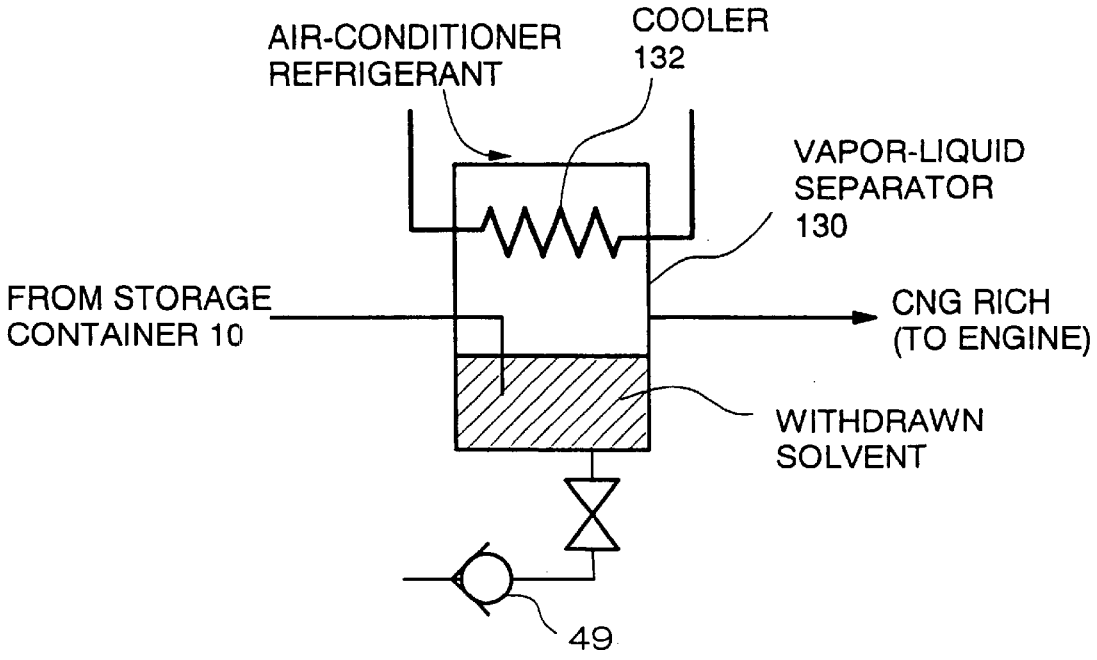
FIG. 60 is a view showing an example of the vapor-liquid separator shown in FIG. 57.

FIG. 60 shows an example of the vapor-liquid separator 130 shown in FIG. 57. In FIG. 60, a cooler 132 cools the stored material that enters the vapor-liquid separator 130 from the storage container 10 so that withdrawal of the solvent can be performed more efficiently by liquefying the hydrocarbon solvent, which has a relatively low boiling point. As a refrigerant for the cooler 130, the refrigerant of a motor vehicle's air-conditioner can be preferably used.

Figure 61:
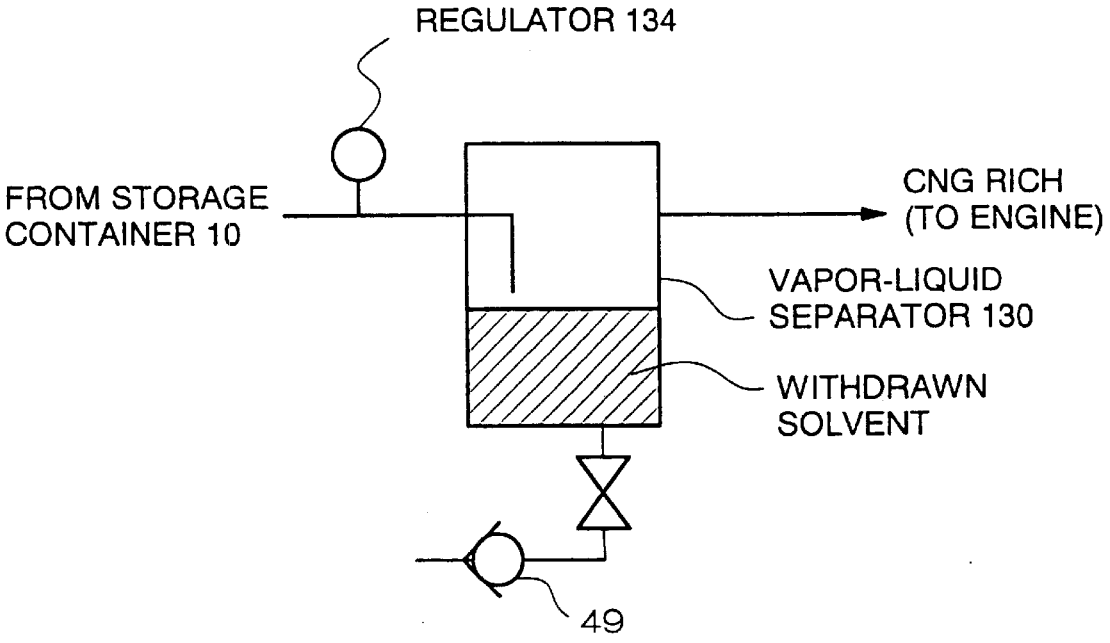
FIG. 61 is a view showing another example of the vapor-liquid separator shown in FIG. 57.

FIG. 61 shows another example of the vapor-liquid separator 130 shown in FIG. 57. In FIG. 61, the stored material discharged from the storage container 10 is decompressed by a regulator 134 before entering the vapor-liquid separator 130. Because the material stored in the storage container 10 in a super-critical state separates into vapor and liquid due to decompression, the operation of the vapor-liquid separator 130 can be hastened. Thus, the hydrocarbon solvent can be withdrawn more efficiently.

Figure 62:
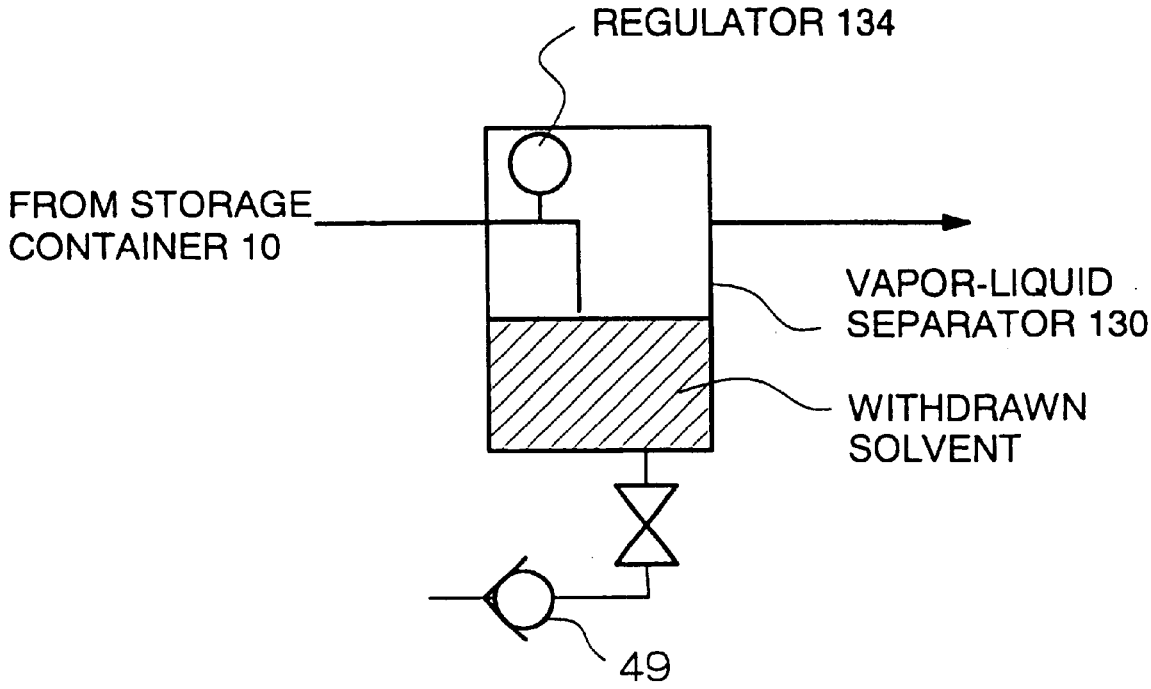
FIG. 62 is a view showing another embodiment of a vapor-liquid separator shown in FIG. 57.

Moreover, FIG. 62 shows another example of the vapor-liquid separator 130 shown in FIG. 57. In FIG. 62, the regulator 134 is installed inside the vapor-liquid separator 130. When the stored material discharged from the vapor-liquid separator 130 is decompressed by adiabatic expansion after entering the regulator 134, the temperature of the regulator 134 also decreases. Therefore, the regulator 134 installed inside the vapor-liquid separator 130 can cool the stored material entering the vapor-liquid separator 130, so that the withdrawal of hydrocarbon solvent can be performed with even greater efficiency.

Embodiment 22

Figure 63:
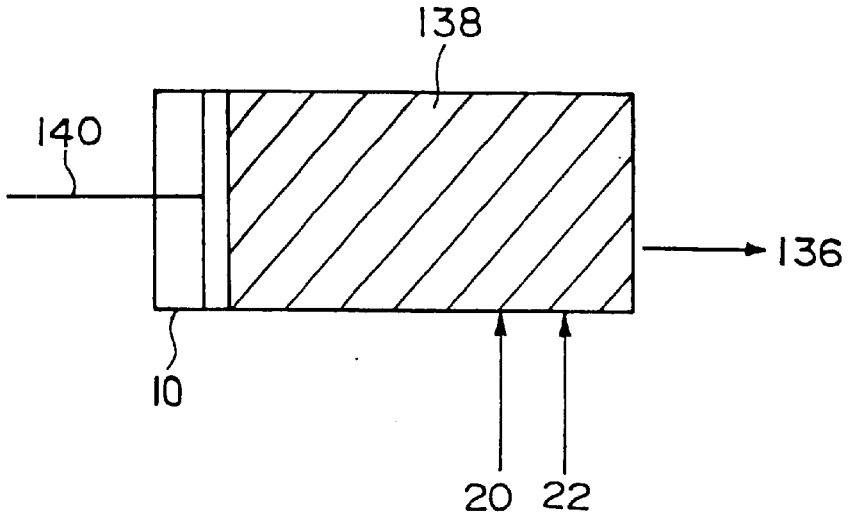
FIG. 63 is a view showing a configuration scheme for discharging the stored material from the storage container in the gas liquefying and storing system for gas whose principal ingredient is methane according to the present invention.

FIG. 63 shows a configuration for discharging the stored material from the storage container 10 in the gas liquefying and storing system for methane-base gas according to the present invention. In FIG. 63, the storage container 10 is furnished with a methane inlet 20 through which the gas whose principal ingredient is methane enters the container and a solvent inlet 22 through which a hydrocarbon solvent for dissolving that gas enters the container. The storage container 10 is also furnished with a solution outlet 136 for discharging the solution of the hydrocarbon solvent in which that gas has been dissolved. As the hydrocarbon solvent, for example, butane, pentane, hexane, and gasoline may be used.

If the above solution 138 is simply discharged through the solution outlet 136 from the storage container 10, space for a vapor-phase portion is formed in the container 10 and methane of great volatility evaporates and occupies the vapor-phase portion. Consequently, the ratio of the constituents of the solution 138 discharged through the solution outlet 136 gradually changes and the methane content decreases. When the ratio of the constituents of the solution 138 of the hydrocarbon solvent in which methane has been dissolved when being discharged through the solvent outlet 136 changes, the combustibility of the solution 138, when used as fuel, changes. Therefore, there is a risk of unstable combustion in an internal combustion engine that uses the solution as fuel.

In this embodiment, the storage container 10 is provided with a piston 140 so that the solution 138 in the container 10 can be discharged while the internal pressure of the container 10 is kept constant. The piston 140 forces out the solution 138 in the storage container 10 while maintaining a constant internal pressure in the container, thereby preventing the vapor-phase portion from being formed in the container 10. Consequently, the ratios of the constituents in the storage container can be kept constant and a solution 138 with constant ratios of the constituents can be discharged from the solution outlet 136. In this embodiment, a pressure gauge not shown senses the pressure in the storage container 10 and the piston 140 is controlled so that the pressure is kept constant.

The piston 140 that works as explained above in this embodiment is an example of the composition adjusting means included in the present invention.

Embodiment 23

Figure 64:
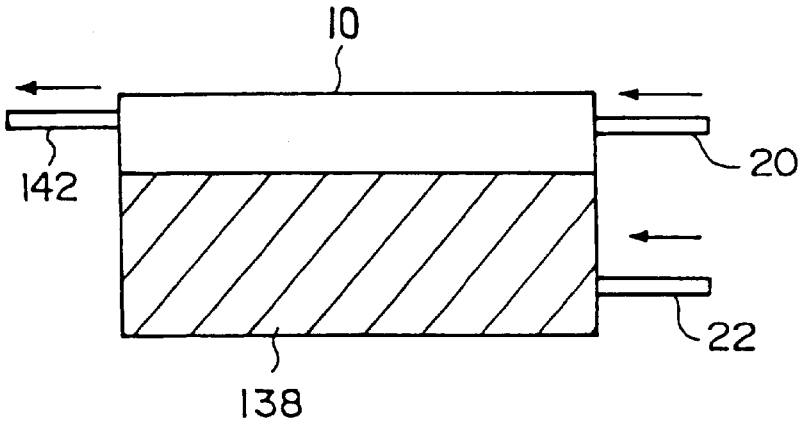
FIG. 64 is a view showing another configuration scheme for discharging the stored material from the storage container in the gas liquefying and storing system for gas whose principal ingredient is methane according to the present invention.

FIG. 64 shows another configuration for discharging the stored material from the storage container 10 in the gas liquefying and storing system according to the present invention. In FIG. 64, the storage container 10 is furnished with a methane inlet 20 through which methane enters the container and a solvent inlet 22 for the introduction of a hydrocarbon solvent, such as butane, pentane, hexane, or gasoline, for dissolving the gas whose principal ingredient is methane. In this embodiment, the gas whose principal ingredient is methane is discharged from the vapor-phase portion of the storage container 10 and used as fuel, and the container 10 is also furnished with a gas outlet 142 for this purpose.

Figure 65:
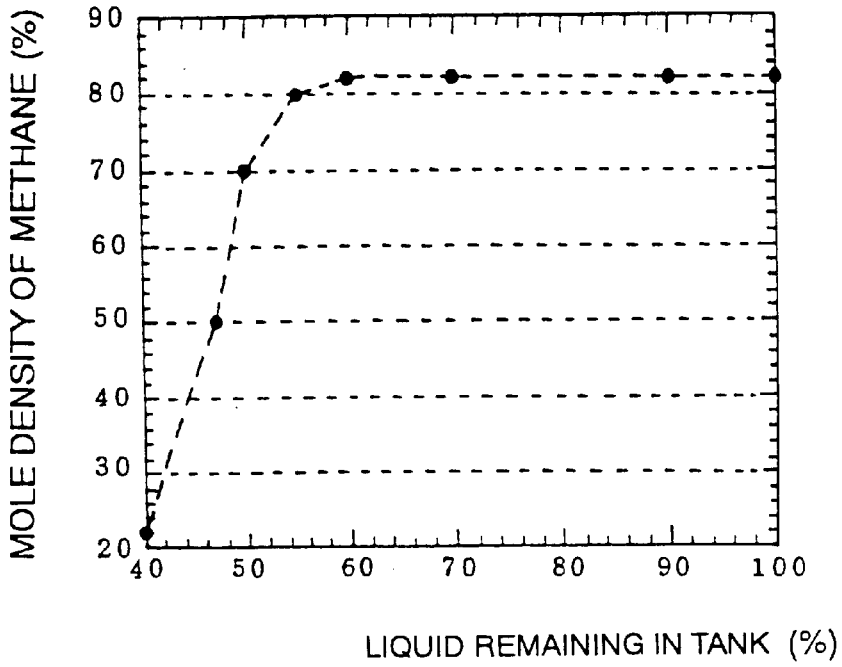
FIG. 65 is a view showing the relationship between the quantity of the solution remaining in the storage container and the mole density of methane in the discharged gas when the stored material is discharged from the vapor-phase portion of the storage container.

FIG. 65 shows the relationship between the ratio of the solution 138 remaining in the storage container 10 and the mole density of methane in the gas discharged from the vapor-portion if the storage container 10 holds the solution 138 of butane in which 82-mole percent methane is dissolved as the stored material and gas is discharged from its vapor-phase portion. As indicated in FIG. 65, the mole density of methane in the gas discharged from the vapor-phase portion is constant before the ratio of the solution 138 remaining in the storage container 10 becomes less than 60%. In this embodiment, therefore, before the above rate becomes less than 60%, the methane gas is discharged as fuel through the gas outlet 142 while the the solution 138 remaining in the storage container 10 is monitored.

In this way, the gas whose principal ingredient is methane with a constant ratio of constituents can be discharged from the storage container 10. In this way, unstable combustion of the gas when used an internal combustion engine can be prevented. Because mainly methane is used as fuel in this embodiment, the consumption of hydrocarbon solvent, which is a limited natural resource, can be reduced and the solvent can be reused.

However, when methane in the solution 138 vaporizes, some hydrocarbon solvent vaporizes along with it. To account for this decrease of the solvent, some hydrocarbon solvent must be replenished to the storage container 10 before the storage container 10 is supplied with methane.

Embodiment 24

Figure 66:
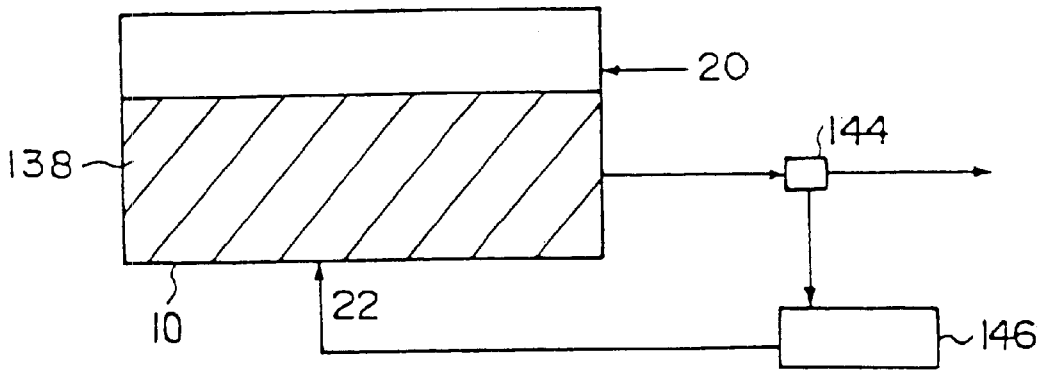
FIG. 66 is a view showing another configuration scheme for discharging the stored material from the storage container in the gas liquefying and storing system for gas whose principal ingredient is methane according to the present invention.

FIG. 66 shows another configuration for discharging the stored material from the storage container in the gas liquefying and storing system for methane-base gas according to the present invention. In FIG. 66, to the storage container 10, a demethanizing chamber 144 is connected that receives the solution 138 discharged from the liquid-phase portion of the storage container 10 and removes the gas whose principal ingredient is methane from the solution.

Low internal pressure of the demethanizing chamber 144 enables the degassing of the solution 138 discharged from the storage container 10, that is, the gas whose principal ingredient is methane can be removed from the solution. The temperature of the solution 138 in the demethanizing chamber 144 decreases as a result of the methane evaporation heat, which suppresses the hydrocarbon evaporation that is concurrent with the vaporization of the solution into the gas whose principal ingredient is methane. Therefore, the quantity of the hydrocarbon solvent in the solution remaining in the demethanizing chamber 144 can be maintained approximately equal to that discharged from the storage container 10. Because the temperature of the solution 138 thus decreases sufficiently when the gas whose principal ingredient is methane is removed from the solution in the demethanizing chamber 144, the capacity of the demethanizing chamber 144 must be adequately smaller than that of the storage container 10. This capacity should be set sufficiently small that no substantial change of internal pressure of the storage container 10 occurs, even when an amount of solution 138 equal to the chamber capacity is discharged from the storage container 10.

The gas whose principal ingredient is methane generated by the degassing of the solution in the demethanizing chamber 144 is fed to an internal combustion engine as fuel and the remaining hydrocarbon solvent is temporarily reserved in a tank for solvent 146. By repeating the above process consisting of discharging solution 138 from the storage container 10, removing the gas whose principal ingredient is methane in the demethanizing chamber 144, and reserving the remaining solvent in the tank for solvent 146, the gas whose principal ingredient is methane stored in the storage container 10 can be used as fuel. The rate of reuse of the hydrocarbon solvent whose estimated amount as natural resources is small can thus be increased. For example, for methane dissolved in butane, this embodiment proved that the remaining butane quantity could increase about 30%, as compared with a case where the demethanizing chamber 144 was not used.

According to this embodiment, as explained above, the rates of the constituents of the stored material discharged from the storage container 10 can be maintained constant. The demethanizing chamber 144 and the tank for solvent 146 that work as explained above are an example of the composition adjusting means included in the present invention.

When the liquid in the storage container has been used up, the following procedure is applied: the gas is completely discharged from the storage container 10 and used as fuel; the hydrocarbon solvent reserved in the tank for solvent 146 is fed back to the storage container 10 through the solvent inlet 22; and methane is allowed to enter the storage container through the methane inlet 20 such that it will dissolve in the hydrocarbon solvent for storage.

Embodiment 25

For the above Embodiments 23 and 24, either a method of discharging the gas whose principal ingredient is methane from the vapor-phase portion of the storage container 10 or a method of separating that gas from the hydrocarbon solvent in the demethanizing chamber 144 is applied. Even by applying these methods, however, it is not avoidable that some hydrocarbon solvent evaporates and blends with the gas whose principal ingredient is methane. Consequently, the hydrocarbon solvent stored in the storage container 10 gradually decreases as the gas whose principal ingredient is methane is used. Therefore, the storage container 10 need to be replenished with an additional hydrocarbon solvent. For this purpose, it is necessary to liquefy a hydrocarbon that is used as the solvent, which requires cooling of the tank for the hydrocarbon solvent, but this process is not easy. In addition, preparing hydrocarbon solvents along with gas whose principal ingredient is methane, such as CNG, increases the load on fuel supply stations.

In this embodiment, an amount of hydrocarbon solvent equal to the anticipated decrease is added in advance to gas whose principal ingredient is methane, so that the storage container 10 will be supplied with gas and hydrocarbon solvent at the same time. As a result, it is not necessary to supply the storage container 10 with a hydrocarbon solvent from the separate source from the methane source. In this manner, the disadvantages described above can be eliminated.

When, for example, methane is dissolved in butane at 140 atm, the butane quantity that can be reused is estimated to be about 70% of the quantity of the initially injected butane into the tank. To compensate this decrease, 5% butane should be added to the methane with which the tank is recharged, which enables the tank to recover the lost butane.

Embodiment 26

As the storage container 10 is charged with gas whose principal ingredient is methane, such as natural gas (CNG), heat of compression is generated because the gas is compressed in the storage container 10. When the volume of the storage container 10 is, for example, 50 liters, the generated heat of compression causes the temperature inside the storage container 10 to rise to about 60° C. higher than the ambient temperature.

Figure 67:
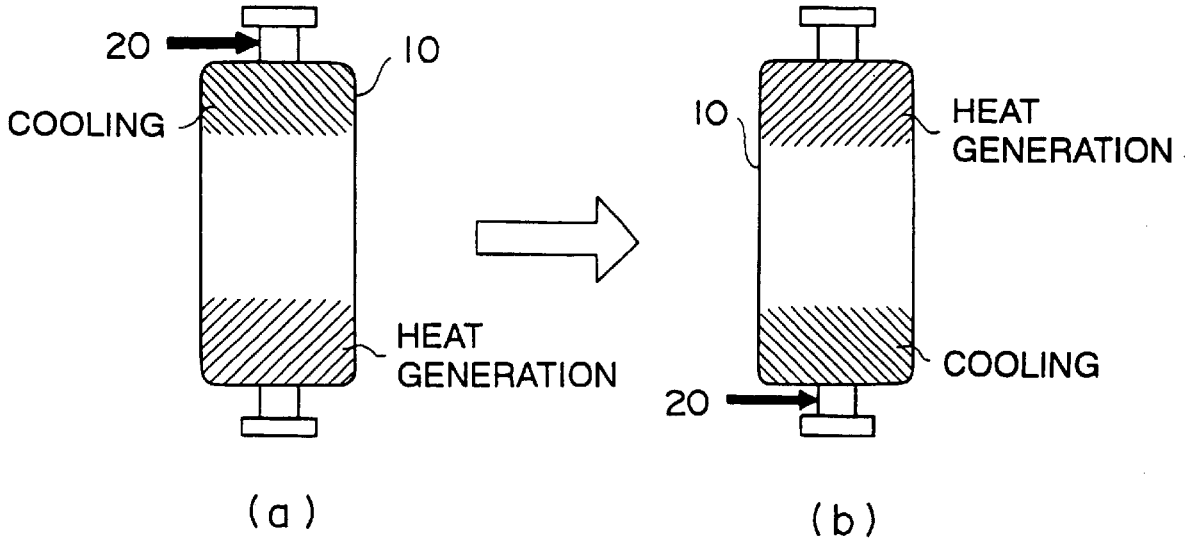
FIG. 67A is a view illustrating the container internal condition when a cylinder-type storage container is charged with CNG.
FIG. 67B is a view illustrating the container internal condition when a cylinder-type storage container is charged with CNG.

FIGS. 67(*a*) and (*b*) illustrate the conditions inside a being charged with CNG when a canister-type container 10 is used as the storage container 10. In FIG. 67(*a*), when the storage container 10 is charged with CNG through the methane inlet 20, heat is generated in the storage container 10 near the opposite end to the methane inlet 20. When heat is generated in the storage container 10, the amount of CNG to be stored in the container 10 decreases because of thermal expansion of the gas.

On the other hand, near the methane inlet 20 of the storage container 20, the temperature decreases because of adiabatic expansion of the injected CNG. Therefore, as shown in FIG. 67(*a*) and (*b*), the cylinder used as the storage container 10 is furnished with two methane inlets 20 that are located apart from each other. For example, one inlet is located on the top end and the other on the bottom end. When charging this cylinder with CNG, CNG is first injected through one methane inlet 20 located at the top of the storage container 10, as shown in FIG. 67(*a*), then charging with CNG is completed through the other methane inlet 22 on the opposite end at the bottom of the container 10. In this manner of charging in two stages, the initially heated end of the container is cooled by adiabatic expansion of the CNG injected in the second stage of charging. In addition, for the end subjected to heat generation by the second CNG injection, temperature rise is not so large because it cooled by adiabatic expansion during the first CNG injection.

For a storage container 10 provided with two methane inlets as described above, temperature rise for the whole unit is suppressed, and, consequently, the CNG density to be stored can be increased. Furthermore, uneven temperature distribution in the storage container 10 can be suppressed. Because stable density of the stored material in the storage container 10 can be attained, stabilization of the ratio of the constituents of the stored material being discharged from the storage container 10 is facilitated. Therefore, it is easy to maintain constant rates of the constituents of the material discharged from the storage container 10.

Embodiment 27

Figure 68:
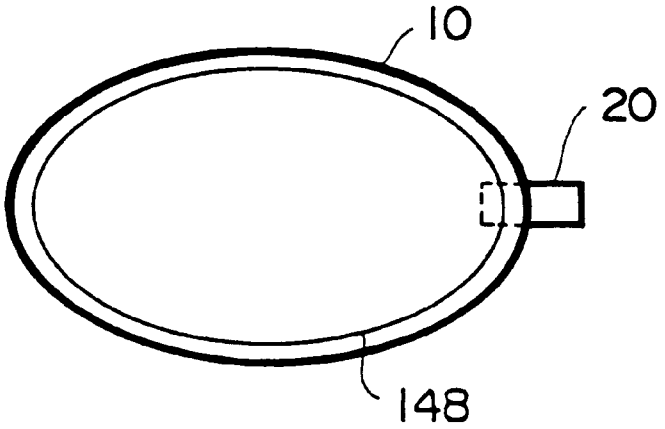
FIG. 68 is a view showing an example of the storage container used for the gas liquefying and storing system for gas whose principal ingredient is methane according to the present invention.

FIG. 68 shows an example of the storage container used for the gas liquefying and storing system for gas whose principal ingredient is methane according to the present invention. In FIG. 68, on the inner walls of the storage container 10 is installed a heat conducting means 148 covering the inner surface of the storage container 10 and connected to the methane inlet 20. Examples of material suitable for the heat conducting means 148 include copper foil and aluminum.

By thus backing the storage container 10 with the heat conducting means 148, the heat conductivity between the inner hot and cold sections created when CNG is injected through the methane inlet 20 is improved, and a more uniform temperature distribution inside the storage container can be achieved. Uneven temperatures inside the storage container 10 can be eliminated, and denser material with stable constituent ratios can be stored.

Figure 69:
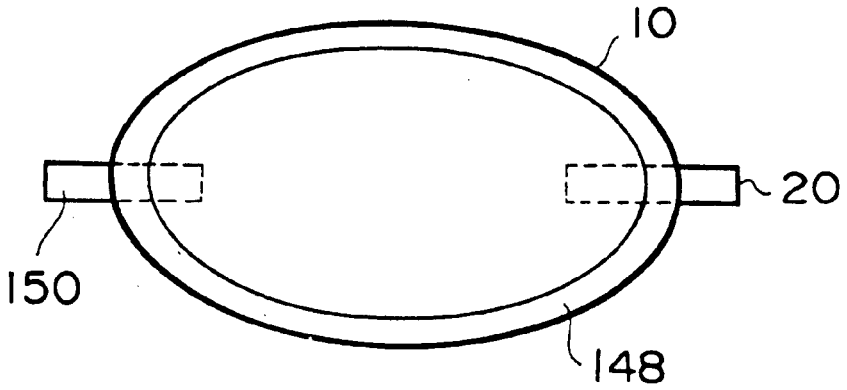
FIG. 69 is a view showing an example of modification to the storage container shown in FIG. 68.

FIG. 69 shows an example of modification to the storage container 10 applied to this embodiment. The storage container 10 shown in FIG. 69 is also backed with the heat conducting means 148. For this modification, in addition to the heat conducting means 148, a heat pipe 150 is connected to the opposite end to the methane inlet 20 of the storage container 10. The heat generated in the storage container 10 is radiated to the outside through the heat pipe 150, and, consequently, the cooling performance of the storage container 10 can be enhanced.

Embodiment 28

Figure 70:
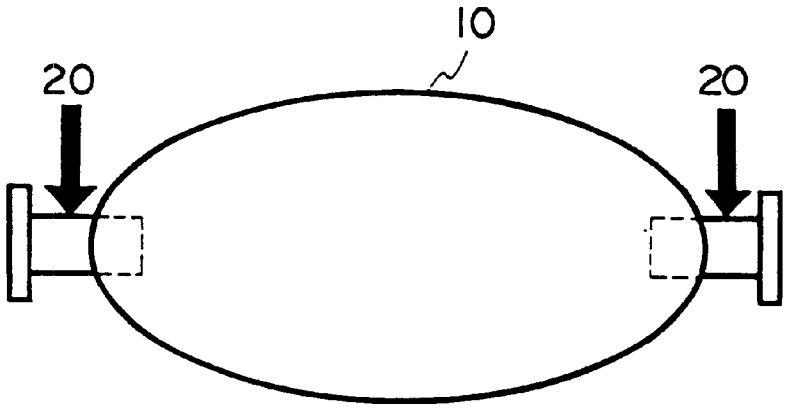
FIG. 70 is a view showing another example of the storage container used for the gas liquefying and storing system for gas whose principal ingredient is methane according to the present invention.

FIG. 70 shows another example of the storage container used for the gas liquefying and storing system for methane-base gas according to the present invention. In FIG. 70, the storage container 10 is furnished with two methane inlets 20 located on opposite ends of the container. In this embodiment, the storage container 10 is charged with gas whose principal ingredient is methane, such as CNG, through the two methane-charging ports 20 simultaneously. This manner of charging causes a phenomenon that the internal sections of the storage container 10 around either end are exposed to heat generation while being cooled. Thus, temperature rise inside the storage container 10 is suppressed, and the density of the stored material can be stabilized.

Embodiment 29

Figure 71:
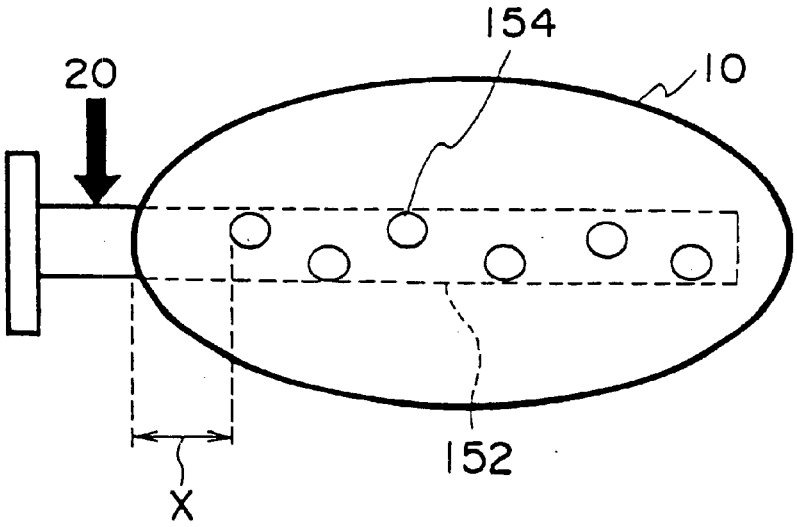
FIG. 71 is a view showing another example of the storage container used for the gas liquefying and storing system for gas whose principal ingredient is methane according to the present invention.

FIG. 71 shows another example of the storage container used for the gas liquefying and storing system for gas whose principal ingredient is methane according to the present invention. In FIG. 71, the storage container 10 is furnished with one methane inlet 20 and an passage extension member 152 that extends from the methane inlet 20, entering the internal space of the storage container 10. The passage extension member 152 has a plurality of release openings for releasing the CNG injected through the methane inlet 20 to the internal space of the storage container 10. Smaller diameters of these release openings 154 cause adiabatic expansion of the CNG when the CNG jets out through these openings. By this adiabatic expansion of the CNG, the stored material in the storage container 10 can be cooled.

In order to reduce the conduction of the low temperature caused by the adiabatic expansion of the CNG released from the release openings 154 to the inner walls of the storage container 10, it is preferable that there be adequate clearance between the inner wall of the storage container 10 and one release opening that is the nearest to the inner wall (as indicated by clearance X in FIG. 71). Therefore, the above low temperature directly cools the stored material in the storage container 10, providing effective cooling.

Furthermore, by increasing the number of the above release openings 154, more cooling points are provided and the heat generation throughout the stored material in the storage container 10 can be suppressed efficiently.

Figure 72:
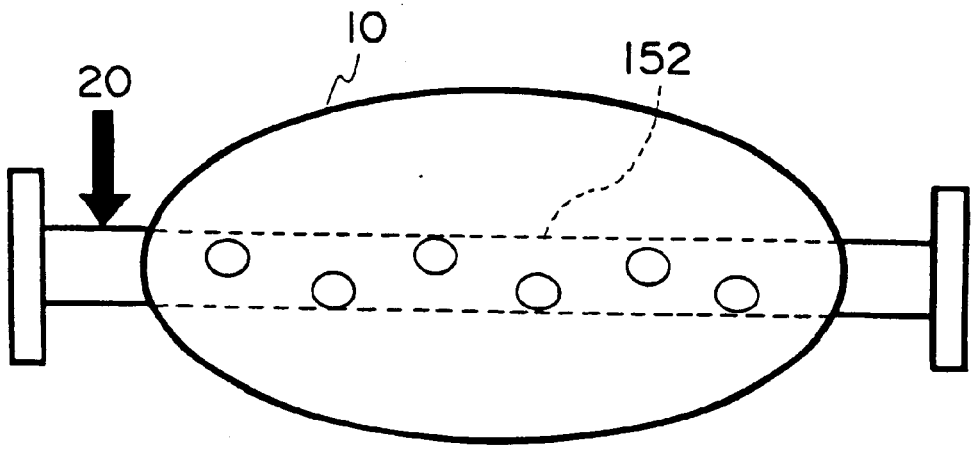
FIG. 72 is a view showing an example of modification to the storage container shown in FIG. 71.

FIG. 72 shows an example of modification to the storage container shown in FIG. 71. In FIG. 72, the passage extension member 152 extends to the other end opposite to the methane 20 inlet and is fixed to the wall of the storage container 10. This structure prevents damage, such as cracking, to the passage extension member 152 even if the storage container 10 vibrates.

Figure 73:
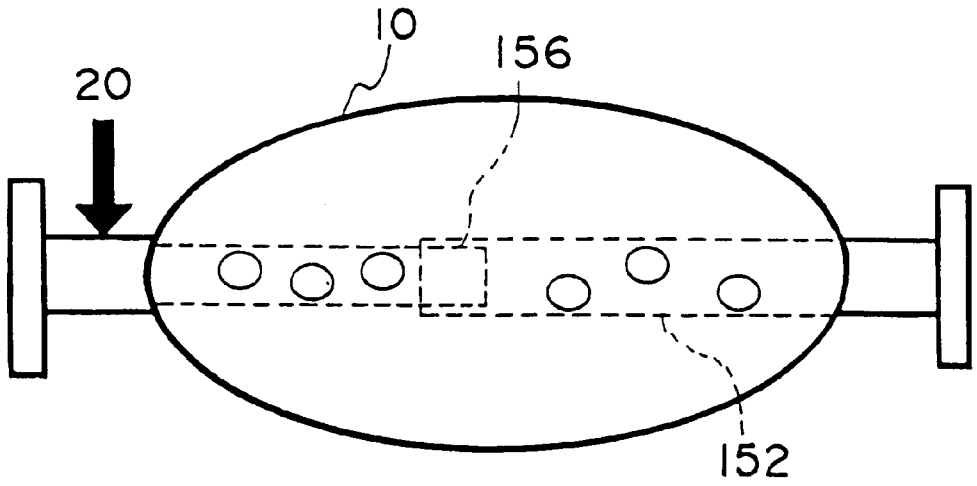
FIG. 73 is a view showing another example of modification to the storage container shown in FIG. 71.

FIG. 73 shows another example of modification to the storage container shown in FIG. 71. In the structure shown in FIG. 73, the passage extension member 152 is divided into two sections nearly in its center. The diameter of one section is made smaller than that of the other section, which enables the connection, by insertion 152; the end of the smaller-diameter section of the member is inserted into the end of the larger-diameter section of the member. Even if the displacement of the storage container 10 differs from that of the passage extension member 152, affected by heat, the above structure of the passage extension member 152 can prevent the application of additional stress to the storage container 10.

Embodiment 30

Figure 74:
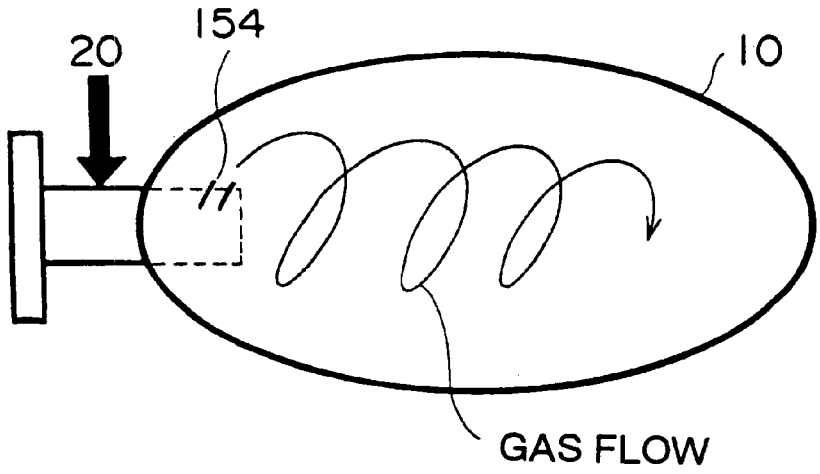
FIG. 74 is a view showing another example of the storage container used for the gas liquefying and storing system for gas whose principal ingredient is methane according to the present invention.

FIG. 74 shows another example of the storage container used for the gas liquefying and storing system according to the present invention. In the structure shown in FIG. 74, the storage container 10 is furnished with release openings 154 connected to the methane inlet 20. The release openings 154 are the gas inlets to the internal space of the container 10, angled so that the gas jets at an angle. When CNG is injected into the storage container 10 through the methane inlet 20, a spiral gas flow of the CNG jet through the release openings 154, as shown in FIG. 74, occurs in the storage container 10. This gas flow agitates the internal space of the storage container 10 and makes the internal temperature distribution uniform. Thus, more precise adjustment of the rates of the constituents of the stored material in the storage container can be achieved.

Embodiment 31

Figure 75:
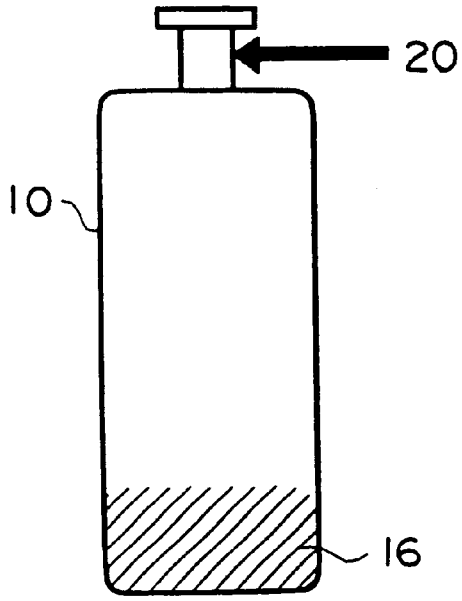
FIG. 75 is a view showing another example of the storage container used for the gas liquefying and storing system for gas whose principal ingredient is methane according to the present invention.

FIG. 75 shows another example of the storage container used for the gas liquefying and storing system for methane-base gas according to the present invention. In FIG. 75, a volatile hydrocarbon solvent is injected into the storage container 10 and forms the liquid-phase portion 16. The methane 20 inlet is provided at the far end of the storage container 10 from the above liquid-phase portion 16 that holds the solvent. When CNG is injected through the methane inlet 20 in the above setup, compression of the CNG generates heat in the liquid-phase portion 16 holding the solvent and this heat evaporates the solvent in the liquid-phase portion 16. The latent heat of this evaporation can suppress internal temperature rise and uneven temperature distribution in the storage container 10. Consequently, the density of the stored material can be stabilized and more precise adjustment of the rates of its constituents can be achieved.

As the above hydrocarbon solvent, suitable are ethers such as diethyl ether, paraffin-base hydrocarbons such as propane, butane, pentane, hexane, and heptane, alcohol such as methyl alcohol, ethyl alcohol, and propyl alcohol, or a composite of these substances, such as, for example, LPG, gasoline, and light oil.

Figure 76:
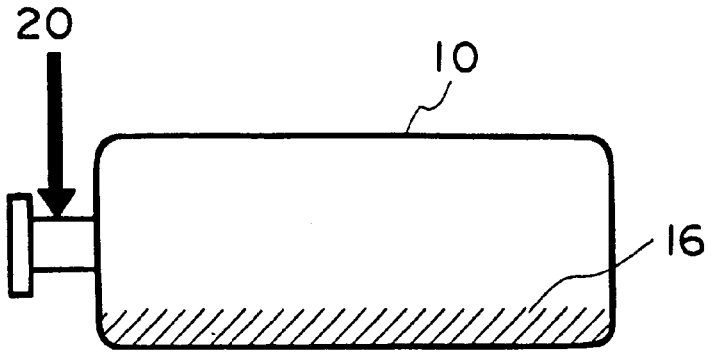
FIG. 76 is a view showing an example of modification to the storage container shown in FIG. 75.

FIG. 76 shows an example of modification to the storage container 10 shown in FIG. 75. In FIG. 76, the storage container installed on its side for use. Thus, a larger area of the liquid level of the liquid-phase portion 16 causes the hydrocarbon solvent to evaporate more readily and greater cooling effect can be produced.

Figure 77:
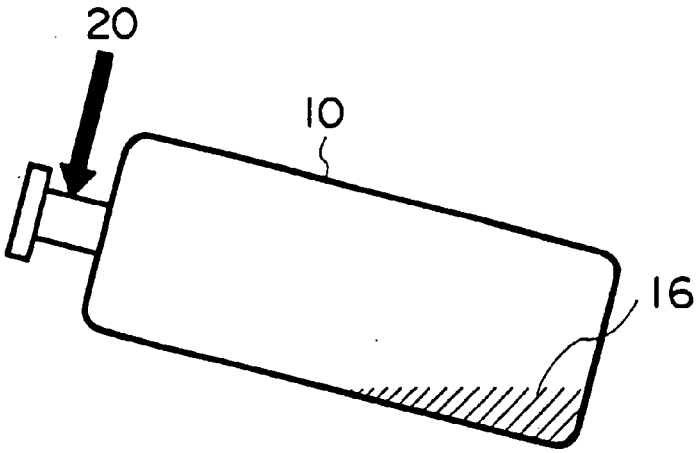
FIG. 77 is a view showing another example of modification to the storage container shown in FIG. 75.

FIG. 77 shows another example of modification to the storage container 10 shown in FIG. 75. In FIG. 77, the storage container 10 is placed on a slope. This installation manner causes more hydrocarbon solvent to collect in the area affected by heat generation when the CNG is injected through the methane inlet 20. Consequently, greater cooling effect can be produced by the latent heat of evaporation.

Embodiment 32

Figure 78:
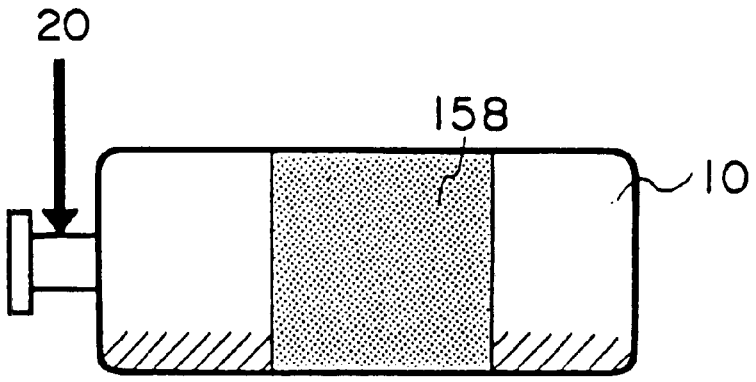
FIG. 78 is a view showing another example of the storage container used for the gas liquefying and storing system for gas whose principal ingredient is methane according to the present invention.

FIG. 78 shows another example of the storage container used for the gas liquefying and storing system for methane-base gas according to the present invention. In FIG. 78, a porous body 158 is fit to the storage container 10. As explained above for FIG. 75, hydrocarbon solvents are adsorbed by the porous body 158. When methane is injected through the methane inlet 20 with solvents being adsorbed by the porous body 158, the larger surface area of the liquid adsorbed by the porous body facilitates evaporation. Consequently, the internal space of the storage container 10 can be efficiently cooled, further suppressing uneven temperature distribution in the storage container 10, thereby facilitating more effective and precise adjustment of the ratios of the constituents in the stored material.

Figure 79:
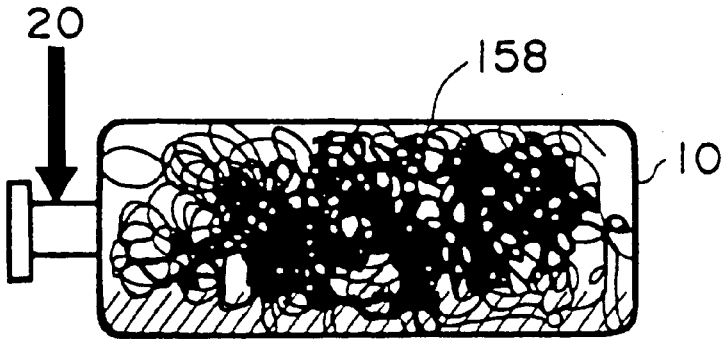
FIG. 79 is a view showing an example of modification to the storage container shown in FIG. 78.

FIG. 79 shows an example of modification to the storage container 10 shown in FIG. 78. In the structure shown in FIG. 79, a metal fiber body is used as the porous body. The metal fiber body can increase the surface area of the hydrocarbon solvent adsorbed on it, and in addition, its high heat-conductivity can produce even greater cooling effect.

Materials which may be used for the metal fiber body include copper fiber, aluminum fiber, and the like.

Figure 80:
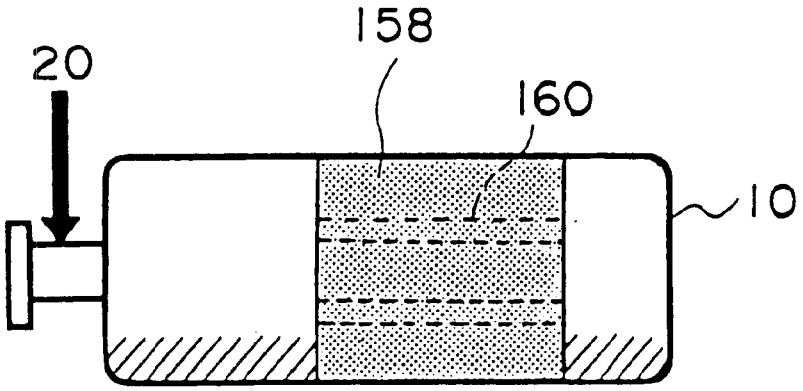
FIG. 80 is a view showing another example of modification to the storage container shown in FIG. 78.

FIG. 80 shows another example of modification to the storage container shown in FIG. 78. In the structure shown in FIG. 80, the porous body 158 is furnished with an airhole 160. This structure can increase the contact area between the CNG and the hydrocarbon solvent adsorbed on the porous body 158, particularly when the internal CNG pressure of the storage container 10 rises exceptionally high. Consequently, the hydrocarbon solvent readily evaporates and greater cooling effect in the storage container 10 can be produced.

Figure 81:
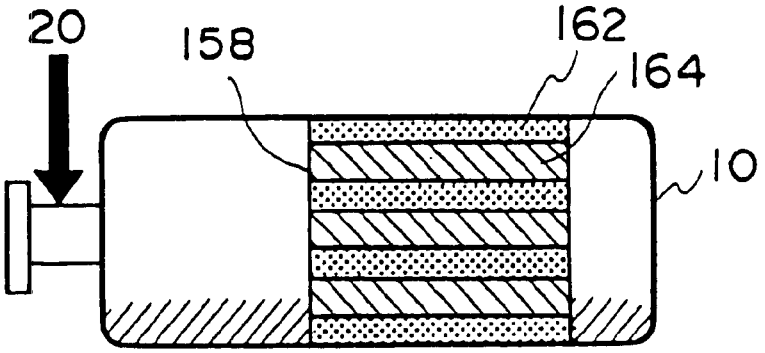
FIG. 81 is a view showing another example of modification to the storage container shown in FIG. 78.

Furthermore, FIG. 81 shows another example of modification to the storage container 10 shown in FIG. 78. In the structure shown in FIG. 81, the porous body 159 comprises a metal fiber body 162 and a resin porous body 164. As the resin porous body 164, for example, a sponge may be used. By thus assembling a layer of the metal fiber body 162 and a layer of resin porous body 164 into the porous body, heat transmission is performed by the metal fiber body 162, while the evaporation of the adsorbed hydrocarbon solvent is performed by the resin porous body 164. In addition, the porous body 158 can be made lighter.

Figure 82:
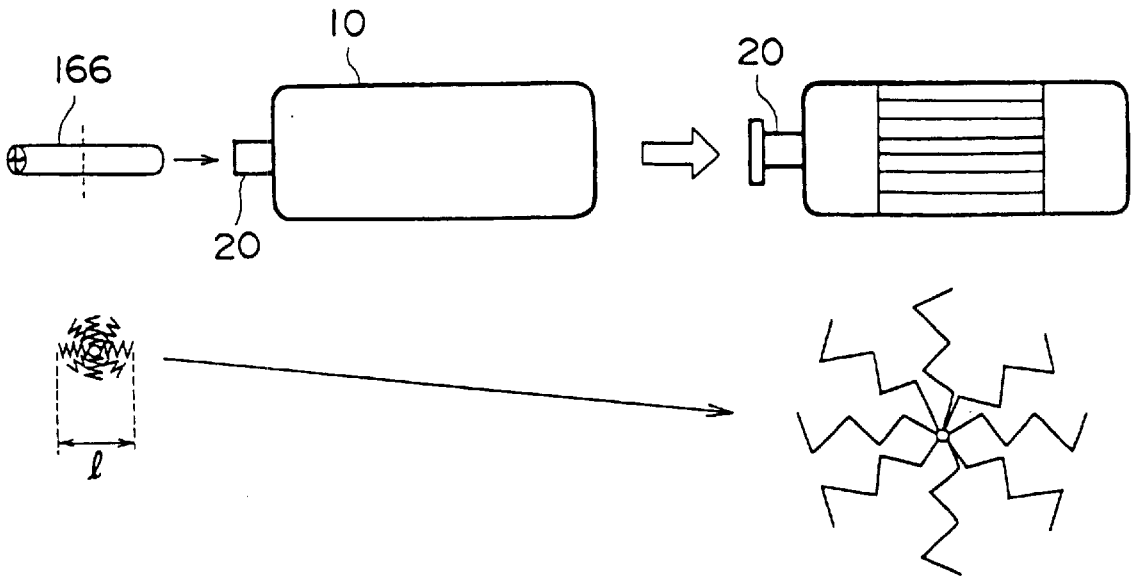
FIG. 82 is a view showing another example of modification to the storage container shown in FIG. 78.

Moreover, FIG. 82 shows another example of modification to the storage container 10 shown in FIG. 78. In the structure shown in FIG. 82, the porous body 158 fit in the storage container 10 is made of shape-memory alloy 166. The initial diameter (l) of this shape-memory alloy 166 shall be smaller than that of the methane inlet 20, and therefore the shape-memory alloy 166 is easily inserted into the storage container 10. After inserted into the storage container 10, the shape-memory alloy 166 expands by heat in the storage container 10 and fixates by exerting the urging force on the inner surface of the storage container 10. By making the porous body 158 of this material, the fabrication process of the storage container 10 can be simplified because the porous body 158 can be inserted after the storage container 10 is fabricated.

Embodiment 33

Figure 83:
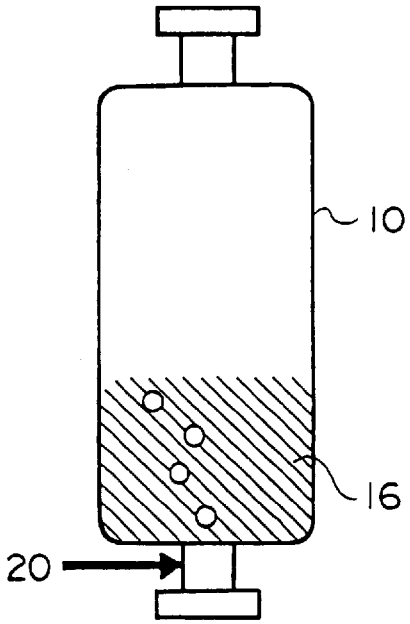
FIG. 83 is a view showing another example of the storage container used for the gas liquefying and storing system for gas whose principal ingredient is methane according to the present invention.

FIG. 83 shows another example of the storage container used for the gas liquefying and storing system for methane-base gas according to the present invention. In the structure shown in FIG. 83, after the storage container 10 is charged with a hydrocarbon solvent, CNG injection according to the above embodiments 26 through 32 is performed until the internal pressure of the storage container 10 has reached 16–18 MPa more or less. Then, CNG is injected through the methane inlet 20 on the liquid-phase portion 16 end of the storage container 10, because little heat is generated after the internal pressure of the storage 10 container reaches 16 MPa or higher. In this way, by applying the second stage of charging the storage container 10 with CNG through the methane inlet 20 provided at the bottom of the container 10, the CNG blows bubbles in the liquid-phase portion 16 while being injected into the container 10. As a result, CNG can be stored in a higher density.

Embodiment 34

Figure 84:
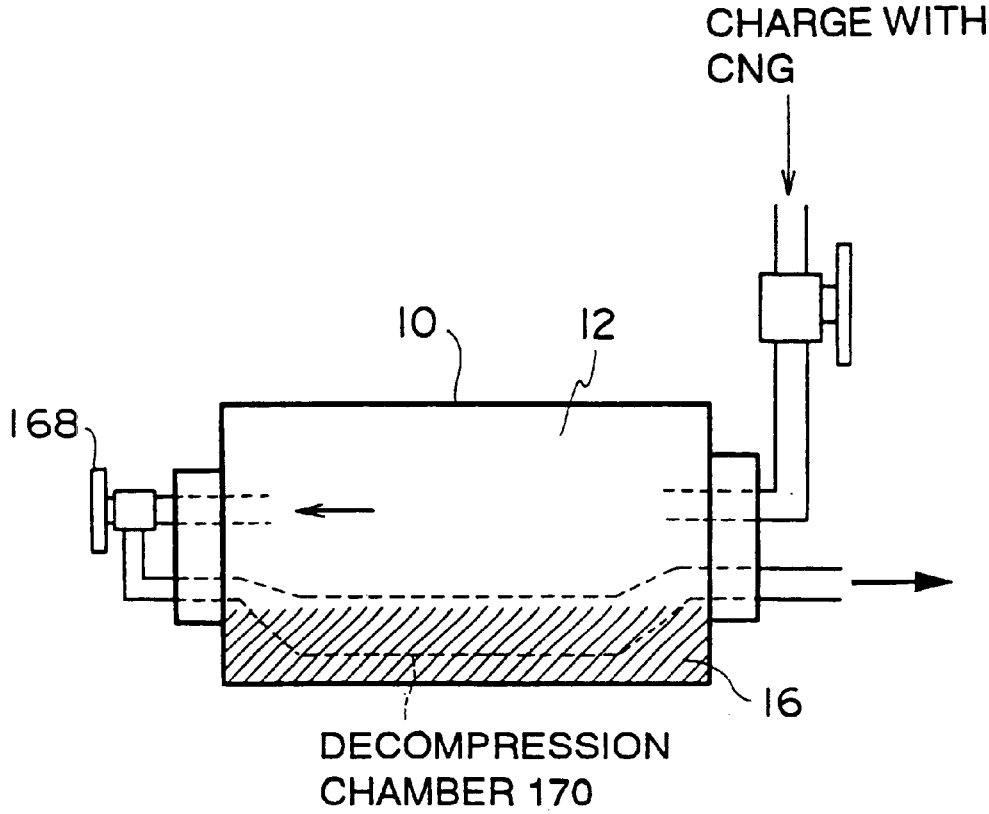
FIG. 84 is a view showing another example of the storage container used for the gas liquefying and storing system for gas whose principal ingredient is methane according to the present invention.

FIG. 84 shows another example of the storage container used for the gas liquefying and storing system for methane-base gas according to the present invention. In the structure shown in FIG. 84, before the storage container 10 is charged with CNG, the gas whose principal ingredient is methane and part of hydrocarbon solvent remained in the storage container 10 is discharged outside via a valve 168 and a decompression chamber (decompression passage) 170. Both cooling by adiabatic expansion of the discharged gas in the decompression chamber 170 and the latent heat of the evaporation from the liquid-phase portion 16 cool the liquid-phase portion 16. Consequently, higher-density CNG can be obtained. The stored material thus discharged is supplied to, for example, an engine that uses fuel.

Figure 85:
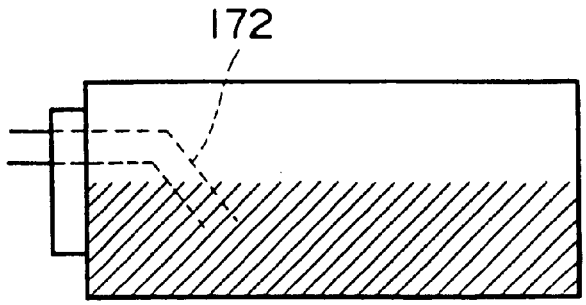
FIG. 85 is a view showing an example of modification to the storage container shown in FIG. 84.

For a container having the example structure shown in FIG. 84, the stored material is mainly discharged from the vapor-phase portion 12 of the storage container 10. However, the hydrocarbon solvent can mainly be discharged by positioning a nozzle 172 with its tip immersed in the hydrocarbon solvent, as shown in FIG. 85. This enables the supply of liquid fuel to an engine if fuel such as gasoline or light oil is used as the hydrocarbon solvent.

Figure 86:
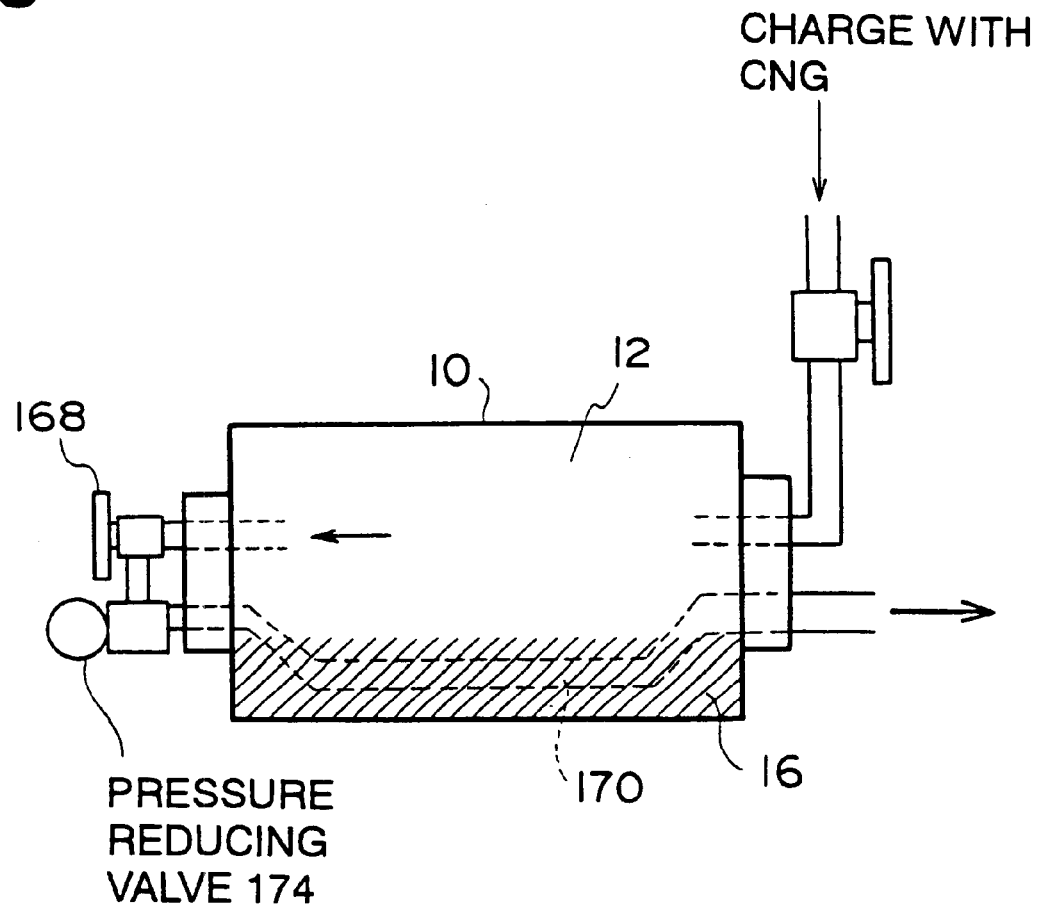
FIG. 86 is a view showing another example of modification to the storage container shown in FIG. 84.

FIG. 86 shows an example of modification to the storage container 10 shown in FIG. 84. In the structure shown in FIG. 86, a pressure-reducing valve 174 is installed between the valve 168 and the decompression chamber 170. This structure can increase the expansion rate of the gas discharged from the vapor-phase portion 12 of the storage container 10 and enables the decompression chamber 170 to produce even greater cooling effect.

Figure 87:
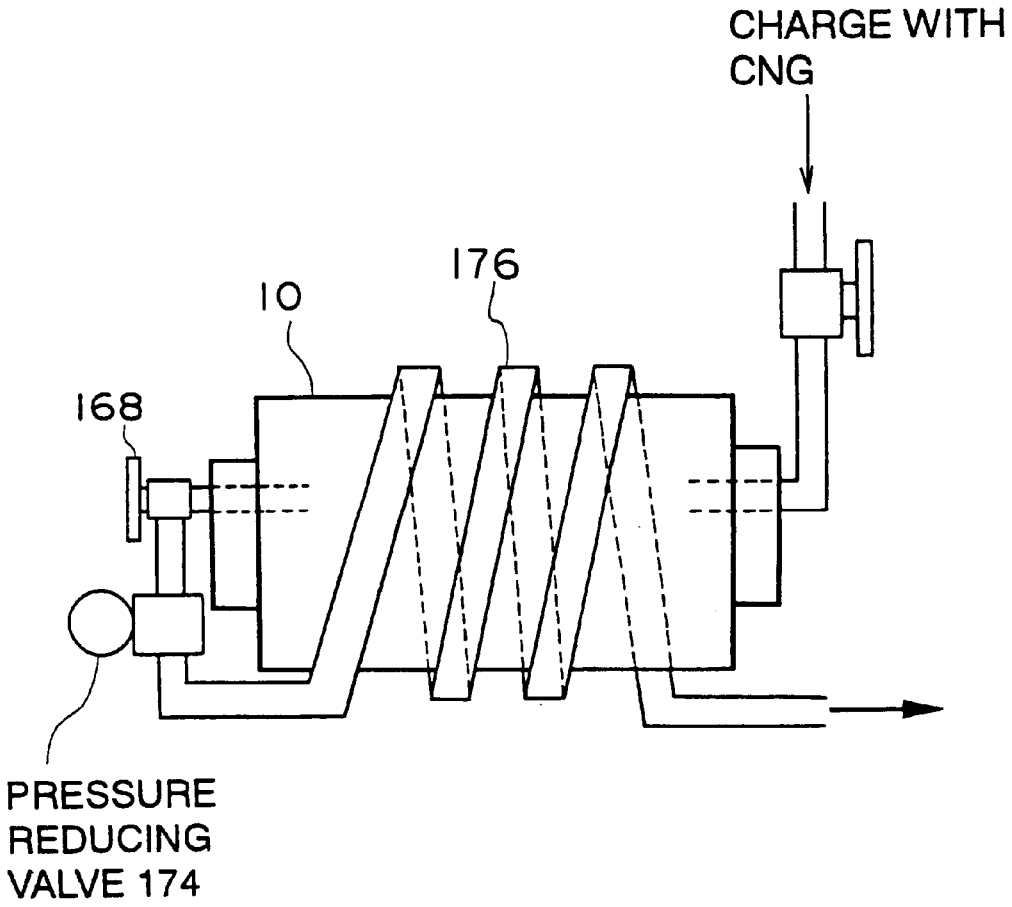
FIG. 87 is a view showing another example of modification to the storage container shown in FIG. 84.

FIG. 87 shows another example of modification to the storage container 10 shown in FIG. 84. In the structure shown in FIG. 87, the gas discharged from the container passes through the pressure-reducing valve 174 and a cooling pipe 176 wrapped around the storage container 10, without passing through the storage container 10, before being discharged. This structure can enhance the cooling effect on the stored material in the storage container 10, particularly when the storage container 10 is made of material such as steel with high heat conductivity.

Figure 88:
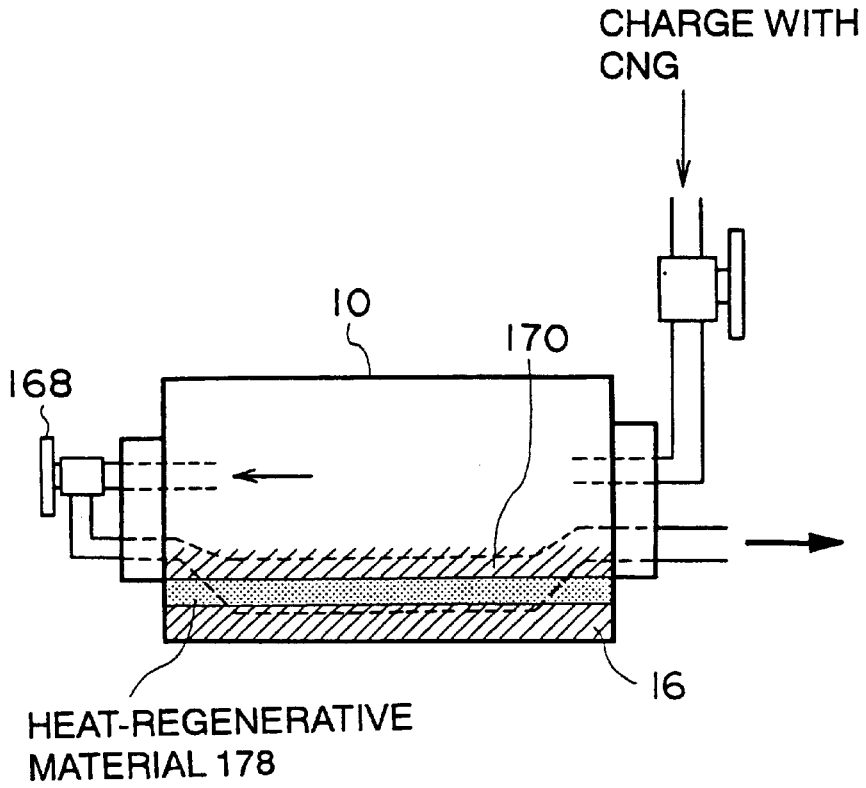
FIG. 88 is a view showing another example of modification to the storage container shown in FIG. 84.

Moreover, FIG. 88 shows another example of modification to the storage container 10 shown in FIG. 84. In the structure shown in FIG. 88, the outer surface of the decompression chamber 170 is covered with heat-regenerative material 178. With this structure, once the temperature of the decompression chamber 170 has become low because of gas discharge, the heat-regenerative material 178 retains this low temperature, and thus the cooling effect can keep on for long time. This can resolve the problem that the storage container 10 is internally cooled only during gas discharge from the container 10 when the engine is operating, but the cooling effect is off during the engine shutdown as the gas discharge stops. This structure can maintain a low temperature of the stored material in the storage container 10, enabling high-density CNG to be stored even when the container is charged with CNG after some time has elapsed, rather than immediately after the engine is turned off.

Embodiment 35

Figure 89:
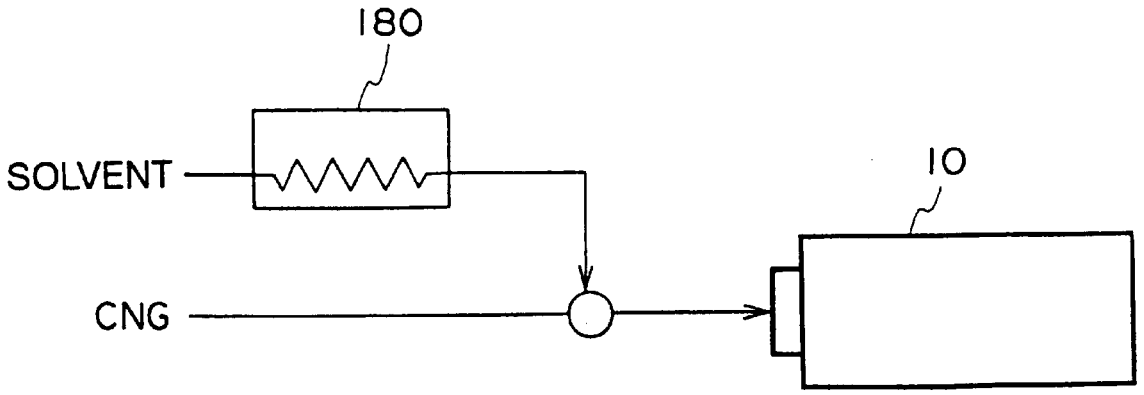
FIG. 89 is a view showing another example of the storage container used for the gas liquefying and storing system for gas whose principal ingredient is methane according to the present invention.

FIG. 89 shows another example of the storage container used for the gas liquefying and storing system for methane-base gas according to the present invention. In FIG. 89, the storage container 10 may be replenished with some hydrocarbon solvent to recover the lost one if necessary, concurrent with being charged with CNG. In this case, the hydrocarbon solvent is cooled by a solvent cooler 180 before being supplied to the storage container 10. This can decrease the temperature of the stored material in the storage container 10 and enables higher-density CNG to be stored.

For example, the above solvent cooler 180 may be installed in a vehicle and the refrigerant of the vehicle's air conditioner may be used to accomplish cooling. If this setup is assembled in a vehicle, a new cooling facility is not required for the fuel supply side and easy charge with high-density CNG is possible.

Furthermore, the above setup in which the solvent cooler 180 cools the hydrocarbon solvent for replenishment may be combined with another cooling method, for example, the one shown in FIG. 84, in which cooling is accomplished by the discharge of the stored material in the storage container 10. This can create even greater cooling effect in the storage container 10.

INDUSTRIAL APPLICABILITY

According to the present invention, as explained above, the composition adjustment means can maintain constant ratios of the constituents of the stored material being discharged from the storage container and stabilize its combustion in an internal combustion engine.

Because gas whose principal ingredient is methane is dissolved in a certain type of hydrocarbon solvent and stored, higher-density methane can be stored.

Moreover, when the gas whose principal ingredient is methane and the hydrocarbon solvent are put to a supercritical state and stored in the storage container, methane can be stored with an even higher density.

When the storage container is recharged, the ratios of the constituent elements of the contents of the storage container are checked and the rates of the constituents of the material to be supplied to the storage container are adjusted. Therefore, the ratios of the constituents of the contents of the storage container can be optimized after the storage container is charged. Consequently, higher-density methane can be stored and stored material can be discharged from the storage container and supplied with a constant constituent ratio to a system for use.

When the stored material is supplied from the vapor-phase portion of the storage container whenever supplied from the storage container to a system that uses it, the amount of the hydrocarbon solvent can be reduced. By determining only the liquid quantity in the storage container, the storage container can be replenished with an appropriate amount of hydrocarbon solvent.

When the hydrocarbon solvent is supplied from the hydrocarbon solvent-dedicated storage container installed on a mobile body to the storage container, the frequency of replenishment of the hydrocarbon solvent from the fuel supply side to the mobile body can be reduced.

When the hydrocarbon solvent in liquid phase is separated from the gaseous part of the stored material discharged from the storage container and returned to the storage container, the amount of consumption of the hydrocarbon solvent in the storage container can be further reduced.

When the stored material is discharged from both vapor-phase and liquid-phase portions of the storage container at a constant rate and supplied from the storage container to a system where it is used, both the ratios of the constituents of the stored material in the storage container and of the material supplied to the system can both be kept constant.

When the storage container is internally cooled when being charged with gas whose principal ingredient is methane, the density of the stored material in the storage container is stabilized and more precise adjustment of the rates of the constituents of the stored material can be achieved. As a result, the ratios of the constituents of the stored material being discharged from the storage container can be easily kept constant.

Moreover, the internal space of the storage container can be efficiently cooled through adiabatic expansion and latent heat of evaporation occurring when the stored material is discharged from the storage container.

When gasoline or light oil is used as the hydrocarbon solvent with which the storage container is charged, the solvent itself can be used as fuel in an emergency.

What is claimed is:

1. A gas liquefying and storing system for a methane-base gas, comprising:

a storage container containing a hydrocarbon solvent for dissolving and storing the methane-base gas, forming liquid phase and vapor phase constituents of a stored material; and a composition adjusting means for maintaining a predetermined compositional ratio of the constituents in said stored material; wherein said composition adjusting means extracts simultaneously said liquid phase and vapor phase constituents from the storage container, and mixes and discharges the extracted liquid phase and vapor phase constituents while maintaining the predetermined compositional ratio during the discharge.

2. The gas liquefying and storing system according to claim 1, wherein said hydrocarbon solvent is a hydrocarbon that is liquid at room temperature.

3. The gas liquefying and storing system according to claim 1, wherein said hydrocarbon solvent is a composite solvent of a hydrocarbon that does not readily liquefy at room temperature and a hydrocarbon that is normally a liquid at room temperature.

4. The gas liquefying and storing system according to claim 1, wherein said hydrocarbon solvent is hexane.

5. The gas liquefying and storing system according to claim 1, wherein said hydrocarbon solvent is gasoline or light oil.

6. A gas liquefying and storing system for a methane-base gas, comprising:

a storage container containing dimethyl ether for dissolving and storing the methane-base gas, forming liquid phase and vapor phase constituents of a stored material; and a composition adjusting means for monitoring a predetermined compositional ratio of the constituents in said stored material; wherein said composition adjusting means extract simultaneously said liquid phase and vapor phase constituents from the storage container, and mixed and discharges the extracted liquid phase and vapor phase constituents while maintaining the predetermined compositional ratio during the discharge.

7. The gas liquefying and storing system according to claim 1, wherein a super-critical state exists in said storage container during at least an initial period of discharge of said stored material.

8. The gas liquefying and storing system according to claim 7, wherein the ratio of the constituents of the stored material of said storage container is such that a content of a hydrocarbon with a carbon number of 3 or higher is between 6 mol % and 45 mol %, and that of a hydrocarbon of a carbon number of 2 or lower is between 93 mol % and 55 mol %.

9. The gas liquefying and storing system according to claim 7, wherein the ratio of the constituents of the stored material of said storage container is such that a content of a hydrocarbon with a carbon number of 3 or higher is between 7 mol % and 65 mol %, and that of a hydrocarbon of a carbon number of 2 or lower is between 93 mol % and 35 mol %.

10. The gas liquefying and storing system according to claim 8, wherein a principal ingredient of a hydrocarbon with a carbon number of 3 or higher is butane.

11. The gas liquefying and storing system according to claim 8, wherein a principal ingredient of a hydrocarbon with a carbon number of 3 or higher is propane.

12. The gas liquefying and storing system according to claim 7, wherein said storage container is temperature-regulated such that a super-critical state will be maintained inside the container.

13. The gas liquefying and storing system according to claim 1, further comprising:

a means for determining conditions in the storage container to determine a ratio of constituents of the hydrocarbon solvent and a quantity of the hydrocarbon solvent contained in said storage container; and a supply ratio control means for calculating a ratio at which said gas and said hydrocarbon solvent are to be supplied to said storage container, based on the result of the above determination, and for executing said supply.

14. The gas liquefying and storing system according to claim 13, wherein said supply ratio control means calculates a supply ratio based on the supply quantity of said gas.

15. The gas liquefying and storing system according to claim 13, wherein said means for determining the conditions in the storage container will determine pressure, temperature, and solvent solution quantity in said storage container and obtain the ratios of the hydrocarbon constituents and the hydrocarbon quantity from these parameters.

16. The gas liquefying and storing system according to claim 13, wherein the hydrocarbon discharged from said storage container is oxidized in an internal combustion engine, and said means for determining the conditions in the storage container determines the ratios of the hydrocarbon constituents based on the output from an air-fuel ratio determining means provided to said internal combustion engine.

17. The gas liquefying and storing system according to claim 1, wherein a vapor-phase outlet is provided at the top of said storage container, a liquid quantity detector is installed to detect the quantity of liquid hydrocarbon solvent in said storage container, only the vapor-phase portion of the material stored in said storage container is discharged through said vapor-phase outlet, and the quantity of hydrocarbon solvent to be supplied for recharging is calculated based on the result of the determination performed by said liquid quantity detector.

18. The gas liquefying and storing system according to claim 13, wherein a withdrawal container is installed to receive the withdrawn remaining hydrocarbon from said storage container, and the withdrawn hydrocarbon and said gas are supplied after the hydrocarbon solvent is supplied.

19. The gas liquefying and storing system according to claim 13, wherein a temporary charging container is connected to said storage container, the hydrocarbon solvent is supplied to said temporary charging container before said gas is supplied, and said hydrocarbon solvent and said gas are together supplied to said storage container.

20. The gas liquefying and storing system according to claim 13, wherein:

a temporary charging container for exclusive solvent use is installed so as to be positioned higher than the liquid level of said storage container in parallel connection with said storage container via piping equipped with a means of controlling passage;

said temporary charging container for exclusive solvent use is charged with the hydrocarbon solvent while said passage is closed; and the hydrocarbon solvent enters said storage container when said passage is open.

21. The gas liquefying and storing system according to claim 13, wherein said storage container is installed on a mobile body and a hydrocarbon solvent-dedicated storage container for storing only the hydrocarbon solvent is connected to said storage container.

22. The gas liquefying and storing system according to claim 1, wherein material stored in a gaseous form is discharged from the vapor-phase portion of said storage container and the hydrocarbon solvent in liquid phase is separated from the discharged gas and returned to said storage container.

23. The gas liquefying and storing system according to claim 1, wherein material stored in a liquid form is discharged from the liquid-phase portion of said storage container in an amount small enough that no substantial change of internal pressure of said storage container occurs and the discharged liquid is returned to said storage container after the vaporization of a gas from said liquid.

24. The gas liquefying and storing system according to claim 1, wherein the vapor-phase hydrocarbon is discharged from the top of said storage container and the liquid-phase hydrocarbon is discharged from the bottom of said storage container at a constant ratio.

25. The gas liquefying and storing system according to claim 24, wherein said storage container is furnished with a liquid quantity detector.

26. The gas liquefying and storing system according to claim 24, wherein the stored material discharged from said storage container is oxidized in an internal combustion engine while the ratio of constituents in the discharged material remain constant as a result of the maintenance of consistent rations of the constituent elements of the contents of said storage container, as determined based on the output from an air-fuel ratio determining means provided to said internal combustion engine.

27. The gas liquefying and storing system according to claim 24, wherein said discharged vapor-phase and liquid-phase hydrocarbons are heated such that the discharged hydrocarbons of different phases blend together.

28. The gas liquefying and storing system according to claim 24, wherein said discharged liquid-phase hydrocarbon is vaporized and then blended together with said discharged vapor-phase hydrocarbon.

29. The gas liquefying and storing system according to claim 2, wherein said storage container is cooled when being supplied with said gas.

30. The gas liquefying and storing system according to claim 2, wherein said storage container is furnished with a plurality of charging ports positioned apart from each other, one of said charging ports is initially used, and charging is switched to another charging port while charging with said gas continues.

31. The gas liquefying and storing system according to claim 2, wherein said storage container is furnished with a heat conducting means covering the inner surface of said storage container and connected to a charging port for said gas provided on said storage container.

32. The gas liquefying and storing system according to claim 2, wherein said storage container is furnished with a plurality of charging ports positioned apart from each other and said charging ports are used at the same time.

33. The gas liquefying and storing system according to claim 2, wherein a passage extension member is installed, extending from a charging port provided on said storage container and entering the internal space of said storage container, and said passage extension member has a plurality of release openings arranged along its longitudinal direction at points sufficiently separated from the inner walls of said storage container.

34. The gas liquefying and storing system according to claim 2, wherein the release openings are angled as internal outlets of a charging port provided on said storage container.

35. The gas liquefying and storing system according to claim 2, wherein a charging port is positioned at the far end from the area that holds the solvent in said storage container.

36. The gas liquefying and storing system according to claim 2, wherein a porous body is installed in said storage container.

37. The gas liquefying and storing system according to claim 30, wherein charging is performed such that the use of a charging port provided at the bottom of said storage container begins while a gas is being charged.

38. The gas liquefying and storing system according to claim 2, wherein a portion of the hydrocarbon solvent is vaporized and released outside said storage container before said storage container is charged with said gas.

39. The gas liquefying and storing system according to claim 2, wherein stored material is released outside said storage container via a decompression passage provided inside or on the surface of said storage container.

40. The gas liquefying and storing system according to claim 39, wherein said decompression passage is covered with heat-regenerative material.

41. The gas liquefying and storing system according to claim 2, wherein said system is charged with a cooled hydrocarbon solvent before being charged with said gas.

42. The gas liquefying and storing according to claim 2, wherein said storage container is furnished with an agitating means.

43. The gas liquefying and storing system according to claim 6, wherein the hydrocarbon solvent can be discharged for immediate use from said storage container.

44. A gas liquefying and storing device for methane-base gas, comprising:

a composition information determining means for determining the ratios of the constituents of material stored in a storage container in which said gas is dissolved in a hydrocarbon solvent and stored; and a sending means for sending the result of the above determination to the supply side from which said gas and said hydrocarbon solvent are supplied to said storage container.

45. A gas liquefying and storing device for methane-base gas, comprising:

a withdrawal container for withdrawing the remaining hydrocarbon from a storage container in which said gas is dissolved in a hydrocarbon solvent and stored;

a determining means for determining the ratios of the constituents of the hydrocarbon in said withdrawal container; and a supply ratio control means for controlling a ratio at which said gas and said hydrocarbon solvent are supplied to said storage container, based on the result of said determination.

46. A gas liquefying and storing device for methane-base gas, wherein, at a stage preceding a storage container in which said gas is dissolved in a hydrocarbon solvent and stored, a temporary charging container for exclusive solvent use is installed via a means for controlling the passage between said storage container and said temporary charging container for exclusive solvent use.

47. A gas liquefying and storing device for methane-base gas, wherein the supply source of said gas and the supply source of a hydrocarbon solvent are connected via respective control means to a temporary storage tank that is in turn connected to a storage container in which said gas is dissolved in said hydrocarbon solvent and stored.

48. A gas liquefying and storing device for methane-base gas, comprising:

a storage container in which said gas is dissolved in a hydrocarbon solvent and stored; and a hydrocarbon solvent-dedicated storage container for storing only said hydrocarbon solvent, connected to said storage container via a control means.

49. A gas liquefying and storing device for methane-base gas, comprising:

a vapor-phase outlet for discharging gaseous stored material, provided at the top of a storage container in which said gas is dissolved in a hydrocarbon solvent and stored;

a vapor-liquid separator for separating liquid from said gaseous stored material; and a feedback passage for returning the liquid separated by said vapor-liquid separator to said storage container.

* * * * *

UNITED STATES PATENT AND TRADEMARK OFFICE

CERTIFICATE OF CORRECTION

PATENT NO. : 6,584,780 B2
DATED : July 1, 2003
INVENTOR(S) : Hibino et al.

It is certified that error appears in the above-identified patent and that said Letters Patent is hereby corrected as shown below:

Column 43,
Line 43, “6 mol %” should read -- 7 mol % --.

Column 46,
Line 9, “storing according” should read -- storing system according --.
Line 13, “claim 6,” should read -- claim 5 --.
Line 40, “use is” should read -- use for charging to the storage container a hydrocarbon solvent having an equilibrium pressure lower than the methane-base gas is --.
Line 41, “between said storage container and said temporary charging” should read -- between the storage container and the temporary charging --.

Signed and Sealed this

Twenty-fifth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,584,780 B2
DATED : July 1, 2003
INVENTOR(S) : Kouetsu Hibino et al.

It is certified that error appears in the above-identified patent and that said Letters Patent is hereby corrected as shown below:

Title page,
Item [63], Related U.S. Application Data ,
"Continuation of application No. 09/868,181, filed on June 15, 2001, now abandoned."
should read -- Continuation of application No. 09/868,181, now abandoned, which is the National Stage of PCT/JP99/07010, filed December 14, 1999. --

Signed and Sealed this

First Day of June, 2004

JON W. DUDAS
*Acting Director of the United States Patent and Trademark Office*